US011499238B2

(12) United States Patent
Luo et al.

(10) Patent No.: US 11,499,238 B2
(45) Date of Patent: Nov. 15, 2022

(54) ALTERNATING CURRENT ELECTROLYSIS FOR USE IN ORGANIC SYNTHESIS

(71) Applicant: WAYNE STATE UNIVERSITY, Detroit, MI (US)

(72) Inventors: Long Luo, Troy, MI (US); Hien M. Nguyen, Bloomfield Hills, MI (US)

(73) Assignee: Wayne State University, Detroit, MI (US)

( * ) Notice: Subject to any disclaimer, the term of this patent is extended or adjusted under 35 U.S.C. 154(b) by 0 days.

(21) Appl. No.: 17/141,036

(22) Filed: Jan. 4, 2021

(65) Prior Publication Data

US 2021/0207274 A1 Jul. 8, 2021

Related U.S. Application Data

(60) Provisional application No. 62/957,092, filed on Jan. 3, 2020.

(51) Int. Cl.

| | |
|---|---|
| ***C25B 3/03*** | (2021.01) |
| ***C25B 3/05*** | (2021.01) |
| ***C25B 3/09*** | (2021.01) |
| ***C25B 3/11*** | (2021.01) |
| ***C25B 3/23*** | (2021.01) |
| ***C25B 3/25*** | (2021.01) |
| ***C25B 3/29*** | (2021.01) |
| ***C25B 11/043*** | (2021.01) |
| ***C25B 3/07*** | (2021.01) |

(52) U.S. Cl.

CPC ..... *C25B 3/29* (2021.01); *C25B 3/03* (2021.01); *C25B 3/05* (2021.01); *C25B 3/07* (2021.01); *C25B 3/09* (2021.01); *C25B 3/11* (2021.01); *C25B 3/25* (2021.01); *C25B 11/043* (2021.01)

(58) Field of Classification Search

CPC .... C25B 3/03; C25B 3/05; C25B 3/09; C25B 3/11; C25B 3/23; C25B 3/25

USPC ..... 205/413, 423, 460, 461, 427, 439

See application file for complete search history.

(56) References Cited

U.S. PATENT DOCUMENTS 4,096,052 A * 6/1978 Weinberg ..... C25B 3/23 205/352

5,968,335 A * 10/1999 Torii ..... C25B 3/23 205/425

OTHER PUBLICATIONS

Andrieux, et al., "Observation of the cation radicals of pyrrole and of some substituted pyrroles in fast-scan cyclic voltammetry. Standard potentials and lifetimes," Journal of the American Chemical Society, vol. 112, No. 6, 1990, pp. 2439-2440.

Bard & Faulkner, et al., "Electrochemical Methods: Fundamentals and Applications," John Wiley & Sons, Inc., New York City, New York, 1980, pp. 15-16.

Cross, et al., "A voltammetric survey of steric and BETA-linkage effects in the electropolymerisation of some substituted pyrroles," Journal of Electroanalytical Chemistry and Interfacial Electrochemistry, vol. 189, No. 2, 1985, pp. 389-396.

De Rosa, "Chlorination of pyrrole. N-Chloropyrrole: formation and rearrangement to 2- and 3-chloropyrrole," Journal of Organic Chemistry, vol. 47, No. 6, 1982, pp. 1008-1010.

(Continued)

*Primary Examiner* — Edna Wong

(74) *Attorney, Agent, or Firm* — Lee & Hayes, P.C.

(57) ABSTRACT

The current disclosure provides alternating current based systems and methods to develop chemical compounds, such as drug molecules using electrochemistry in organic synthesis.

19 Claims, 59 Drawing Sheets

(56) References Cited

OTHER PUBLICATIONS

Diaz, et al., "Electrochemistry of some substituted pyrroles," Journal of Electroanalytical Chemistry and Interfacial Electrochemistry, vol. 130,1981, pp. 181-187.
Espinoza, et al., Practical Aspects of Cyclic Voltammetry: How to Estimate Reduction Potentials When Irreversibility Prevails, Journal of The Electrochemical Society, vol. 166, No. 5, 2019, pp. H3175-H3187.
Hartmer & Waldvogel, "Electroorganic synthesis of nitriles via a halogen-free domino oxidation-reduction sequence," Royal Society of Chemistry, vol. 51, 2015, pp. 16346-16348.
Honraedt, et al., "Copper-catalyzed free-radical C-H arylation of pyrroles," Chemical Communications, vol. 50, No. 40, 2014, pp. 5236-5238.
Ishifune, et al., "Electroreduction of aliphatic esters using new paired electrolysis systems," Electrochimica Acta, vol. 46, No. 20-21,2001, pp. 3259-3264.
Joe & Doyle, "Direct Acylation of C(sp3)-H Bonds Enabled by Nickel and Photoredox Catalysis," Angewandte Chemie International Edition, vol. 55, No. 12, 2016, pp. 4040-4043.
Jud, et al., "Cathodic C-H Trifluoromethylation of Arenes and Heteroarenes Enabled by an in Situ-Generated Triflyltriethylammonium Complex," Organic Letters, vol. 21, No. 19, 2019, pp. 7970-7975.
Koike & Akita, "New Horizons of Photocatalytic Fluoromethylative Difunctionalization of Alkenes," Chem, vol. 4, No. 3, 2018, pp. 409-437.
Llorente, et al., "Paired Electrolysis in the Simultaneous Production of Synthetic Intermediates and Substrates," Journal of The American Chemical Society, vol. 138, No. 46, 2016, pp. 15110-15113.
Ma, et al., "Direct Arylation of a-Amino C(sp3)-H Bonds by Convergent Paired Electrolysis," Angewandte Chemie International Edition, vol. 131, No. 46, 2019, pp. 16700-16704.
Martins, et al., "A Green Approach: Vicinal Oxidative Electrochemical Alkene Difunctionalization," ChemElectroChem, vol. 6, No. 5, 2018, pp. 1300-1315.
McNally, et al., "Discovery of an ALPHA-Amino C-H Arylation Reaction Using the Strategy of Accelerated Serendipity," Science, vol. 334, No. 6069, 2011, pp. 1114-1117.
Moeller, "Using Physical Organic Chemistry to Shape the Course of Electrochemical Reactions," Chemical Reviews, vol. 118, No. 9, 2018, pp. 4817-4833.
Nagib & MacMillan, Trifluoromethylation of arenes and heteroarenes by means of photoredox catalysis, Nature, vol. 480, No. 7376, 2011, pp. 224-228.
Natte, et al., "Palladium-Catalyzed Trifluoromethylation of (Hetero)Arenes with CF3Br," Angewandte Chemie International Edition, vol. 128, No. 8, 2016, pp. 2832-2836.
Noto, et al., "Diastereoselective Synthesis of CF3- and CF2H-Substituted Spiroethers from Aryl-Fused Cycloalkenylalkanols by Photoredox Catalysis," Journal of Organic Chemistry, vol. 81, No. 16, 2016, pp. 7064-7071.
O'Brien, et al., "Radical C—H functionalization of heteroarenes under electrochemical control," Angewandte Chemie International Edition, vol. 53, No. 44, 2014, pp. 11868-11871.
Sauer, et al., "An Electrocatalytic Approach to the Radical Difunctionalization of Alkenes," ACS Catalysis, vol. 8, No. 6, 2018, pp. 5175-5187.
Siu, et al., "Catalyzing Electrosynthesis: A Homogeneous Electrocatalytic Approach to Reaction Discovery," Accounts of Chemical Research, vol. 53, No. 3, 2020, pp. 547-560.
Struder, "A "Renaissance" in Radical Trifluoromethylation," Angewandte Chemie International Edition, vol. 51, No. 26, 2012, pp. 8950-8958.
Tabba & Smith, "Anodic oxidation potentials of substituted pyrroles: derivation and analysis of substituent partial potentials," Journal of Organic Chemistry, vol. 49, No. 11, 1984, pp. 1870-1875.
Tang, et al., "Olefinic C—H functionalization through radical alkenylation," Chemical Society Review, vol. 44, No. 5, 2015, pp. 1070-1082.
The Njardarson Group, "Top 200 Pharmaceutical Products by U.S. Retail Sales in 2018," The University of Arizona, 2018, 1 page <<retrieved at:https://www.pharmaexcipients.com/news/top-200-drugs-2018/>>.
Wang, et al., "Direct C—H Trifluoromethylation of Glycals by Photoredox Catalysis," Organic Letters, vol. 17, No. 22, 2015, pp. 5698-5701.
Wang, et al., "nBu4NI-catalyzed oxidative amidation of aldehydes with tertiary amines," Tetrahedron Letters, vol. 54, No. 46, 2013, pp. 6233-6236.
Wei, et al., "Visible Light-Induced Photocatalytic C—H Perfluoroalkylation of Quinoxalinones under Aerobic Oxidation Condition," Advanced Synthesis & Catalysis, vol. 361, No. 23, 2019, pp. 5490-5498.
Yan, et al., "Electrochemical regioselective azidoiodination of alkenes," Tetrahedron, vol. 73, No. 6, 2019, pp. 764-770.
Yan, et al., "Synthetic Organic Electrochemical Methods Since 2000: On the Verge of a Renaissance," Chemical Reviews, vol. 117, No. 21, 2017, pp. 13230-13319.
Yatham, et al., "Catalytic Intermolecular Dicarbofunctionalization of Styrenes with CO2 and Radical Precursors," Angewandte Chemie International Edition, vol. 56, No. 36, 2017, pp. 10915-10919.
Ye, et al., "Anodically Coupled Electrolysis for the Heterodifunctionalization of Alkenes," Journal of the American Chemical Society, vol. 140, No. 7, 2018, pp. 2438-2441.
Yin, et al., "Photoredox Catalytic Trifluoromethylation and Perfluoroalkylation of (Hetero)arenes Using Trifluoroacetic and Related Carboxylic Acids," ChemRxiv, 2020, 7 pages.

* cited by examiner (prior art)

(prior art)

(prior art)

(prior art)

(prior art)

(prior art)

(prior art)

(prior art)

| Entry | *V* | *f* | $^{19}$F-NMR Conv(%) | Iso Yield | **Mono-substituted** | **Di-substituted** |
|---|---|---|---|---|---|---|
| 01 | 4.4 V (DC) | N/A | 13 | - | **13** | **N/A** |
| 02 | 0.0 | N/A | <1 | N/A | **N/A** | **N/A** |
| **03** | **4.4 V (AC)** | **100 Hz** | **100** | **84** | **95** | **5** |
| 04 | 3.3 V (AC) | 100 Hz | 6 | - | **6** | **N/A** |
| 05 | 3.6 V (AC) | 100 Hz | 27 | - | **27** | **N/A** |
| 06 | 4.0 V (AC) | 100 Hz | 48 | 44 | **48** | **2** |
| *07 | 4.8 V (AC) | 100 Hz | 44 | - | **44** | **1** |
| 08 | 4.4 V (AC) | 10 Hz | 21 | - | **9** | **12** |
| 09 | 4.4 V (AC) | 1000 Hz | 00 | N/A | **N/A** | **N/A** |

*__Entry 07__ got chlorine substituted product with 16% Iso Yield.

| entry | $V_p$ (V) | f(Hz) | conversion[b] (%) | yield[c] (%) | 5/6 ratio[b] |
|---|---|---|---|---|---|
| 1 | 0 | n/a | <1 | | |
| 2 | 3.3 (AC) | 100 | 6 | | |
| 3 | 3.6 (AC) | 100 | 27 | | |
| 4 | 4.0 (AC) | 100 | 48 | 44 | 24 : 1 |
| **5** | **4.4 (AC)** | **100** | **100** | **84** | **19 : 1** |
| 6 | 4.8 (AC) | 100 | 44 | | 44 : 1 |
| 7 | 4.4 (AC) | 10 | 21 | | 0.75 : 1 |
| 8 | 4.4 (AC) | 1000 | <1 | | |
| 9 | 4.4 (AC, sine) | 60 | 40 | | |
| 10 | 4.4 (AC)[e] | 100 | 66 | 64 | |
| **11** | **4.4 (DC)** | **n/a** | **13** | | |

| Entry | $V_p$ (V) | Frequency | $^{19}$F-NMR yield of **32** (%) | **32:33** |
|---|---|---|---|---|
| 1 | 3.3 | 100 | 6 | |
| 2 | 4.4 | 100 | 100 (iso yield: 84) | 19 : 1 |
| 3 | 4.8 | 100 | 44 | 44 : 1 |
| 4 | 4.4 (DC) | N/A | 13 | |
| 5 | 0 | N/A | <1 | |
| 6 | 4.4 | 10 | 9 | 1 : 1.3 |

28

29

30

31

33

34

35

36

37

5

7

8

9

10

11

12

13

14

15

16

17

18

19

20

21

22

23

24

(prior art)

| Entry | $V_{real,peak}$ (V) | $f$ (Hz) | Initiator (equiv) | Time (h) | Conversion[b] (%) (1+2) | Yield[c] (%) | **1/2** ratio[b] |
|---|---|---|---|---|---|---|---|
| 1 | 2.1 | 100 | none | 24 | <1 | | |
| 2 | 1.5 (AC) | 100 | $Et_3N$ (0.1) | 24 | 12 + 0 | | |
| 3 | 2.1 (AC) | 100 | $Et_3N$ (0.1) | 24 | 56 + 05 | | |
| 4 | 2.8 (AC) | 100 | $Et_3N$ (0.1) | 24 | 14 + 04 | | |
| **5[d]** | **2.1 (AC)** | **100** | **$Et_3N$ (0.1)** | **48** | **74 + 08** | **66 + 03** | **11 : 1** |
| 6 | 2.1 (AC) | 10 | $Et_3N$ (0.1) | 24 | 32 + 07 | | |
| 7 | 2.1 (AC) | 1000 | $Et_3N$ (0.1) | 24 | 05+ 00 | | |
| 8[e] | 2.1 (DC) | n/a | $Et_3N$ (0.1) | 24 | 31 + 55 | | **1 : 2** |

5

6

7

8

9

10

| Entry | Voltage(V) | Frequency(Hz) | Yield (desired : side) |
|---|---|---|---|
| 1 | 2.00 | DC | 24 : 21 |
| 2 | 2.00 | 10 (Sin) | 73: 00 |

FIG. 23C
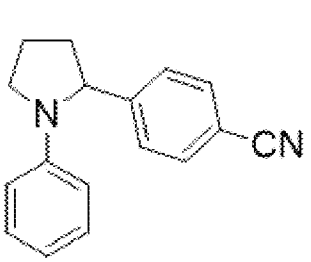
77%
70%
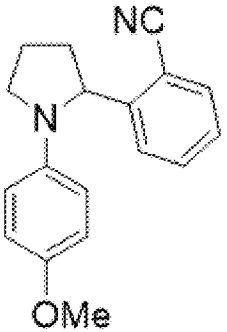
61%

FIG. 23D
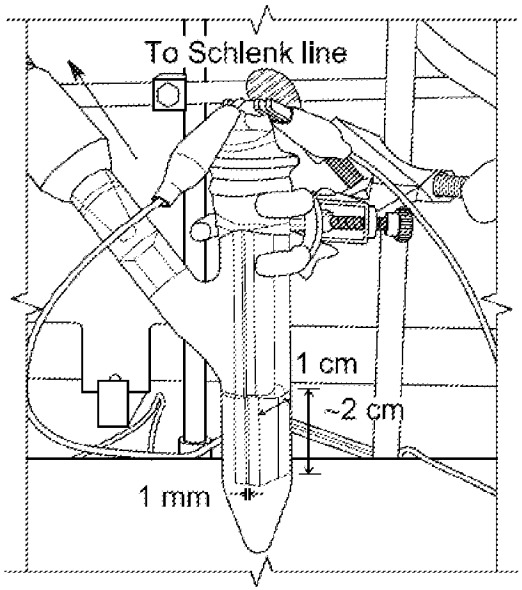
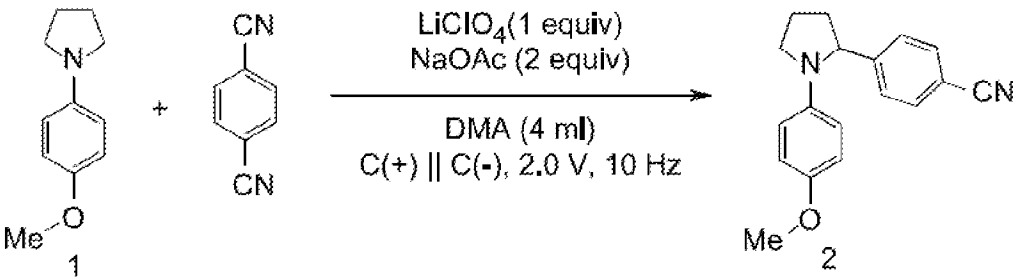
FIG. 23E
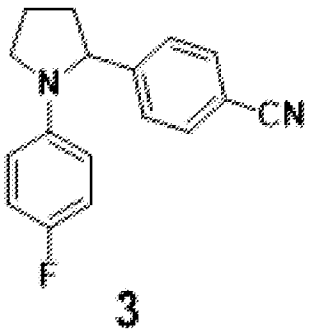

4

5

ALTERNATING CURRENT ELECTROLYSIS FOR USE IN ORGANIC SYNTHESIS

CROSS-REFERENCE TO RELATED APPLICATION

This application claims the benefit of U.S. Provisional Patent Application No. 62/957,092, filed on Jan. 3, 2020, which is incorporated herein by reference in its entirety as if fully set forth herein.

FIELD OF THE DISCLOSURE

The current disclosure provides alternating current based systems and methods to develop chemical compounds, such as drug molecules, using electrochemistry in organic synthesis.

BACKGROUND OF THE DISCLOSURE

Over the past century, innovations in synthetic organic chemistry have enabled the discovery and development of many life-changing medicines, thereby improving patients' health worldwide. However, the accumulation of chemical waste caused by synthesizing the drug molecules is a major concern. Such waste leads to chemicals entering streams and other areas of the environment (Basics of Green Chemistry|U.S. Environmental Protection Agency (EPA)). Innovative methodologies to synthesize chemical compounds, such as drug molecules, are needed to address these environmental concerns. The EPA has identified the practice of "green chemistry" as a way to reduce or eliminate the use or generation of hazardous substances. In particular, green chemistry (or sustainable chemistry) is the design of chemical products and processes that reduce pollution at its source and minimize or eliminate the hazards of chemical feedstocks, reagents, solvents, and products.

Considering these goals, medicinal chemists have implemented drug design methodologies to synthesize drug molecules using green chemistry techniques to eliminate or reduce chemical waste. Two compelling reactions are photo-redox catalysis and electrochemical organic synthesis. Both reactions have been implemented in sustainable chemistry practices due to the generation and interactions of electrons in these reactions during the drug molecule synthesis. Specifically, electrons directly participate in the redox transformation of the starting reagents to the final drug molecules. This direct use of electrons cuts down on the usage of chemicals, reduces waste, and offers improvements in cost, safety, and sustainability.

Photo-redox chemistry has become prevalent in the last decade to form carbon-carbon and carbon-heteroatom bonds during drug synthesis. In photo-redox catalysis, redox reactions occur upon electrons' excitation by light. Photo-redox catalysis provides access to a unique reaction environment, where oxidation and reduction of substrates are spatially and temporally close to each other. However, these methodologies have several limitations: namely, the use of photo-catalysts and the relatively small window of tunable redox potentials of the photo-catalysts to allow for the proper oxidation and reduction potentials.

Electrochemistry for organic synthesis is another emerging field that attracts great interest from the pharmaceutical industry. Unlike photo-redox, where a photo-redox catalyst drives redox reactions upon excitation by light, electrochemistry directly uses electrodes under different electric potentials to conduct the reactions. The use of electrodes in place of photo-catalysts allows mitigation of the waste and a reusable surface to perform the reaction. An electrode's redox power is also easily tunable and can be adjusted to any potential needed for a given transformation. As a result, electrochemistry enables precise control of chemoselectivity by simply selecting the electrode potential (Yan, et al., *Chem. Rev.* 2017, 117, 13230; Moeller, et al., *Chem. Rev.* 2018, 118, 4817). This delicate control of chemical reactivity is critical because drug synthesis often requires the ability to change one part of a complex molecule without affecting the rest of its structure. This unique feature, along with its sustainable chemistry environmental advantages (in reducing chemical waste), make using electrochemistry a more desirable alternative than using photo-redox chemistry for the organic synthesis of drug molecules.

In paired electrolysis reactions, such as described in Yan, et al., *Chem. Rev.* 2017, 117, 13230, reduction and oxidation reactions are separately completed at the cathode and anode, and they are connected by the mass transfer of reaction intermediates from one electrode to the other. The available transition time for paired electrolysis is determined by how fast the intermediates can move between the cathode and anode. This transfer time is typically on the order of seconds. Although reduction and oxidation reactions occur in the same pot during paired electrolysis like in photo-redox catalysis, they are not close to each other neither in space nor in time. As a result, paired electrolysis cannot handle reactions involving short-lived intermediates like photo-redox catalysis.

SUMMARY OF THE DISCLOSURE

The current disclosure provides for the use of alternating current (AC) electrolysis in organic synthesis. The use of AC can efficiently mimic the beneficial attributes of photo-catalytic reaction cycles without suffering its noted drawbacks. For example, the use of AC electrolysis (ACE) allows the reducing and oxidizing reaction conditions to be fine-tuned by varying the applied voltage and frequency rather than using photo-catalysts that result in the formation of environmentally harmful byproducts.

Use of ACE in organic synthesis is more efficient than the DC method when, for example, reactions involve intermediates with limited half-lives. In the AC method, electrode(s) alternate between reducing and oxidizing conditions so that intermediates are closer to the site of reduction or oxidation, allowing for further derivatization while minimizing dimerization or decomposition into byproducts.

Further, DC methods typically utilize a sacrificial reductant or oxidant to complete the redox cycle, thereby creating excess waste. In comparison, the present disclosure's use of AC does not require a sacrificial oxidant or reductant. Instead, methods of the present disclosure can utilize reusable electrodes (e.g., platinum, carbon, etc.) to provide the surface for reduction and oxidation.

Methods disclosed herein have been utilized to synthesize trifluoromethylated hetero/arenes, di-trifluoromethylated alkenes, chloro-trifluoromethylated alkenes, bromo-trifluoromethylated alkenes, and arylated amines.

BRIEF DESCRIPTION OF THE SEVERAL VIEWS OF THE DRAWINGS

Some of the drawings submitted herein may be better understood in color. Applicant considers the color versions of the drawings as part of the original submission and reserves the right to present color images of the drawings in later proceedings.

FIGS. 23A-23G. (23A) Electrochemical α-amino arylation reaction. (23B) Control the product selectivity in C—H arylation reaction using ACE. (23C) Substrate scope. (23D-23G) General procedure for α-amine arylation, instrumentation, and structures. (23D) Synthesis of α-amine arylation and instrumental setup. (23E) Compound 3. (23F) Compound 4. (23G) Compound 5.

DETAILED DESCRIPTION

Green synthesis of chemical compounds such as drugs using electricity is described. The current disclosure provides electrified organic synthetic systems that enable medicinal chemists to produce drug molecules from renewable feedstocks using electricity. The described systems and methods provide accurate and convenient control over electrons' reactivity by tuning electrode potentials.

Baran, et al. published articles describing different forms of synthetic organic electrochemical methods used since 2000 (Yan, et al., *Chem. Rev.* 2017, 117, 13230-13319). As of Jan. 3, 2019, literature descriptions of synthetic organic electrochemical methods using anodic reactions account for 63% of the literature published since 2000. Literature descriptions of synthetic organic electrochemical methods using cathodic reactions account for 35% of the literature published since 2000. Literature descriptions of synthetic organic electrochemical methods using paired electrolysis reactions account for less than 3% of the literature published since 2000.

Figure 1A:
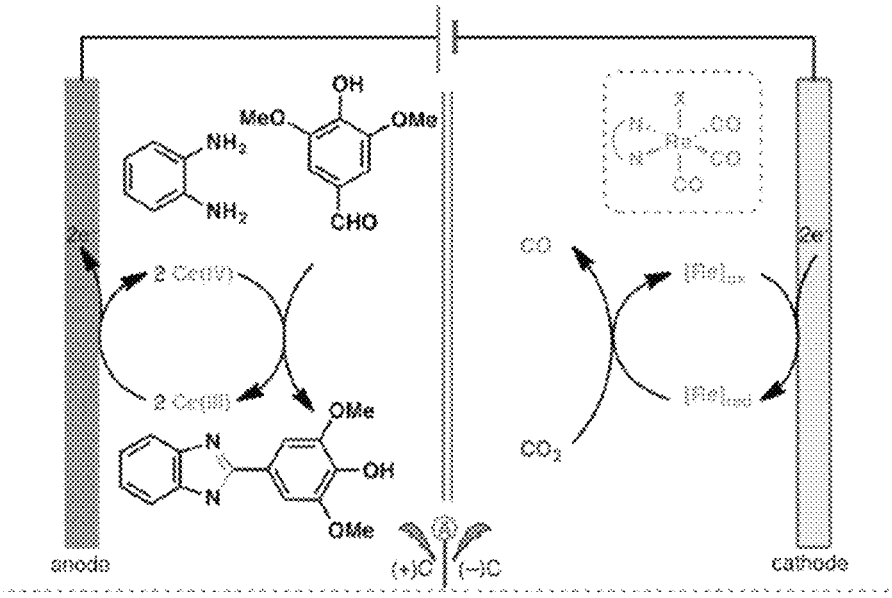
FIGS. 1A-1C. Three types of paired electrolysis reactions: (1A) Separate paired electrolysis reaction (Llorente, et al., *J. Am. Chem. Soc.* 2016, 138, 15110-15113). (1B) Sequential paired electrolysis reaction (Hartmer, et al., *Chem. Commun.* 2015, 51, 16346-16348). (1C) Convergent paired electrolysis reaction (Ishifune, et al., *Electrochim. Acta* 2001, 46, 3259-3264).
Figure 1B:
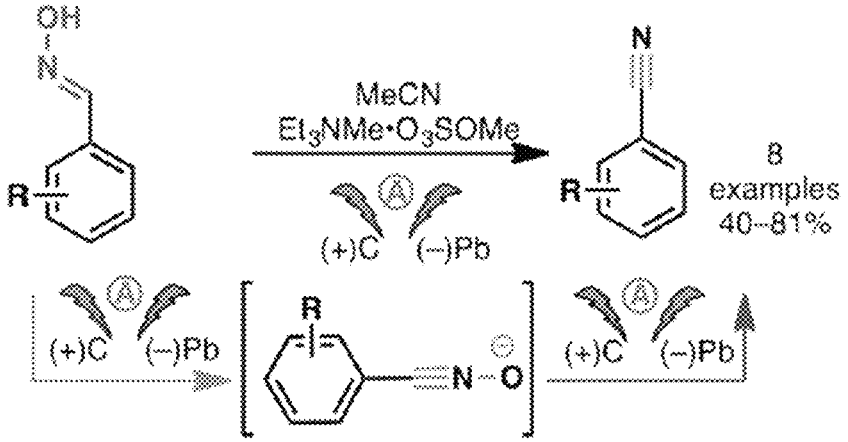
Figure 1C:
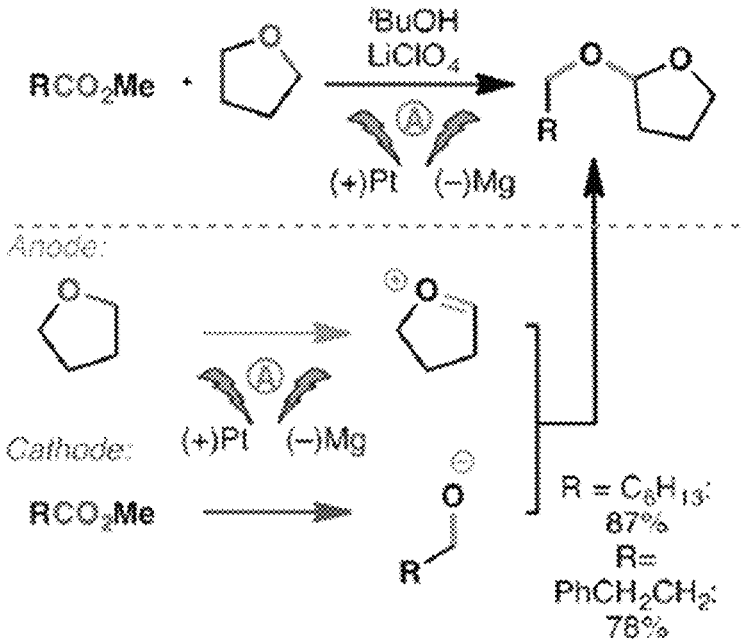

FIGS. 1A-1C depict three types of paired electrolysis reactions. Paired electrolysis reactions provide for a unique reaction environment where both oxidation and reduction can take place. In addition, energy efficiency is maximized when using paired electrolysis reactions, when the expenditure of electrical power to oxidize/reduce the sacrificial species is averted. FIG. 1A depicts a separate paired electrolysis reaction (Llorente, et al., *J. Am. Chem. Soc.* 2016, 138, 15110-15113), FIG. 1B depicts a sequential paired electrolysis reaction (Hartmer, et al., *Chem. Commun.* 2015, 51, 16346-16348), and FIG. 1C depicts a convergent paired electrolysis reaction (Ishifune, et al., *Electrochim. Acta* 2001, 46, 3259-3264).

Figure 2A:
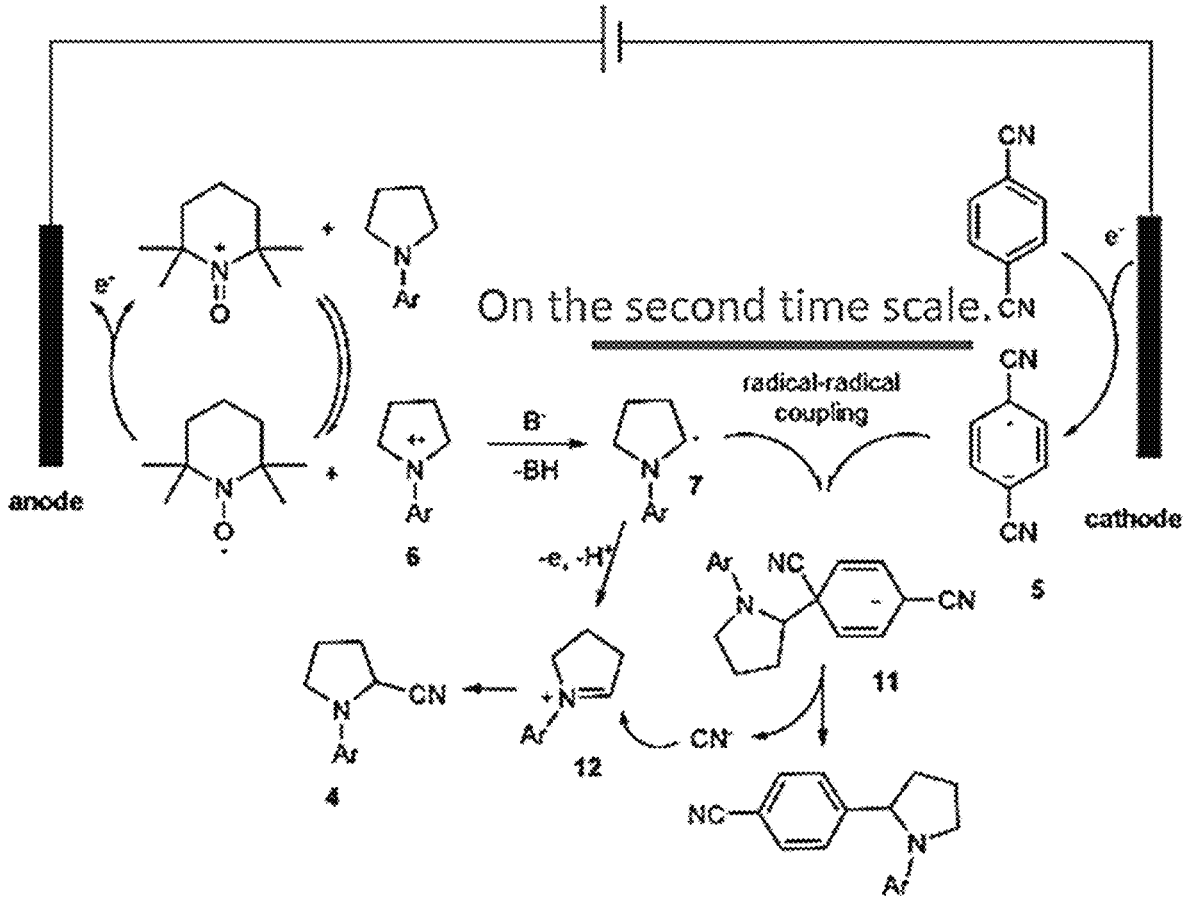
FIGS. 2A-2C. Paired electrolysis reactions require stable reaction intermediates. (2A) Separate paired electrolysis reaction. (2B) The reaction of the formation of a stable radical. (2C) Cyclic voltammogram showing reduction and oxidation of the catalysts 1,4-Dichlorobenzene (1,4-DCB) and 1-(4-methoxyphenyl)pyrrolidine), respectively, when current and the applied voltage is varied (Ma, et al., *Angew. Chem.* 2019, 131 (46), 16700-16552).
Figure 2B:
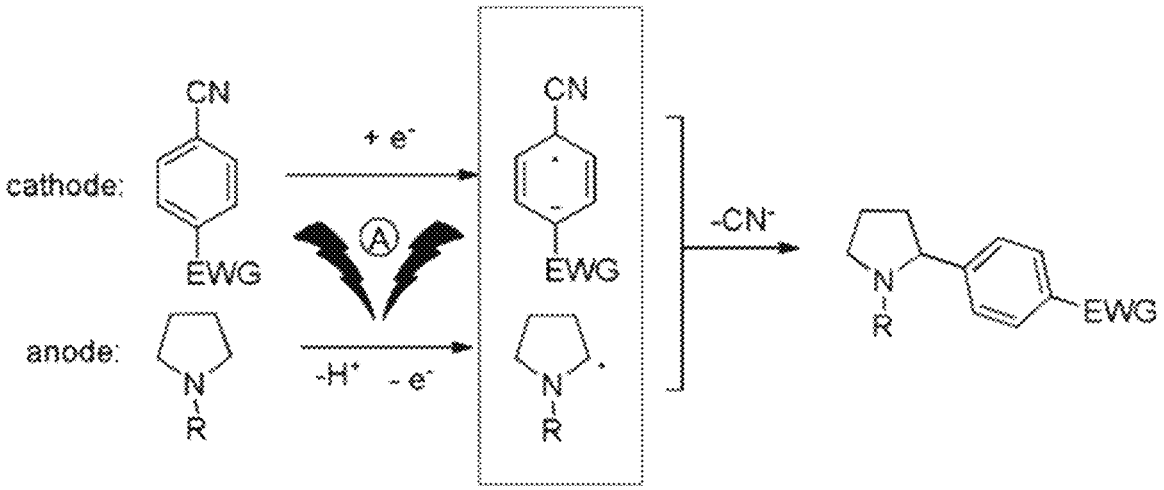
Figure 2C:
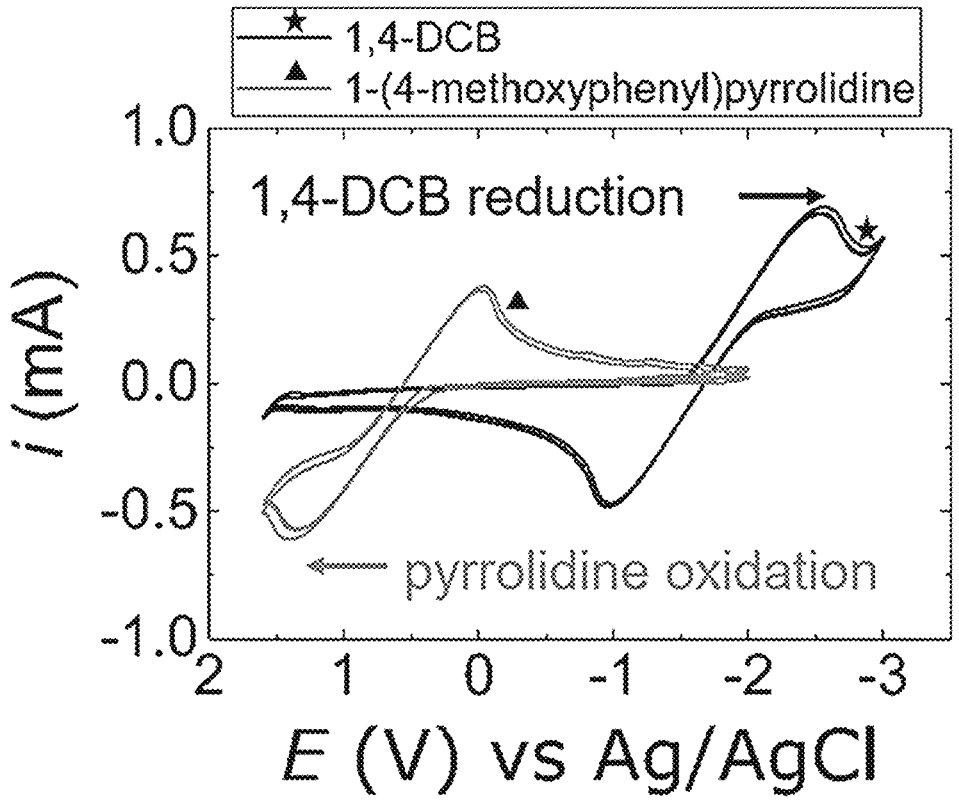

FIGS. 2A-2C depict paired electrolysis reactions requiring stable reaction intermediates and associated data. There is a very limited reaction library for paired electrolysis reactions. A first step can be to build a sufficiently large reaction library for electrochemical organic synthesis. FIG. 2A depicts a separate paired electrolysis reaction. FIG. 2B shows the reaction of the formation of a stable radical. FIG. 2C depicts a cyclic voltammogram showing reduction and oxidation of the catalysts 1,4-dichlorobenzene (1,4-DCB) and 1-(4-methoxyphenyl)pyrrolidine), respectively, when current and the applied voltage is varied (Ma, et al., *Angew. Chem.* 2019, 131 (46), 16700-16552).

Figure 3A:
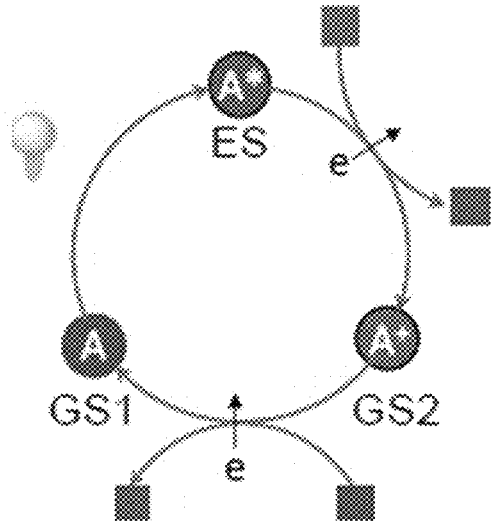
FIGS. 3A-3D. Photo-redox reaction mechanisms which take advantage of the unique reaction environment of photo-redox catalysis, where both the reduction and oxidation of the substrates and intermediates are spatially and temporally close to each other. (3A) Generalized schematic of a photo-redox catalytic cycle. (3B) The trifluoromethylation of arenes (aryl C—H bond) using a Sequential reaction (Nagib, et al., *Nature* 2011, 480, 224). (3C) The α-amino C—H arylation using a Convergent reaction (McNally, et al., *Science* 2011, 334, 1114). (3D) The C—H functionalization of amines with aryl halides by dual nickel and photo-redox catalysis using a Catalyzed reaction.

FIGS. 3A-3D depict photoredox reaction mechanisms which take advantage of the unique reaction environment of photo-redox catalysis, where both the reduction and oxidation of the substrates and intermediates are spatially and temporally close to each other. A generalized schematic of a photo-redox catalytic cycle is shown in FIG. 3A where A represents a photo-catalyst, G.S. stands for the ground state, E.S. stands for the excited state, and e represents an electron. Upon light excitation, the photo-redox catalyst (A) is promoted from the ground state to its excited state (A*). A* is a strong reductant that engages in single-electron transfer with organic (and organometallic) substrates. Once A* loses one electron, it becomes an oxidant (A+). A+ takes an electron from another substrate or intermediate to return to A. In this catalytic cycle, the excited photo-catalyst acts as both an oxidant and reductant, enabling the reduction and oxidation of the substrates and intermediates to occur in the same pot. More specifically, these two redox-opposite reactions are spatially and temporally close to each other so that the products of the two reactions can effectively interact with each other.

Arenes are aromatic hydrocarbons with alternating double and single carbon bonds (delocalized pi electrons) forming a ring. "Heteroarene," "heteroaryl," and "heteroarylene" include at least one carbon atom and one or more atoms independently selected from nitrogen, oxygen, and sulfur. A heteroarene includes a 5-membered or 6-membered aromatic ring. Representative examples include furanyl (e.g., furan-2-yl), imidazolyl (e.g., 1H-imidazol-1-yl), isoxazolyl, isothiazolyl, oxadiazolyl, oxazolyl, Pyridinyl (e.g., pyridin-4-yl, pyridin-2-yl, pyridin-3-yl), pyridazinyl, pyrindinyl, pyrazinyl, pyrazolyl, pyrrolyl, tetrazolyl, thiadiazolyl, thiazolyl, thienyl (e.g. thien-2-yl, Thien-3-yl), triazolyl and triazinyl.

Figure 3B:
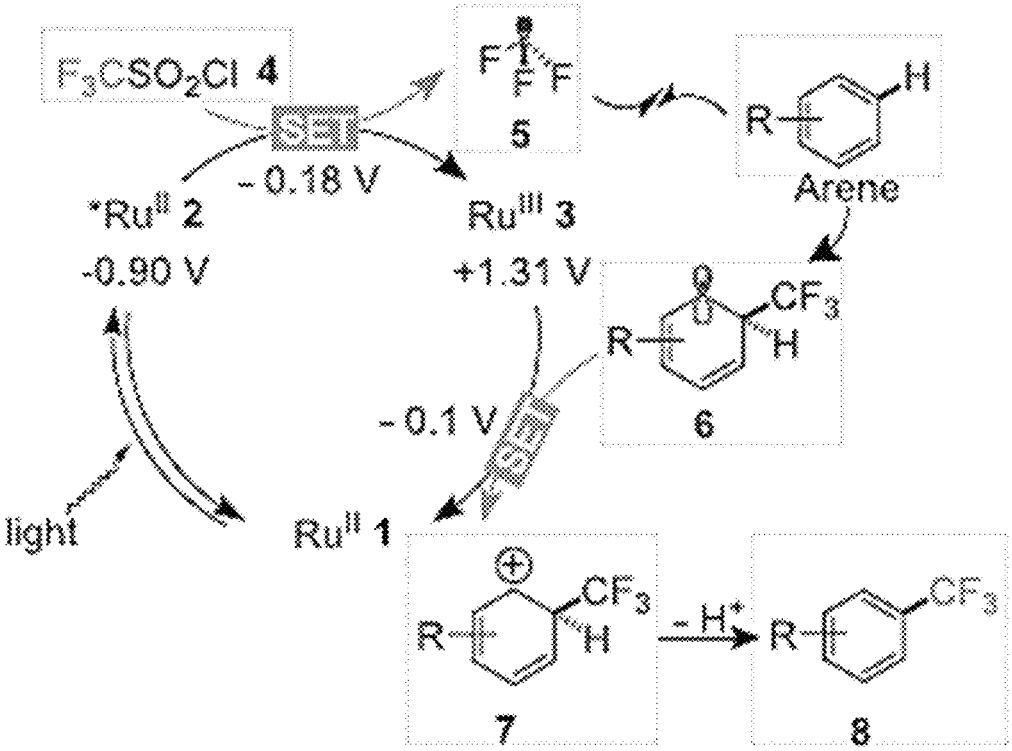

FIG. 3B illustrates the trifluoromethylation of arenes (aryl C—H bond) using a sequential reaction (Nagib, et al., *Nature* 2011, 480, 224). This reaction is initiated by the excitation of a photo-catalyst $Ru^{II}$ (1) to $*Ru^{II}$ (2). 2 reduces triflyl chloride (4) via single-electron transfer (SET), producing oxidant $Ru^{III}$(3) and the $CF_3$ radical (5). 5 combines with aromatic systems such as arenes. The resultant radical (6) undergoes a second SET with the now oxidizing photo-catalyst (3) to produce a cation (7). 3 returns to the ground state (1). After deprotonation, 7 forms the product (8). The two sequential and opposite redox steps in this catalytic cycle (4 to 5 and 6 to 7) enable this reaction.

Figure 3C:
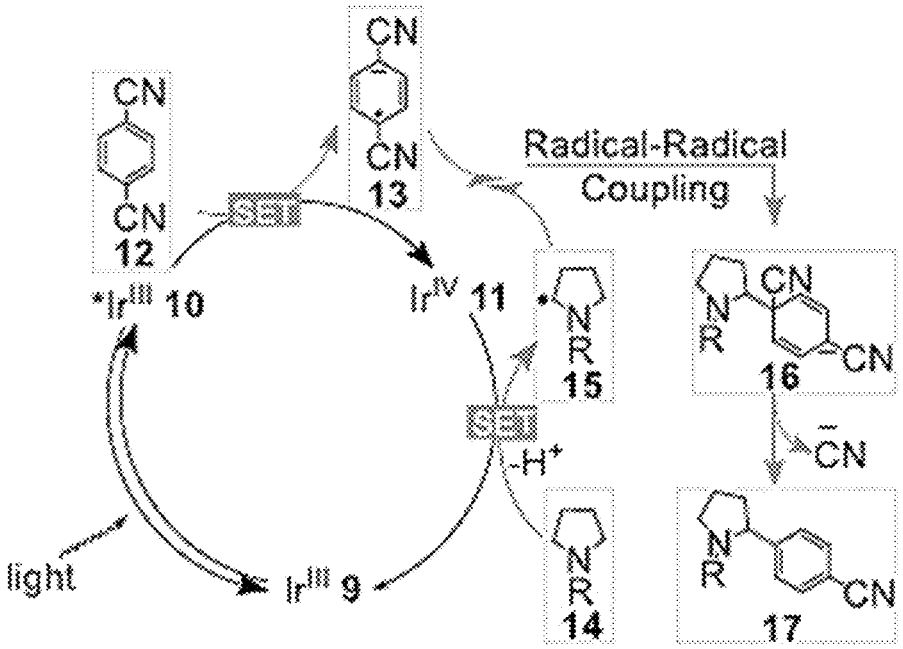
Figure 3D:
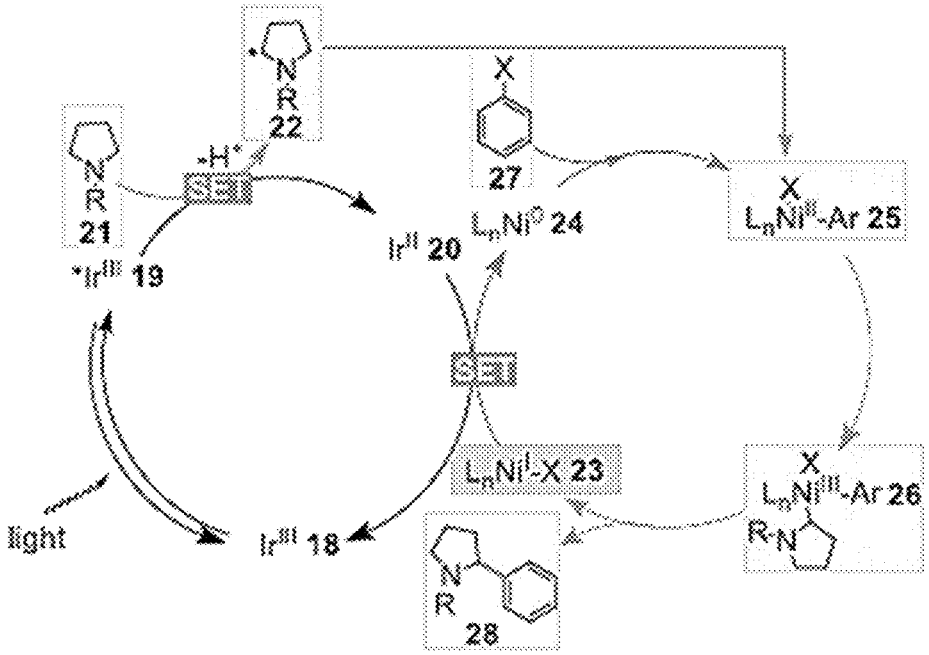

FIG. 3C illustrates the α-amino C—H arylation using a convergent reaction (McNally, et al., *Science* 2011, 334, 1114). The photo-catalyst IrIII (9) is promoted to its excited state *IrIII (10) by light in this reaction. 10 is a strong reductant, which donates an electron to the arene (12), producing the radical anion (13). The resultant $Ir^{IV}$ (11) is a strong oxidant and undergoes a SET with amine (14), generating α-amino radical (15), as well as returning to 9. A radical-radical coupling reaction combines 13 and 15. Elimination of $CN^-$ from 16 gives the product 17. In this reaction, the reduction of arene and oxidation of amine is essential. α-Arylated amines are also a prominent structural class found among medicinal agents (e.g., Tadalafil for treating erectile dysfunction) (The Njarõarson Group, Top 200 Pharmaceutical Products by U.S. Retail Sales in 2018). In FIG. 3D, the C—H functionalization of amines with aryl halides by dual nickel and photo-redox catalysis using a catalyzed reaction is shown. Unlike the previous two mechanisms, the catalyzed mechanism also includes a catalytic cycle. Because a catalyst can activate the substrates by forming covalent bonds with them, this mechanism provides access to unique reactivity and, importantly, the covalently bound catalysts can confer high levels of stereocontrol in these transformations.

FIG. 3D shows the C—H functionalization of amines by dual nickel and photo-redox catalysis as an example (Joe, et al., *Angew. Chem., Int. Ed.* 2016, 55, 4040). This overall reaction is similar to the one in FIG. 3C, except the reduction of aryl halide (27) and the coupling of aryl and amine radicals (22), are mediated by various oxidation states of a Ni catalyst (23, 24, 25, and 26). The Ni catalyst is necessary for activating aryl halides in these schemes.

Figure 4A:
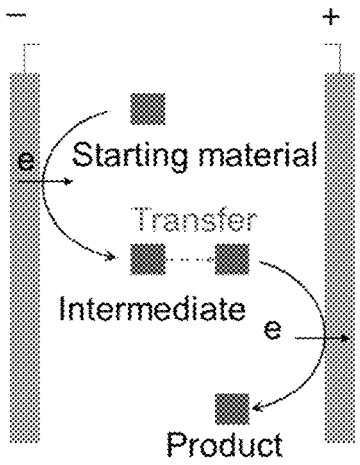
FIGS. 4A, 4B. A merger of DC electroorganic synthesis and a photo-redox catalytic cycle. (4A) Generalized schematic of a paired DC electrolysis reaction for a conventional paired electrolysis reaction. (4B) The reaction of trifluoromethylation of heteroarenes involves a short-lived intermediate and is limited by the mass transfer of radical intermediates.
Figure 4B:
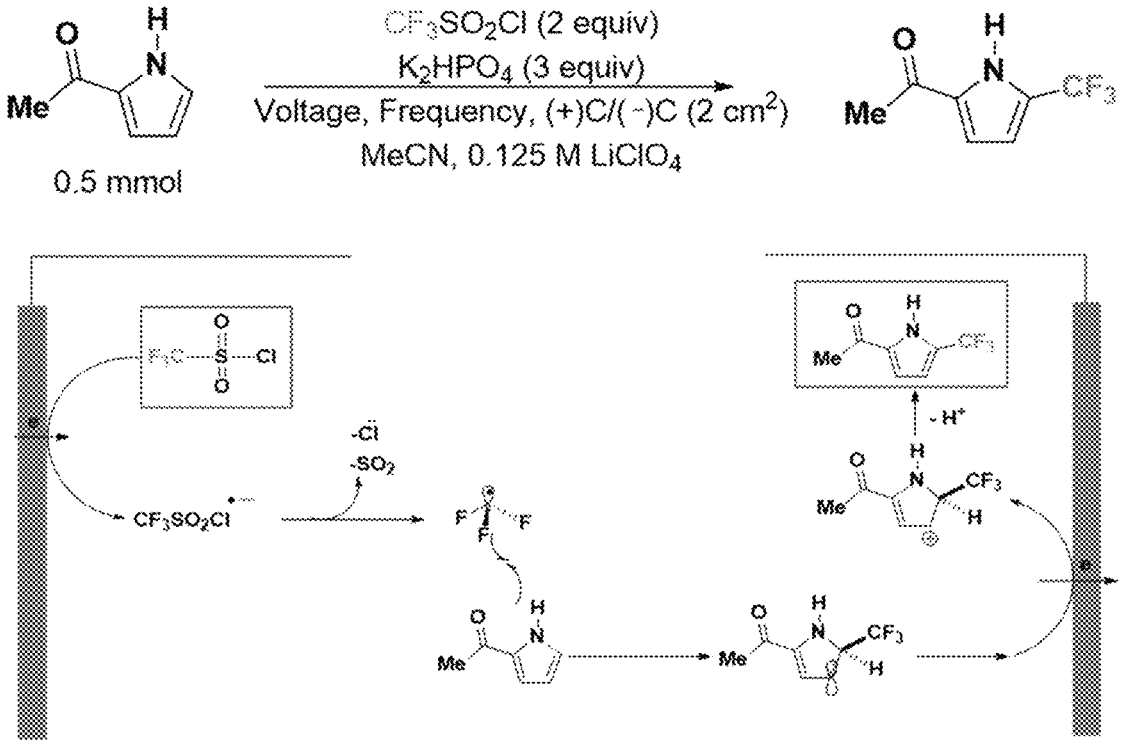

FIGS. 4A and 4B depict a merger of DC electroorganic synthesis and a photo-redox catalytic cycle. A generalized schematic of a paired electrolysis reaction for a conventional paired electrolysis reaction is shown in FIG. 4A. FIG. 4B shows the reaction of trifluoromethylation of heteroarenes. FIG. 4B involves a short-lived intermediate and is limited by the mass transfer of radical intermediates. This reaction contains a low product yield of 13%.

Figure 5:
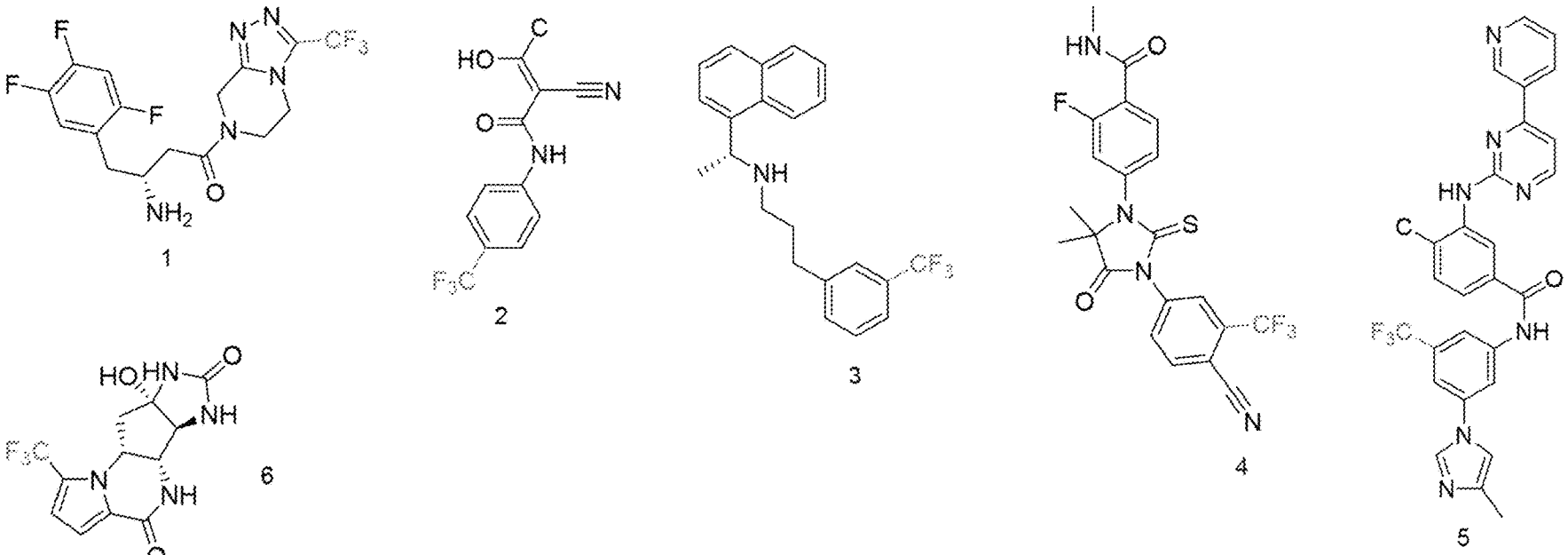
FIG. 5. Direct trifluoromethylation is of great importance in the pharmaceutical industry (Studer, et al., *Angew. Chem., Int. Ed.* 2012, 51, 8950). Six of the top 100 most successful drugs by sales in 2018 contain at least one trifluoromethyl group (The Njarðarson Group, Top 200 Pharmaceutical Products by U.S. Retail Sales in 2018).

As indicated in FIG. 5, direct trifluoromethylation is of great importance in the pharmaceutical industry (Studer, et al., *Angew. Chem., Int. Ed.* 2012, 51, 8950). Six of the top 100 most successful drugs by sales in 2018 contain at least one trifluoromethyl group (The Njarõarson Group, Top 200 Pharmaceutical Products by U.S. Retail Sales in 2018). Drug molecules containing $CF_3$ include Sitagliptin (1), a $CF_3$ containing molecule used in the treatment of diabetes. The anti-diabetic medication has a market sales rank of number 23 and number 54. Aubagio (2) is a $CF_3$ containing molecule used in the treatment of neurological disorders. This relapsing forms of multiple sclerosis (RMS) treatment drug has a market sales rank of number 67. Sensipar (3) is a $CF_3$ containing molecule used in the treatment of hormonal disorders. This drug used in the treatment of hyperparathyroidism has a market sales rank of number 74. Xtandi (4) is a $CF_3$ containing molecule used in oncology treatment. This drug, used in the treatment of prostate cancer, has a market sales rank of number 25. Nilotinib (5) is a $CF_3$ containing molecule used in oncology treatment. This drug is used to treat chronic myelogenous leukemia and has a market sales rank of number 65. Agelastatin analogue drugs (6) are $CF_3$ molecules used in the drug for oncology treatment. The analogues are used in the treatment of chronic lymphocytic leukemia.

Figure 6A:
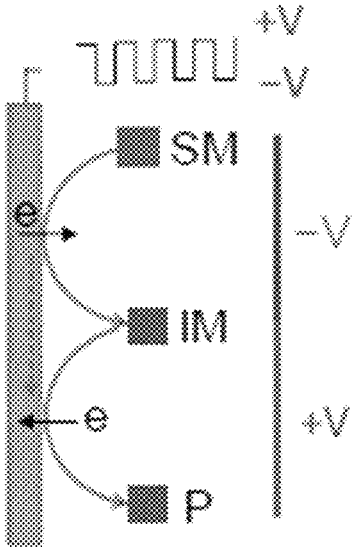
FIGS. 6A-6D. Alternating current electrolysis (ACE). (6A) Generalized schematic of ACE, which mimics the turnovers of a photo-redox catalyst by swiftly alternating the voltage polarity of an electrode. S.M.: starting material, I.M.: intermediate, P: product. (6B) Electrochemical trifluoromethylation of 2-acetylpyrrole (24) using ACE. (6C) Experimental setup depicting the ACE setup and waveform generator as the AC power supply. (6D). Two single electron transfer reactions on two ACE electrodes. The ACE reaction was off by half a period.

FIGS. 6A-6D present aspects of alternating current electrolysis (ACE). FIG. 6A presents a generalized schematic of an ACE, which mimics the turnovers of a photo-redox catalyst by swiftly alternating the voltage polarity of the electrode. In FIG. 6A, S.M. represents starting material, I.M. stands for intermediate, and P represents product. More specifically, an alternating voltage drives the redox transformations of the substrates sequentially at the same electrode to mimic the turnovers of a photo-redox catalyst in a photo-catalytic cycle. In the current disclosure reaction scheme, the intermediates do not have to migrate between the two electrodes, enabling short-lived intermediates to react almost immediately upon the electrode polarity reversal. The current disclosure provides for the use of ACE to tune the voltage switching rate carefully and, hence the time between the redox events. ACE's unique property provides better control over the reactions than either conventional paired electrolysis or photo-redox catalysis. The present disclosure provides for an innovative and interdisciplinary approach to use ACE to perform organic synthesis.

Exemplary embodiments disclosed herein can utilize sequential or convergent reactions. For example, in an exemplary sequential reaction, reactant [A] and [B] may be added to an ACE reaction. [A] can be reduced or oxidized into an intermediate form [C] that reacts with [B] to generate product [D].

In another exemplary sequential reaction, reactant [A], [B], and [C] may be added to an ACE reaction. [A] can be reduced or oxidized into an intermediate form [D] that reacts with [B] to generate another intermediate [E]. Intermediate [E] can react with [C] to generate product [F]. As will be understood by one of ordinary skill in the art, and as depicted in the reaction mechanisms above, sequential reactions can include different numbers of starting reactants, depending on the number of sequential reaction steps and intermediates required to obtain a desired end product.

In an exemplary convergent reaction, reactant [A] and [B] may be added to a reaction. [A] is reduced to intermediate [C], and [B] is oxidized to intermediate [D]. Intermediate [C] and [D] react to form product [E].

As described herein, ACE can be utilized to generate a wide variety of organic molecules. Particularly useful reactions for ACE and those particularly described herein include (1) trifluoromethylation of alkenes; (2) heterodifunctionalization of alkenes; (3) α-arylation of amines; and (4) styrene oxidization.

As used herein, "reaction groups" refer to starting reactants added to or within an ACE reaction. For a sequential reaction, a reaction group can include a molecule that is reduced or oxidized to initiate the ACE reaction and a molecule that reacts with the reduced or oxidized intermediate. For a convergent reaction, reaction groups can include redox pairs, that is one reactant that will be reduced and one reactant that will be oxidized.

Particularly useful voltages to apply within ACE are generally between 1-10 volts (e.g., 0.5=, 1, 1.5, 2, 2.5, 3, 3.5, 4, 4.5, 5, 5.5, 6, 6.5, 7, 7.5, 8, 8.5, 9. 9.5, 10, or 10.5). Particular embodiments disclosed herein utilize voltages between 1.8 and 2.5 volts or between 4.0 and 4.8 volts. Particularly useful frequencies to apply within ACE are generally between 1-10,000 Hz. Particular embodiments disclosed herein utilize frequencies such as between 85-115 Hz or 90-110 Hz.

Electrodes formed from many materials may be used. Platinum, carbon, and nickel are particularly useful.

Figure 6B:
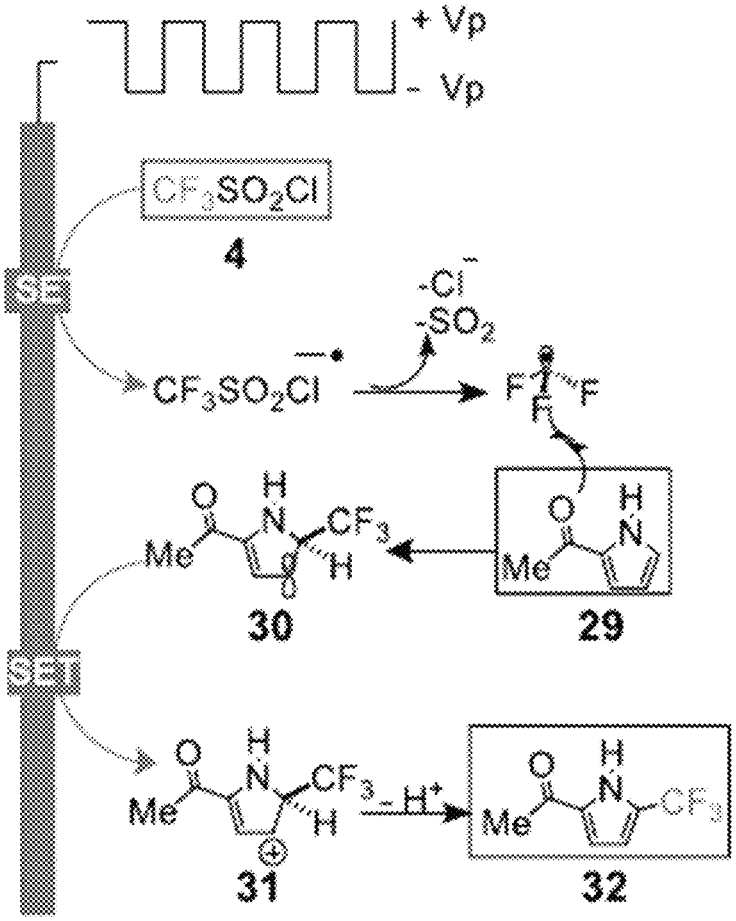
Figure 6D:
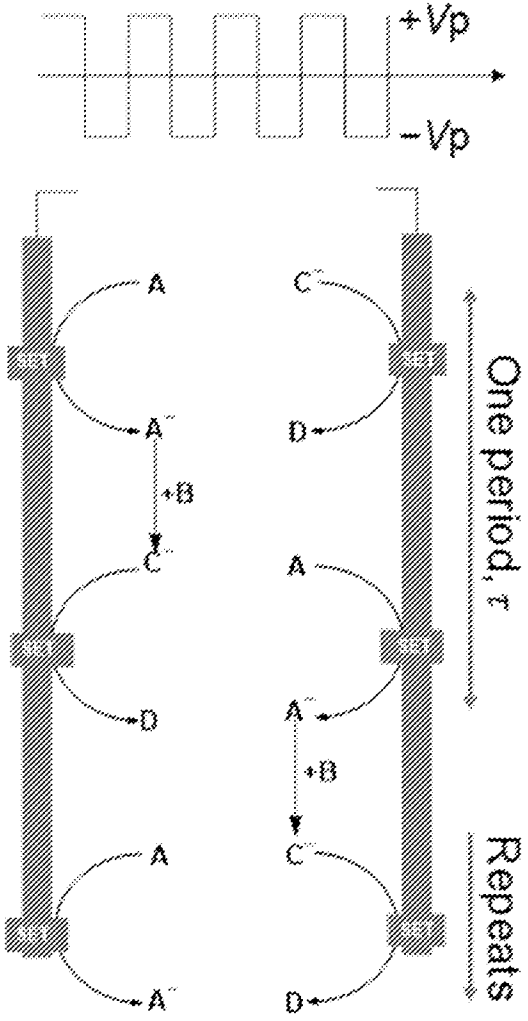
Figure 6C:
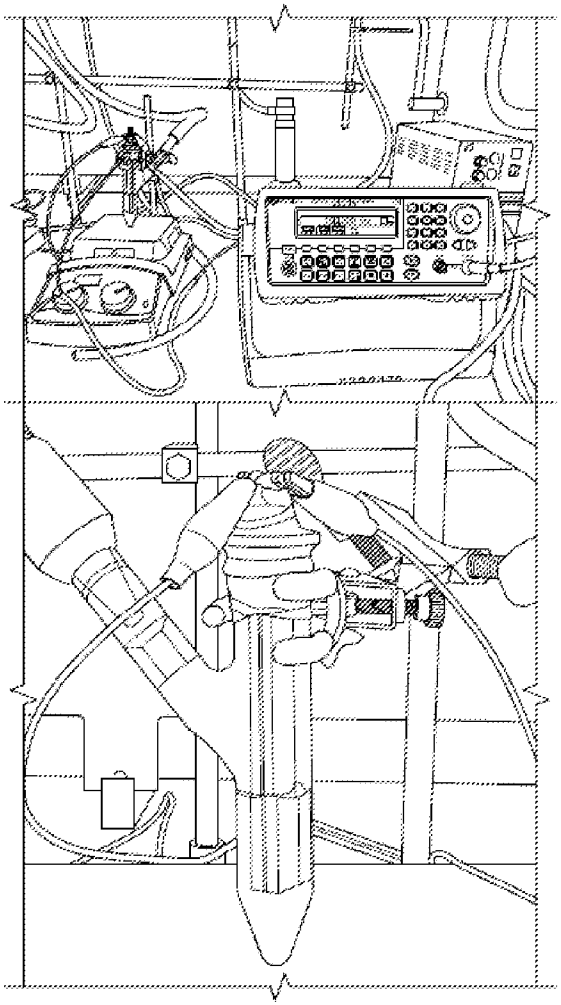

FIG. 6B shows electrochemical trifluoromethylation of 2-acetylpyrrole (24) using ACE. In an initial study, trifluoromethylation of aryl C—H bonds was used as the model reaction (see FIG. 3B for the mechanism) and 2-acetylpyrrole (29) as a model substrate. A square waveform with various frequencies (10 to 1000 Hz) and amplitudes ($V_p$ from 3.3 to 4.8 V) between two carbon electrodes was applied to sequentially reduce triflyl chloride (4) and oxidize the intermediate 30 (FIG. 6B). After 24 hours, a quantitative yield was obtained from $^{19}$F-NMR, and an isolated yield of 84% was obtained for the mono-trifluoromethylation product (32) at 100 Hz and 4.4 V (entry 2 in FIGS. 10A-10F). FIG. 6C shows an experimental setup depicting the ACE setup and a waveform generator as the AC power supply, while 6D depicts two single electron transfer reactions on two ACE electrodes. The ACE reaction on the two electrodes is off by half a period.

Figure 7A:
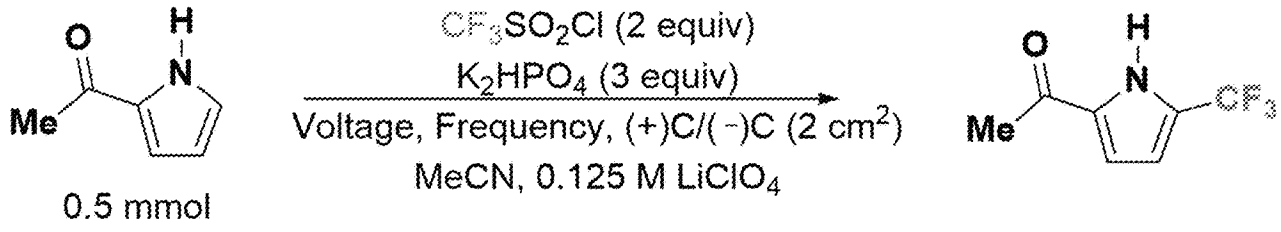
FIGS. 7A, 7B. (7A) Results for electrochemical trifluoromethylation of 2-acetylpyrrole using ACE. (7B) Reaction Development. Reaction scale: 0.5 mmol of 2 (1 equiv.) in 4 mL of acetonitrile. [b]The conversion and the ratio of 5/6 were determined by $^{19}$F NMR. ° Isolated yield of 5. [d]Chlorinated product was isolated in 16% yield. [e]1 mmol of 2.
Figure 7B:
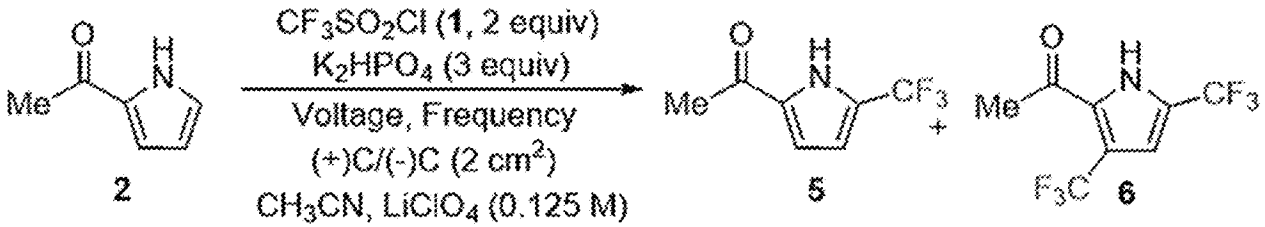
Figure 8:
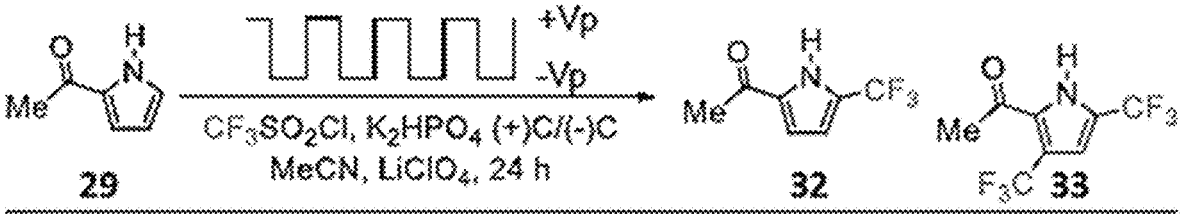
FIG. 8. Results for electrochemical trifluoromethylation of 2-acetylpyrrole using ACE.

Results for electrochemical trifluoromethylation of 2-acetylpyrrole using ACE are shown in FIGS. 7A, 7B, and 8. FIG. 7A shows the trifluoromethylation of aryl C—H bonds of 2-acetylpyrrole. The $^{19}$F-NMR conversion, Iso yield, and the amount of mono-substitution or di-substitutions were recorded while varying the voltage and frequency. Entry 1 used a direct current of 4.4 V and showed a 13% yield of the mono-trifluoromethylation product. Entry 2 used no voltage and had a yield of less than 1%. Entry 3 showed the highest yield of 95% mono-trifluoromethylation product and 5% di-trifluoromethylation product using an alternating current of 100 Hz with an amplitude of 4.4V. Entries 4-9 describe the product yields while varying the alternating current from 3.3V to 4.8V and the frequency between 10 Hz, 100 Hz, and 1000 Hz. Entry 7 resulted in chlorine substituted product with 16% Iso yield.

During reaction optimization in FIG. 7B, the frequency f and amplitude $V_p$ of the square waveform were varied. It was found that trifluoromethylation of 2 at 100 Hz and 4.4 V (entry 5) afforded the desired product 5 in 84% yield. The mono-/bis-trifluoromethylated product ratio (5/6) was found to be 19:1. Both f and $V_p$ strongly affected the yield and selectivity. At 100 Hz, 5 was predominantly formed with a 5/6 ratio of >20:1 (entries 4 and 6). In contrast, 6 became more favorable at 10 Hz (entry 7). At 1000 Hz, no reaction took place (entry 8). If $V_P$ was set greater or less than 4.4 V, the yield of 5 decreased. At $V_p$<4.4 V, there was a significant amount of unreacted 2 recovered after 24 h (entries 2-4). At $V_p$=4.8 V, although 2 was completely consumed, a chlorinated side product was isolated in 16% (entry 6). Importantly, the use of a 60 Hz sine waveform (entry 9), the same waveform as the household power supply, afforded the desired product 5 in 40% NMR conversion. The application to a large scale was explored utilizing 1 mmol of 2-acetylpyrrole (2), and the desired product 5 was obtained in a comparable yield (64%, entry 10). To compare, the paired electrolysis condition only gave a 13% yield of 5 using identical chemical reagents at a constant voltage of 4.4 (entry 11). The control experiment established that there was no reaction when no voltage was applied (entry 1). Overall, the results in FIG. 7B confirmed the hypothesis that the ACE significantly improved the yield compared to the paired electrolysis.

Referring to FIG. 8, in an initial study, trifluoromethylation of aryl C—H bonds was used as the model reaction (see FIG. 3B for the mechanism) and 2-acetylpyrrole (29) as a model substrate. A square waveform with various frequencies (10 to 1000 Hz) and amplitudes ($V_p$ from 3.3 to 4.8 V) between two carbon electrodes was applied to sequentially reduce triflyl chloride (4) and oxidize the intermediate 30 (FIG. 6B). After 24 hours, a quantitative yield was obtained from $^{19}$F-NMR, and an isolated yield of 84% was obtained for the mono-trifluoromethylation product (32) at 100 Hz and 4.4 V (entry 2 in FIG. 8). In contrast, when using the paired electrolysis reaction (FIG. 4A), a constant voltage of 4.4 V only resulted in a 13% yield (entry 4). When no voltage was applied, no product was formed (entry 5). The frequency and amplitude strongly affect both yield and regioselectivity. At 100 Hz, 32 is the dominant product with a selectivity of >95%. However, the bis-trifluoromethylation major side product (33) became more favorable at 10 Hz (entry 6). These results can be interpreted as meaning that ACE offers easy access to bistrifluoromethylated arenes, which often show unique biological activity relative to their monosubstituted counterparts. The results demonstrate a tunable relationship between the frequency of voltage oscillation and the yield and selectivity of the reaction, suggesting the ACE approach offers new opportunities not available to the other more restrictive methods like paired electrolysis and photo-redox catalysis.

While square forms were used in the experimental protocols described herein and are preferred, other non-square waveforms may also be used, provided they provide a distinct enough transition from reducing to oxidizing conditions to form intended molecules at relevant yields. Multistage waveforms may also be used (see, e.g., FIG. 24).

Figure 9A:
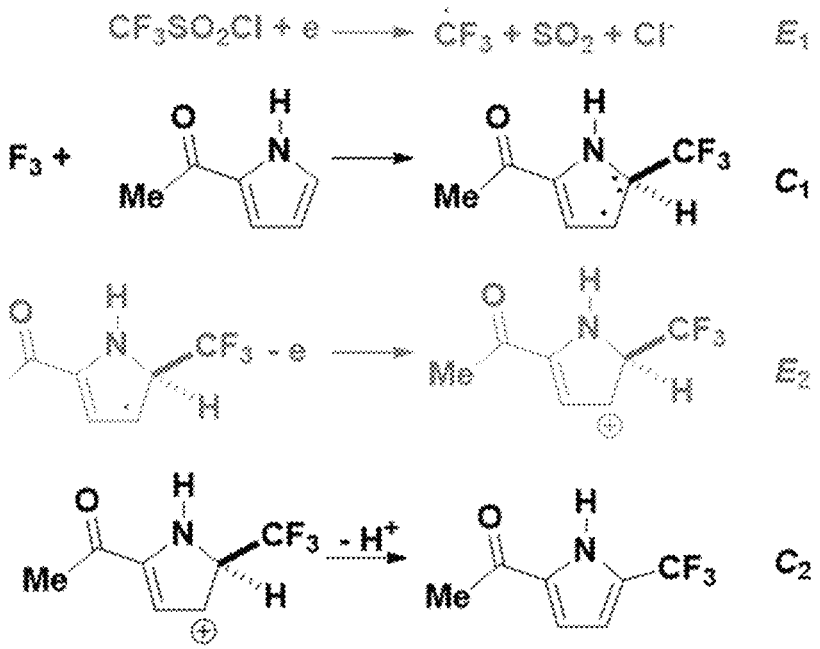
FIGS. 9A, 9B. (9A) The electrochemical reaction mechanism of the trifluoromethylation of 2-acetylpyrrole depicting the $E_1$, $C_1$, $E_2$, and $C_2$ substitutions of the $CF_3$ when 4.4 V is applied on an ACE electrode. (9B) Cyclic voltammogram showing reduction and oxidation of $CF_3SO_2Cl$ and 2-acetyl pyrrole when current and the applied voltage is varied. The voltage for this $E_1$ reaction was recorded at −0.5 V.
Figure 9B:
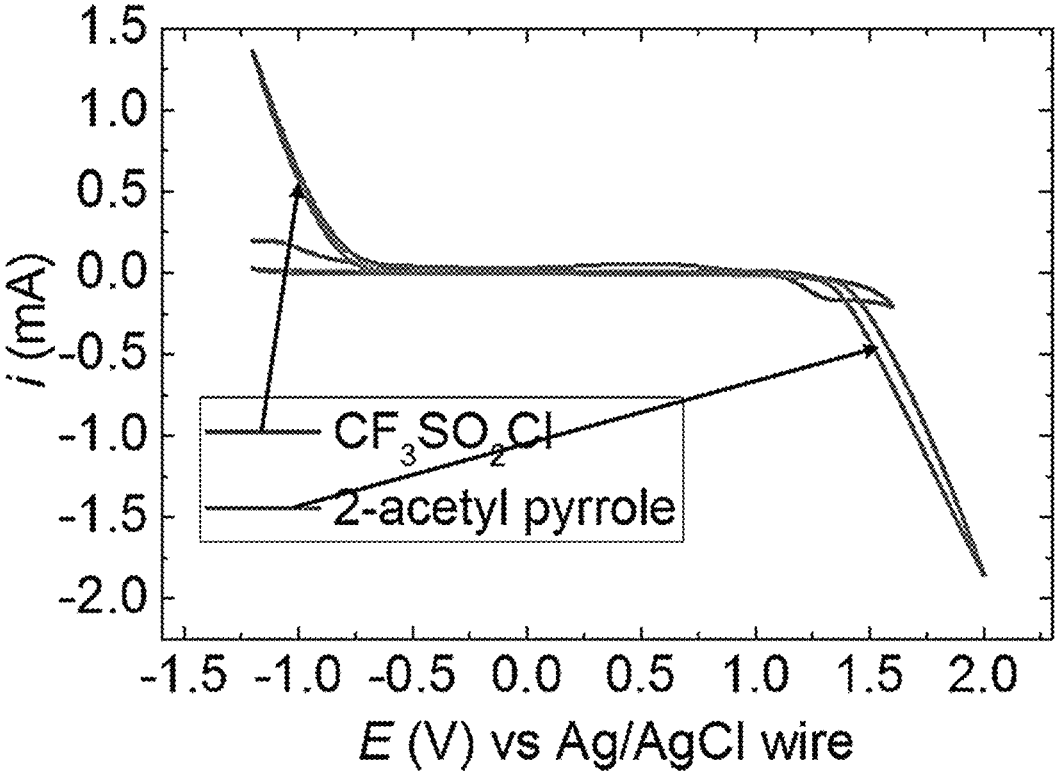

FIG. 9A shows the electrochemical reaction mechanism of the trifluoromethylation of 2-acetylpyrrole depicting the $E_1$, $C_1$, $E_2$, and $C_2$ substitutions of the $CF_3$ when 4.4 V is applied on the ACE electrode. FIG. 9B provides a cyclic voltammogram showing reduction and oxidation of the catalysts $CF_3SO_2Cl$ and 2-acetyl pyrrole when current and the applied voltage is varied. The voltage for this $E_1$ reaction was recorded at −0.5 V.

Figure 10A:
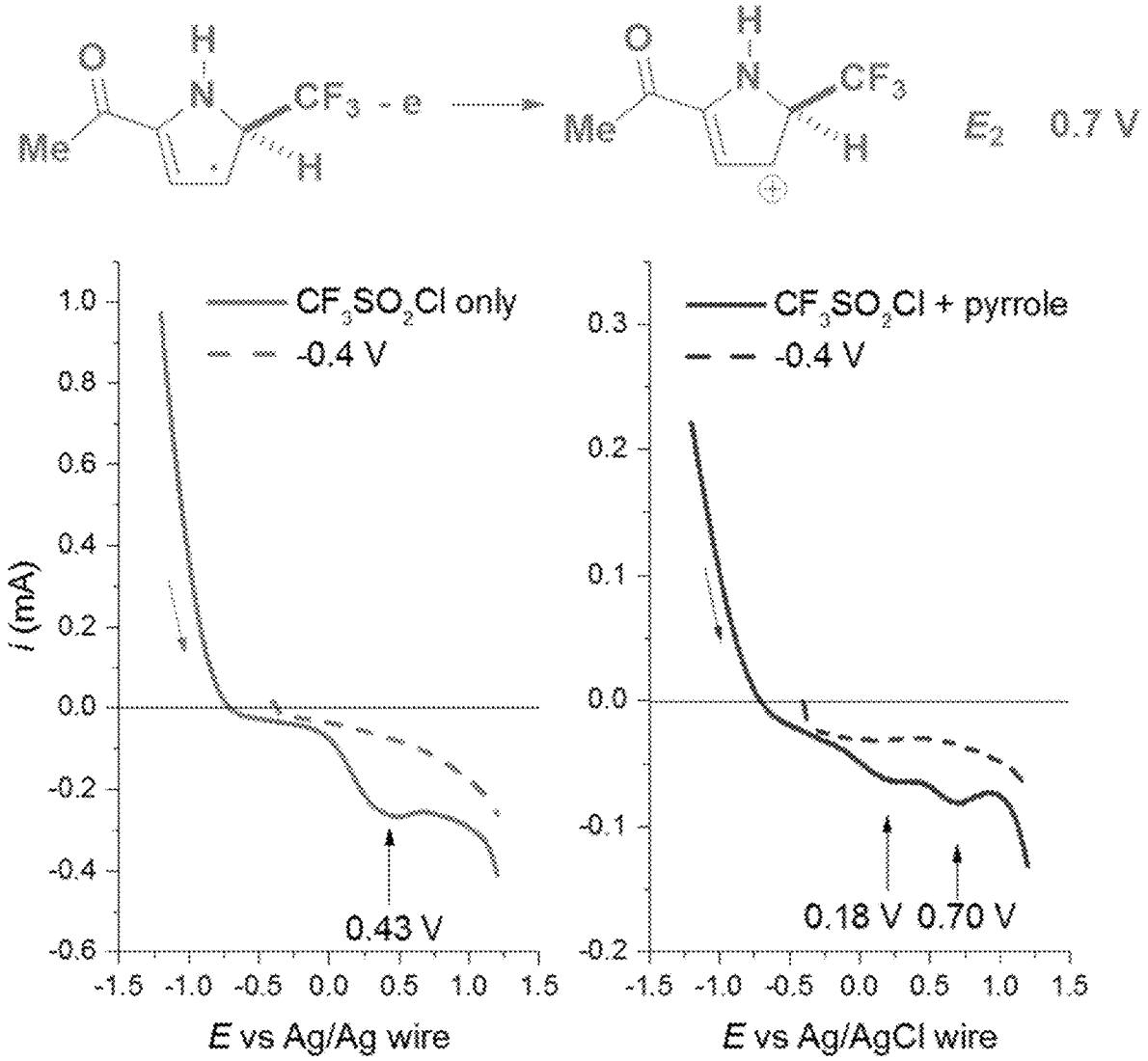
FIGS. 10A-10F. (10A) Cyclic voltammograms for the substrate $CF_3SO_2Cl$ only and for the substrates $CF_3SO_2Cl$+2-actylpyrrole, showing the voltage for this $E_2$ reaction was recorded at 0.7 V. (10B) Cyclic voltammograms of $CF_3SO_2Cl$ in MeCN. (10C) Fast-scan linear sweep voltammograms of a mixture of $CF_3SO_2Cl$ and 2-actylpyrrole. (10D) Left panel: The electrode potential was held at −1.2 V for 1, 2, and 3 s, followed by sweeping the potential positively to 1.2 V at 20 V/s. Concentrations of $CF_3SO_2Cl$ and 2-actylpyrrole were both 0.25 M. Right panel: different equivalents of 2-actylpyrrole to $CF_3SO_2Cl$ was added, and the holding time at −1.2 V was 3 s. Curve: the electrode potential was held at −0.4 V for 1 s before the potential sweep. (10E) The linear sweep voltammograms of a mixture of $CF_3SO_2Cl$+2-actylpyrrole at different scan rates. (10F) The total charge associated with the oxidation of reaction intermediate estimated from the anodic waves in (10E) as a function of scan rate. For all the voltammograms collected, an Ag/AgCl wire was used as the quasi-reference electrode.
Figure 10B:
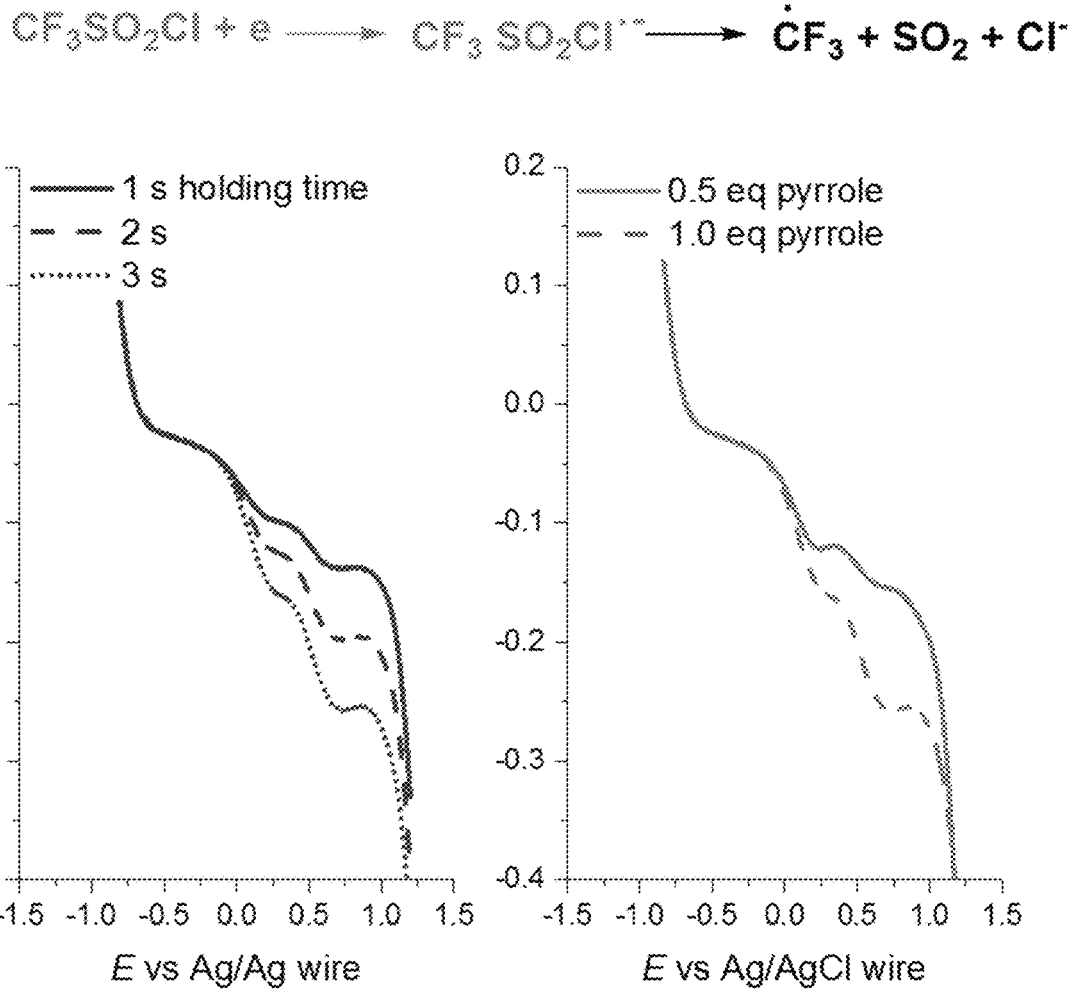
Figure 10C:
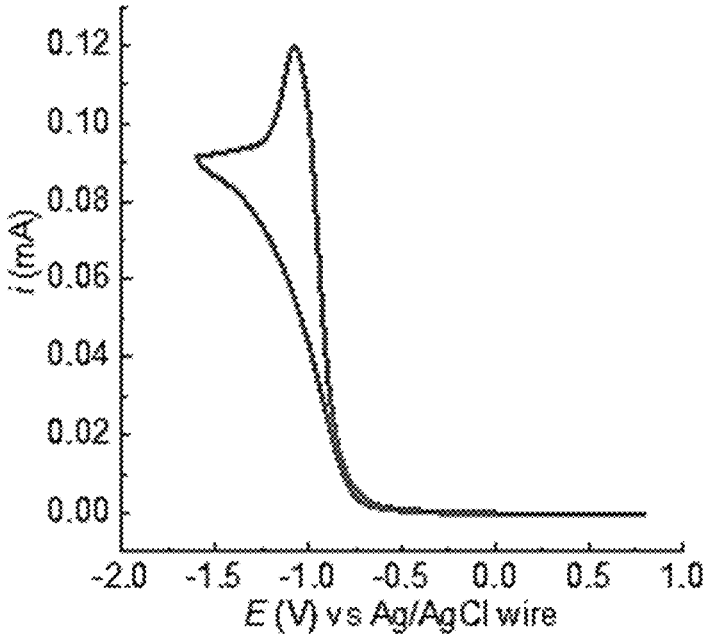
Figure 10D:
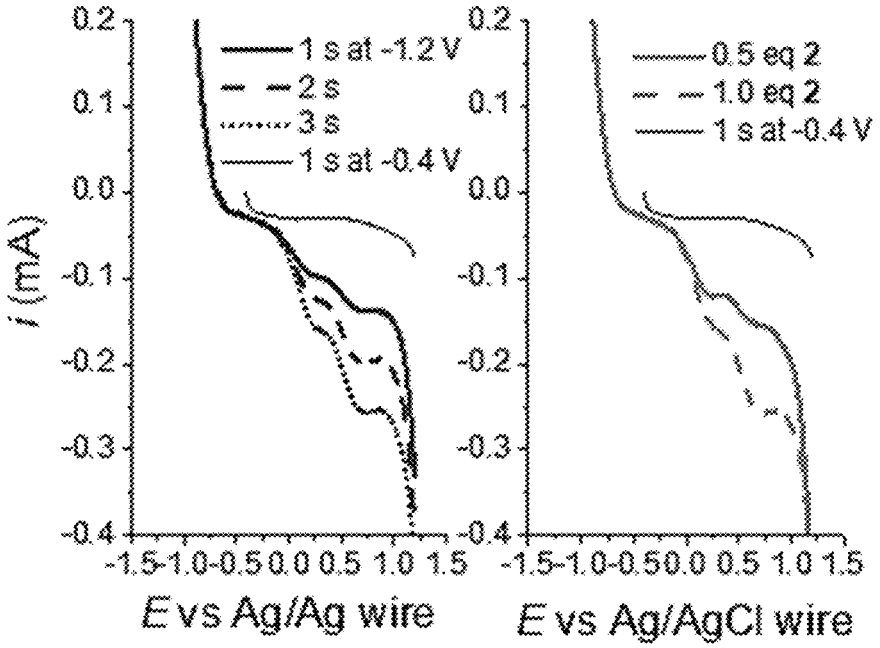
Figure 10E:
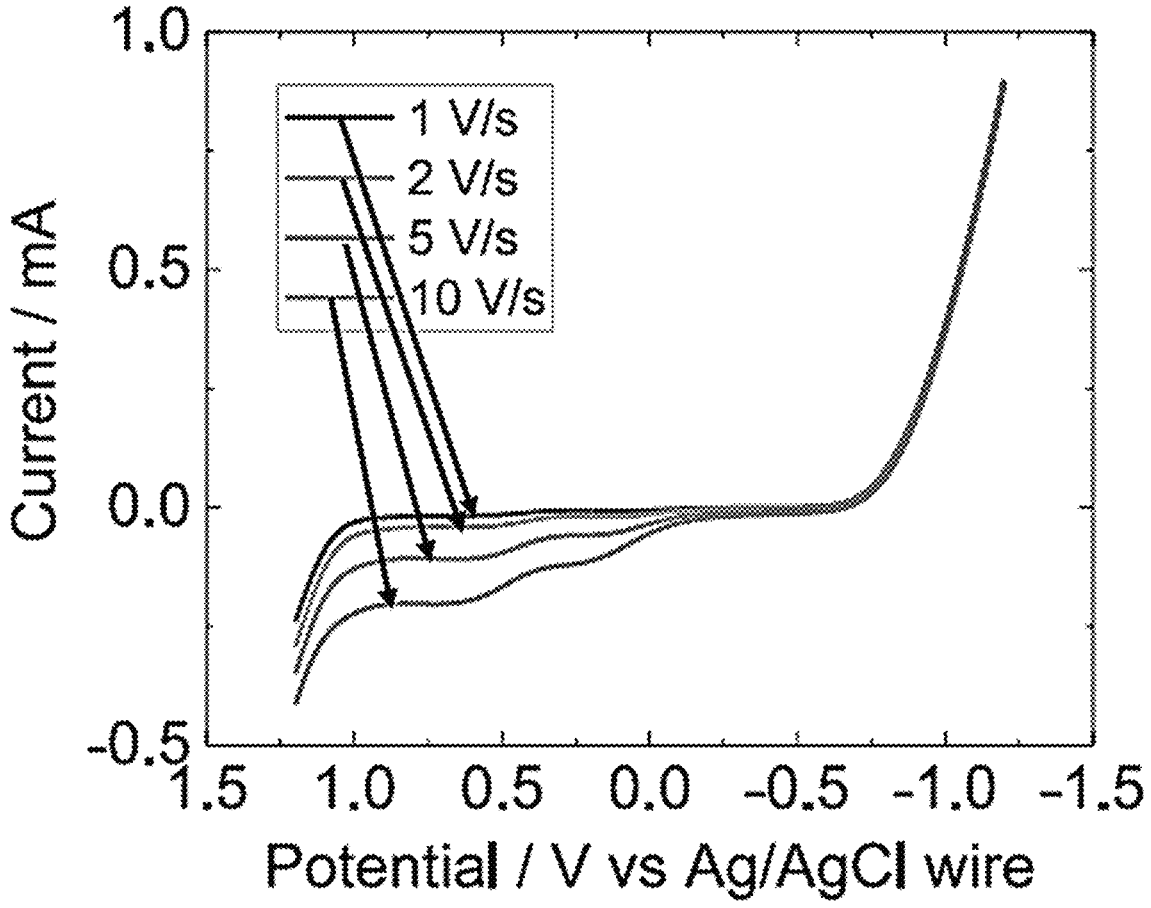
Figure 10F:
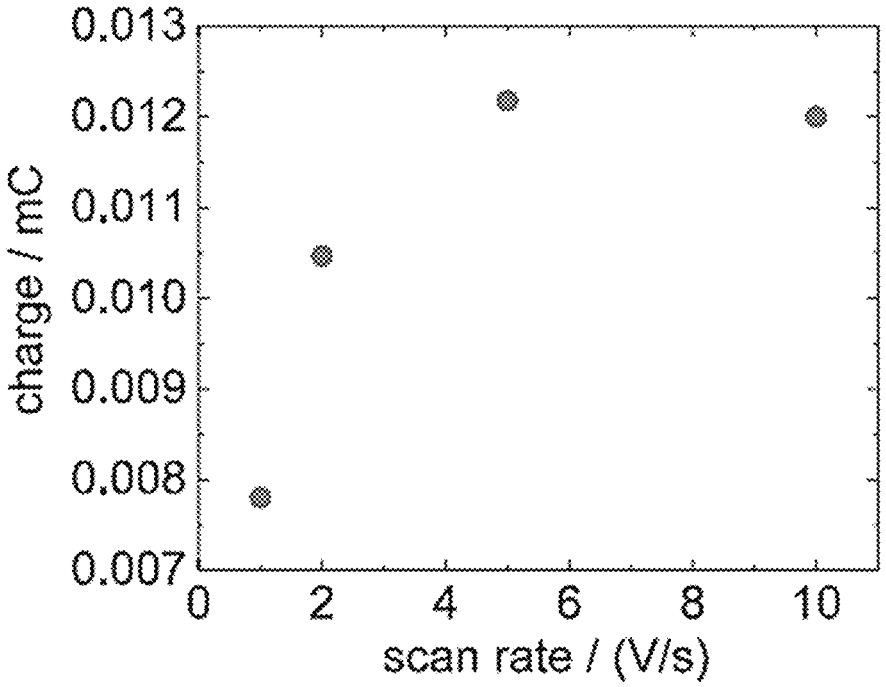

FIG. 10A depicts cyclic voltammograms for the substrate $CF_3SO_2Cl$ only and for the substrates $CF_3SO_2Cl$+2-acetylpyrrole. (10B) Cyclic voltammogram of $CF_3SO_2Cl$ in MeCN. In FIGS. 10C-10D, the critical role of $V_p$ and f in the ACE method was investigated. The standard reduction potential ($E_1$) of $CF_3SO_2Cl$ and the oxidation potential ($E_2$) of the radical intermediate were measured, which determined the voltage required for trifluoromethylation to proceed. The cyclic voltammogram of $CF_3SO_2Cl$ (FIG. 10B) showed an onset potential for $CF_3SO_2Cl$ reduction is −0.7 V vs Ag/AgCl. The $E_1$ was estimated to be −0.97 V using the inflection points of the cathodic wave (Espinoza, et al., *J. Electrochem. Soc.* 2019, 166 (5), H3175-H3187). To detect the oxidation of the unstable intermediate, fast-scan linear sweep voltammetry was used (Andrieux, et al., *J. Am. Chem. Soc.* 1990, 112 (6), 2439-2440). The electrode potential was held at −1.2 V to reduce $CF_3SO_2Cl$ and generate a pool of radical intermediate. Subsequent scanning of the electrode potential positively at a high scan rate of 20 V/s enabled the oxidation of the radical intermediate before it proceeded through other pathways. At low scan rates, the electrochemical signal from the oxidation of the radical intermediate significantly diminished (FIGS. 10D, 10E), confirming the instability of the radical intermediate. An anodic wave was observed starting from 0 V with a major peak at 0.7 V (FIG. 10A). When the potential was held at −0.4 V, wherein no $CF_3$ radical was generated, no anodic wave was observed, suggesting the anodic wave results from the oxidation of the radical intermediate. To further confirm this result, two additional experiments were carried out. First, the holding time was elongated at −1.2 V to generate more $CF_3$ radicals. Second, the concentration of 2-actylpyrrole was increased in the reaction mixture. In both cases, a significantly increased current (FIG. 10C) was observed, confirming the anodic wave arose from the oxidation of the radical intermediate. Accordingly, $E_2$ was estimated to be 0.5 V using the inflection points of the anodic wave (Espinoza, et al., *J. Electrochem. Soc.* 2019, 166 (5), H3175-H3187). Based on these results, the thermodynamic voltage for electrochemical trifluoromethylation was estimated, $|E_1-E_2|$, is 1.5 V. It is worth noting that the current took off after 0.85 V for all experiments due to direct electrooxidation of 2-actylpyrrole (Cross, et al., *J. Electroanal. Chem. Interfac.* 1985, 189 (2), 389-396; Diaz, A.; Martinez, A.; Kanazawa et al., *J. Electroanal. Chem. Interfac.* 1981, 130, 181-187; Tabba, et al., *J. Org. Chem.* 1984, 49 (11), 1870-1875). FIGS. 10E and 10F show the linear sweep voltammograms of a mixture of 1 and 2 at different scan rates. The concentrations of 1 and 2 are 0.25 M and 0.375 M, respectively. The electrode potential was held at −1.2 V for 3 s followed by sweeping the potential positively to 1.2 V at 1, 2, 5, and 10V/s. (10F) The total charge associated with the oxidation of 3 estimated from the anodic waves in (10E) as a function of scan rate. The charge decreased rapidly at scan rates <5 V/s, indicating the loss of 3 due to alternative chemical reaction pathways.

Figure 11:
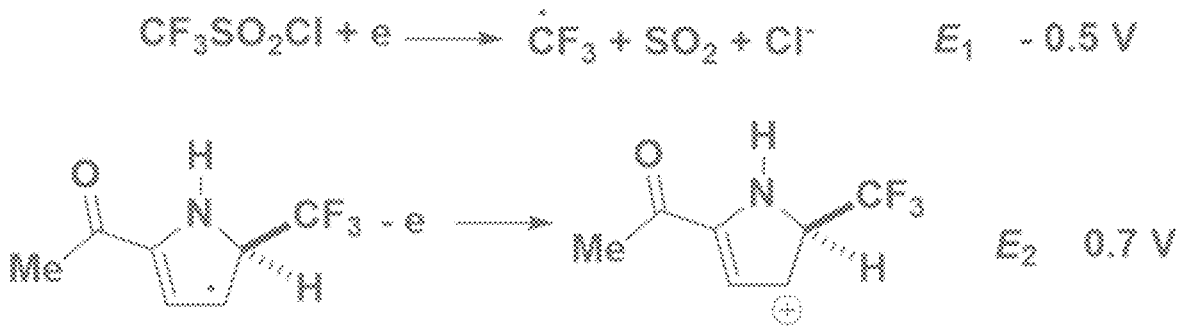
FIG. 11. During ACE, the reaction was initiated by reducing $CF_3SO_2Cl$ to $CF_3$ radicals when an electrode's potential was negative. $CF_3$ radicals are then combined with 2-actylpyrrole to form the radical intermediate. Upon the voltage polarity reversal, the radical intermediate was oxidized to the allylic cation at the same electrode. Subsequent deprotonation of the allylic cation was rapid, generating the final product.

FIG. 11 depicts the oxidation and reduction reactions of substrates described herein. The reduction of $CF_3SO_2C$ followed an $E_1$ mechanism, and the voltage was measured at −0.5 V. The oxidation of the pyrrole intermediate followed an $E_2$ mechanism, and the voltage was measured at 0.7 V. Voltage bias needed for the two reactions is 1.2 V. However, the current disclosure presents 4.4 V as the applied voltage to drive the reactions.

Figure 12A:
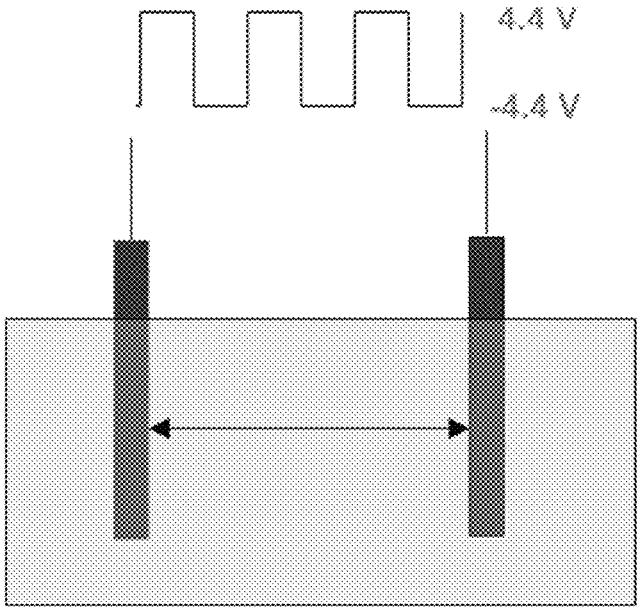
FIGS. 12A-12D. (12A) Depicts ACE using two electrodes with an applied voltage between −4.4 V and 4.4 V. (12B) A schematic of the equivalent circuit of the electrochemical system for ACE is also depicted. (12C) Measured voltage ($V_{real}$) between two glassy carbon electrodes during the ACE when $V_p$ was set as 4.4 V. (12D) The peak value of $V_{real}$ vs reaction time.
Figure 12B:
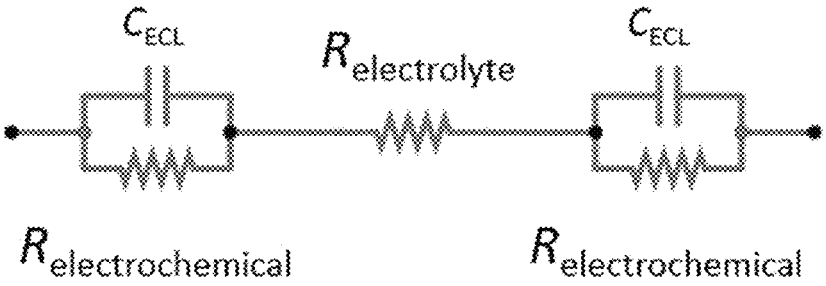

FIGS. 12A and 12B depict two electrodes using ACE with an applied voltage between −4.4 V and 4.4 V. A schematic of the equivalent circuit is also depicted. During the potential step, the electrical double layer (ECL) impedance is small. A significant portion of the voltage drop occurs at the electrolyte resistor ($R_{electrolyte}$) between the two electrodes (Bard, A. J.; Faulkner, L. R., *Electrochemical Methods: Fundamentals and Applications*. Wiley New York: 1980). The formula used to calculate the equivalent circuit's voltage is: $V_{ec}=V_0-V_0\exp(-t/R_{electrolyte}C)$.

Figure 12C:
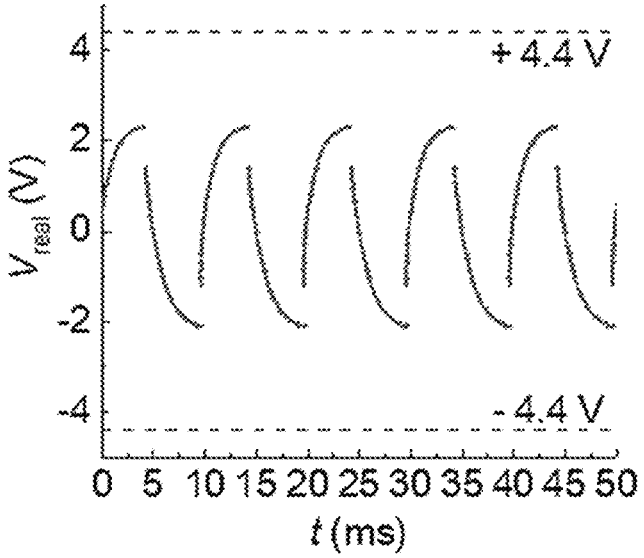

FIG. 12C shows a finding that $V_{real}$ oscillated between ±2 V at $V_p$=4.4 V during the ACE reaction.

Figure 12D:
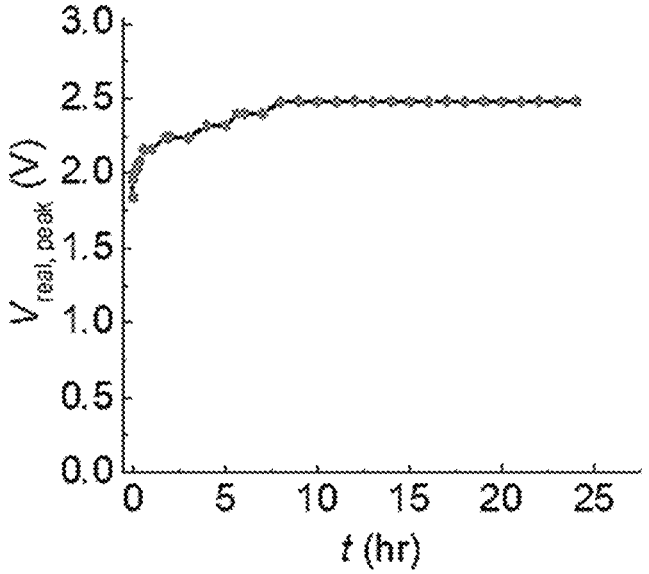

FIG. 12D shows the peak value of $V_{real}$ ($V_{real,\ peak}$) gradually increased from 1.8 V to 2.5 V and then stayed constant until the reaction completion at 24 h.

Figure 13A:
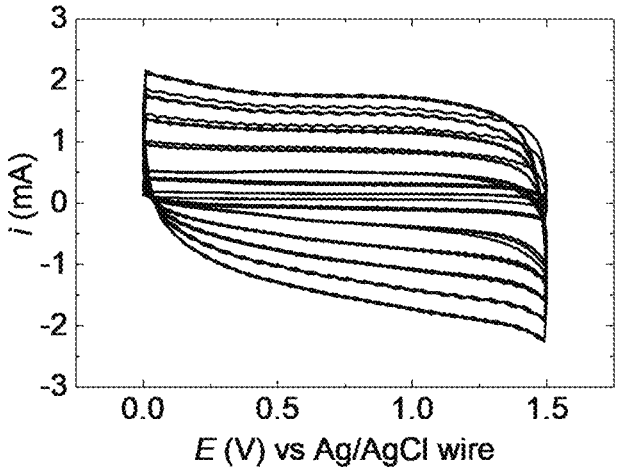
FIGS. 13A, 13B. (13A) Glassy carbon electrode in 0.125 M $LiClO_4$+MeCN solution. Cyclic voltammograms are depicting the measurement of the current for the electrical double layer ($C_{ECL}$) and the scan rate (13B) for the measurement (V/s). (13B) $C_{ECL}$ was equal to 0.5*0.0041, and F was equal to 2 mF, and the slope of the scan rate graph was measured at 0.0041 F.
Figure 13B:
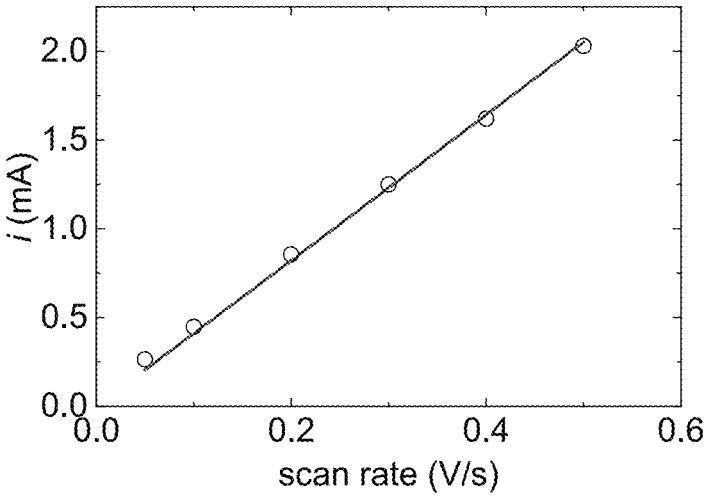

Using a glassy carbon electrode in 0.125 M $LiClO_4$+MeCN solution, FIG. 13A shows cyclic voltammograms depicting the measurement of the current for the electrical double layer ($C_{ECL}$) and FIG. 13B shows the scan rate for the measurement (V/s). $C_{ECL}$ was equal to 0.5*0.0041, and F was equal to 2 mF, and the slope of the scan rate graph was measured at 0.0041 F in FIG. 13B.

Figure 14:
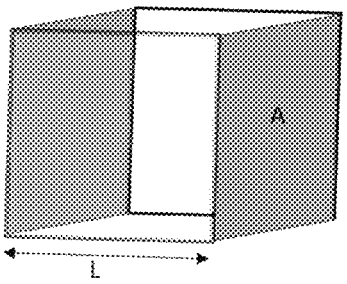
FIG. 14. Estimation of the electrolyte solution resistance between the two glassy carbon electrodes, $R_{electrolyte}$.

FIG. 14 depicts the estimation of $R_{electrolyte}$. The equation used for the calculation is:

$$R_{electrolyte}=\rho\times L/A$$

wherein ρ is resistivity, L is length, and A is cross sectional area.

$$\Lambda^\circ - \text{Molar Conductivity of } LiClO_4 = 73.27\frac{S\ \text{cm}^2}{\text{mol}}$$

$$\Lambda^\circ\ C = 73.27\frac{S\ \text{cm}^2}{\text{mol}}\times 0.125\frac{\text{mol}}{\text{cm}^3}\times 10^{-3} = 9.16\times 10^{-3}\frac{S}{\text{cm}}$$

$$\rho = \frac{1}{\Lambda^\circ\ C} = \frac{\Omega\ \text{cm}}{9.16\times 10^{-3}} = 109.17\ \Omega\text{cm}$$

$$L = 0.3\ \text{cm}$$

$$A = 1\ \text{cm}\times 3\ \text{cm} = 3\ \text{cm}^2$$

$$R_{electrolyte} = 109.17\ \Omega\text{cm}\times(0.3\ \text{cm}/3\ \text{cm}^2) = 10\Omega$$

Figure 15A:
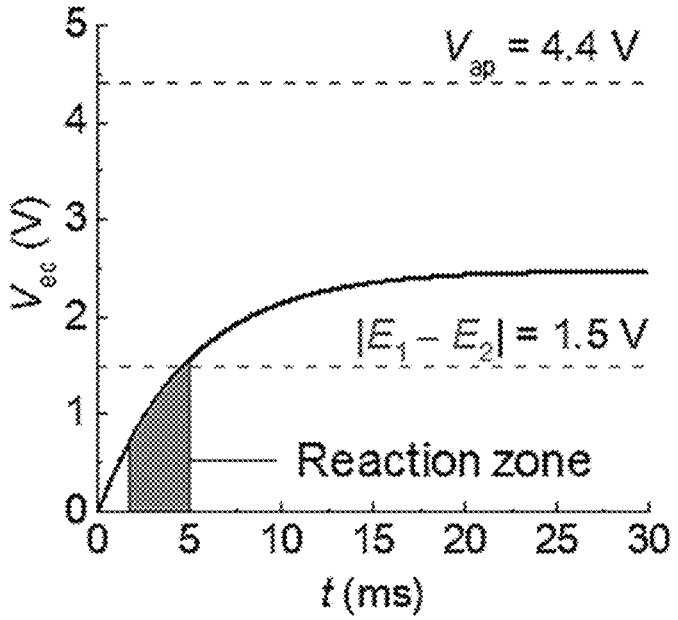
FIGS. 15A, 15B. Measurements when applying 4.4 V to substrates during formation of a product using ACE. (15A) Theoretical modeling of the voltage available for electrochemical reactions ($V_{ec}$) vs the voltage pulse duration, t, at $V_p$=4.4 V. The region highlighted in blue indicates the reaction zone during a 5 ms voltage pulse of a 100 Hz square wave. (15B) Graphic depiction of the reaction time and product yield at different applied voltages.
Figure 15B:
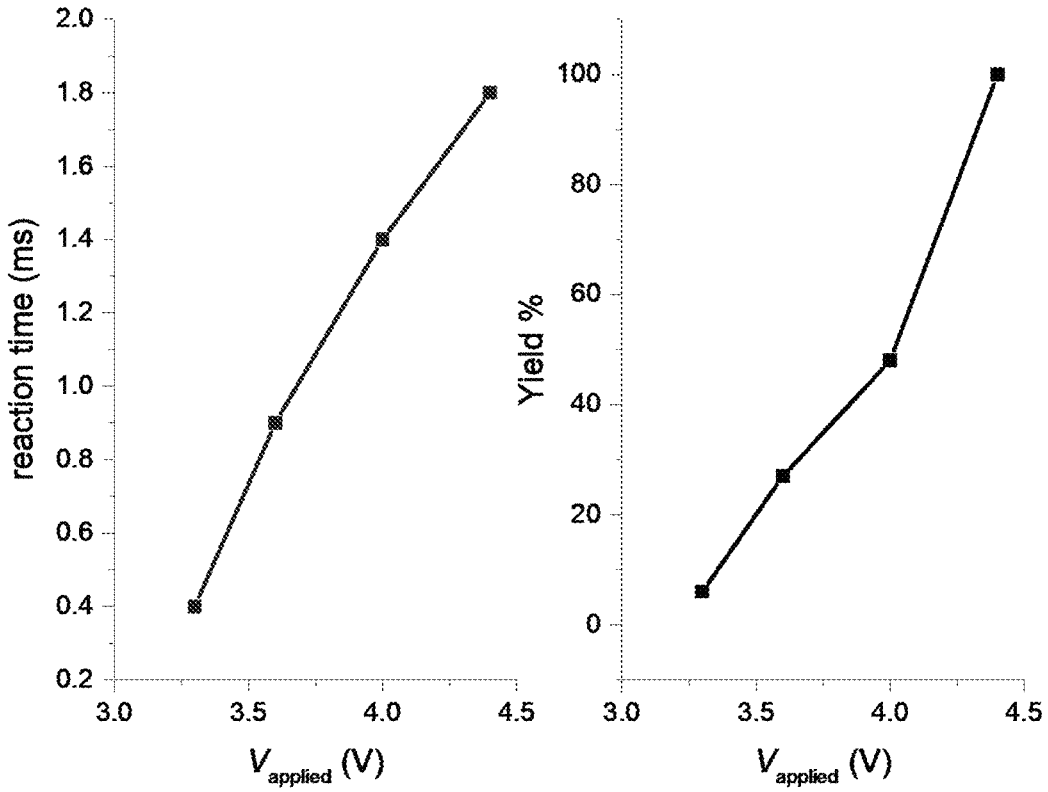

FIGS. 15A and 15B depict the measurements from applying 4.4 V to the substrates during the product's formation using ACE. FIG. 15A is a graphical depiction of applying a voltage over time. Because the onset potentials for reducing $CF_3SO_2Cl$ and oxidizing the radical intermediate were measured to be −0.7 V and 0 V, the minimum voltage required for electrochemical trifluoromethylation is 0.7 V. Therefore, trifluoromethylation only occurred between 1.7 ms and 5 ms in a single voltage pulse. FIG. 15B is a graphic depiction of the reaction time when the voltage was applied to the reaction. At 100 Hz, each pulse lasts 5 ms. The voltage drop at the electrolyte during the voltage pulses leads to the higher voltage required for AC electrolysis.

Figure 16A:
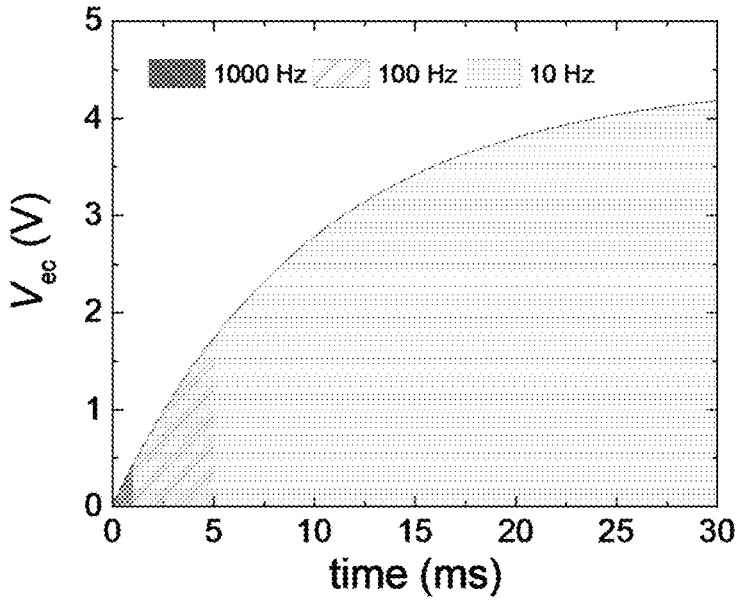
FIGS. 16A-16C. (16A) The voltage available for electrochemical reactions applied over time using a frequency of 10, 100, and 1000 Hz. (16B) Predicted ranges of $V_{ec}$ at different $V_p$ and f. The error bars were calculated from the variations in $V_{real,\ peak}$ during the reactions. (16C). Measured $V_{real,\ peak}$ at different $V_p$ and f during ACE. The error bars are the standard deviations of the $V_{real,\ peak}$ values measured hourly for 24 hours.
Figure 16B:
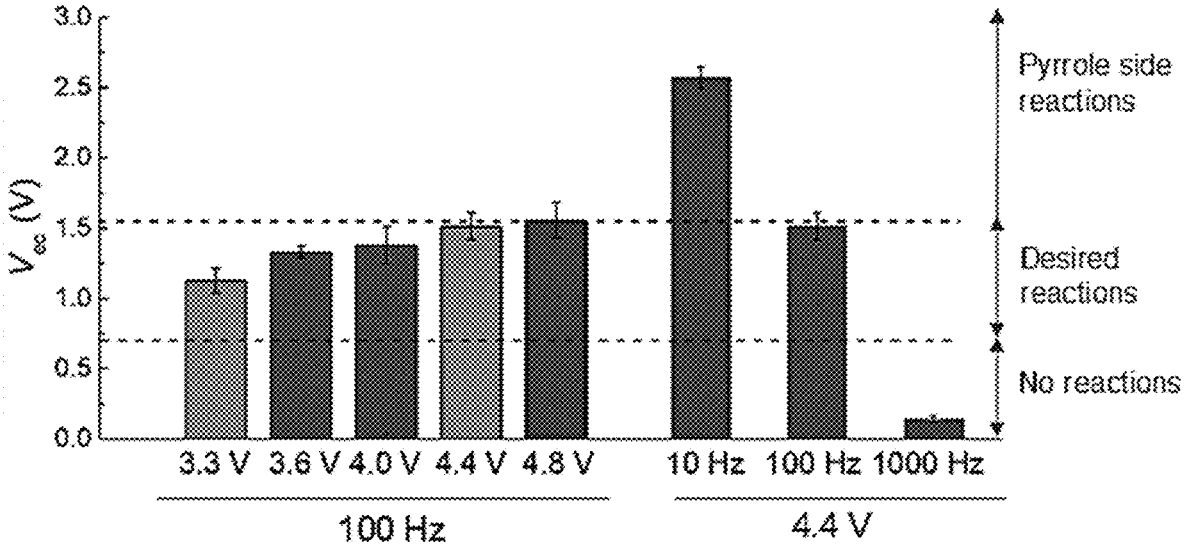
Figure 16C:
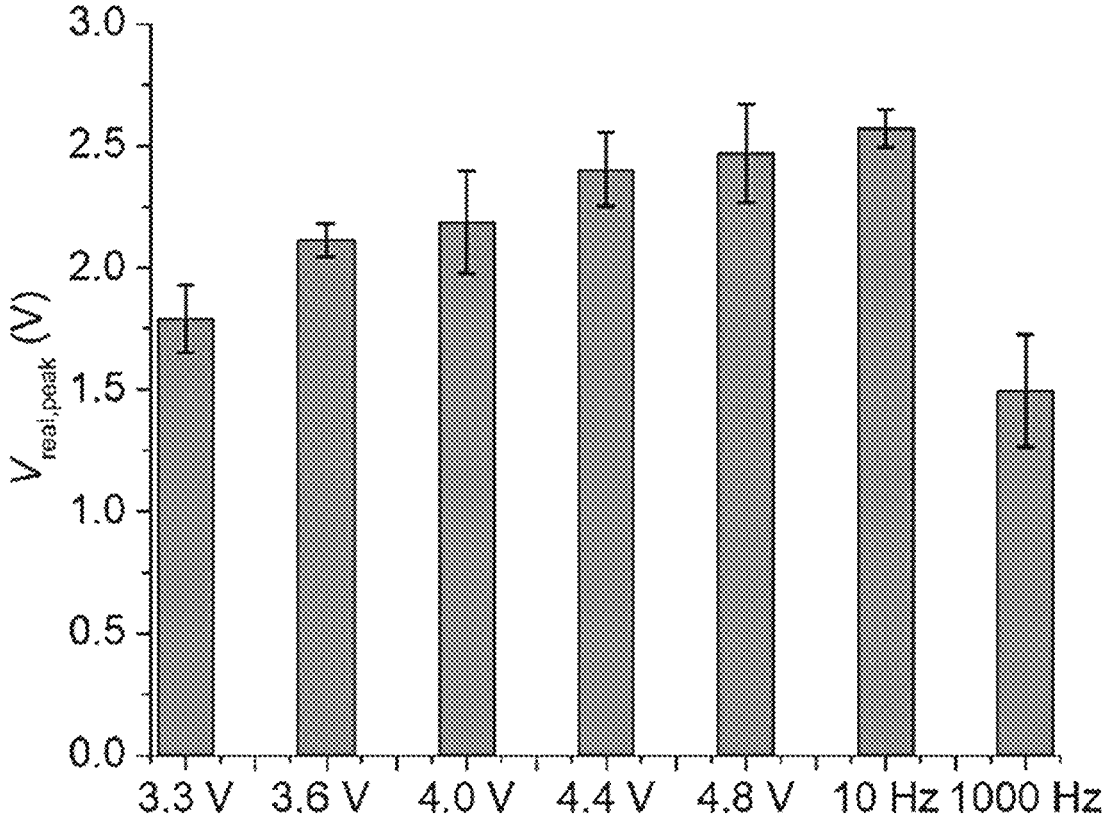

FIGS. 16A-16C illustrate the graphical depictions of substrates when a voltage of 100 was applied to the reaction. FIG. 16A shows the voltage applied over time using a frequency of 10, 100, and 1000 Hz. The predicted ranges of $V_{ec}$ at different $V_p$ and f using the equation $V_{ec}=V_{real,\ peak}(1-\exp(-2t/R_{electrolyte}C_{EDL}))$ and the measured $V_{real,\ peak}$ (FIG. 16C) are summarized in FIG. 16B. At all $V_p$, $V_{ec}$ passed the minimum voltage of 0.7 V required by electrochemical trifluoromethylation. At $V_p$=4.8 V, $V_{ec}$ was also enough to oxidize 2-actylpyrrole and reduce $CF_3SO_2Cl$ simultaneously (>1.55 V). These results are consistent with the experimental findings that (1) the desired final product was observed at $V_p$>3.3 V; (2) the product yield increased, and the unreacted 2-actylpyrrole decreased until $V_p$ reached 4.4 V; and (3) the chlorination product was observed at 4.8 V due to the direct oxidation of 2-actylpyrrole (De Rosa, et al., *J. Org. Chem.* 1982, 47 (6), 1008-1010). A similar analysis was conducted for different f at $V_p$=4.4 V. At 1000 Hz, $V_{ec}$ was always below 0.7 V, and thus unable to drive the reactions. At 10 Hz, $V_{ec}$ went beyond the voltage for direct oxidation of pyrrole, causing significant side reactions. FIGS. 16A-16C show the measured $V_{real,\ peak}$ values at different frequencies and voltages.

Figure 17A:
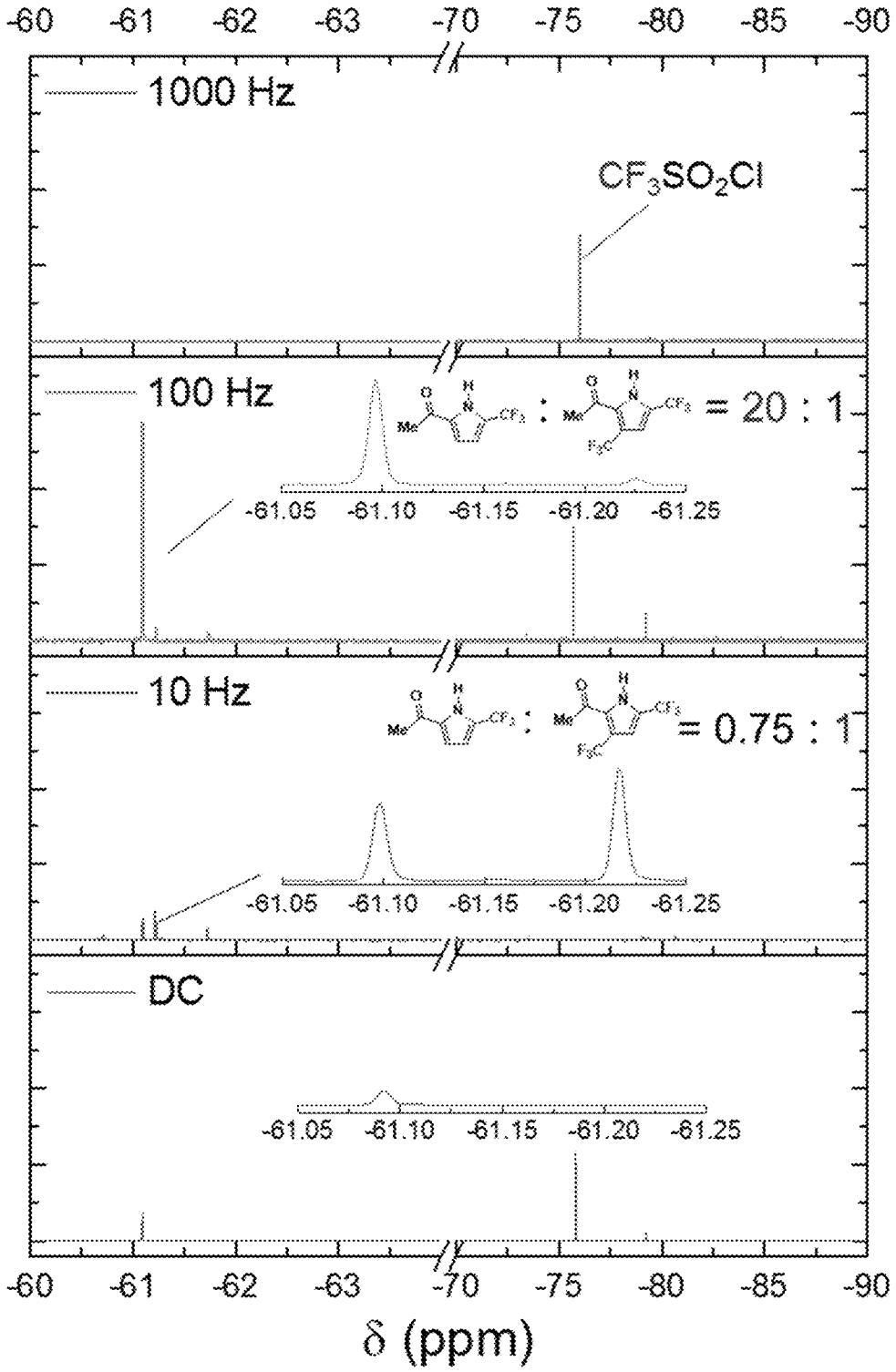
FIGS. 17A, 17B. NMR analysis of the reaction product mixtures under different AC frequencies of 1000 Hz, 100 Hz, 10 Hz, and DC. The voltage amplitude was kept at 4.4 V. (17A) $^{19}$F-NMR of product mixtures. (17B)$^1$H-NMR of the product mixtures.
Figure 17B:
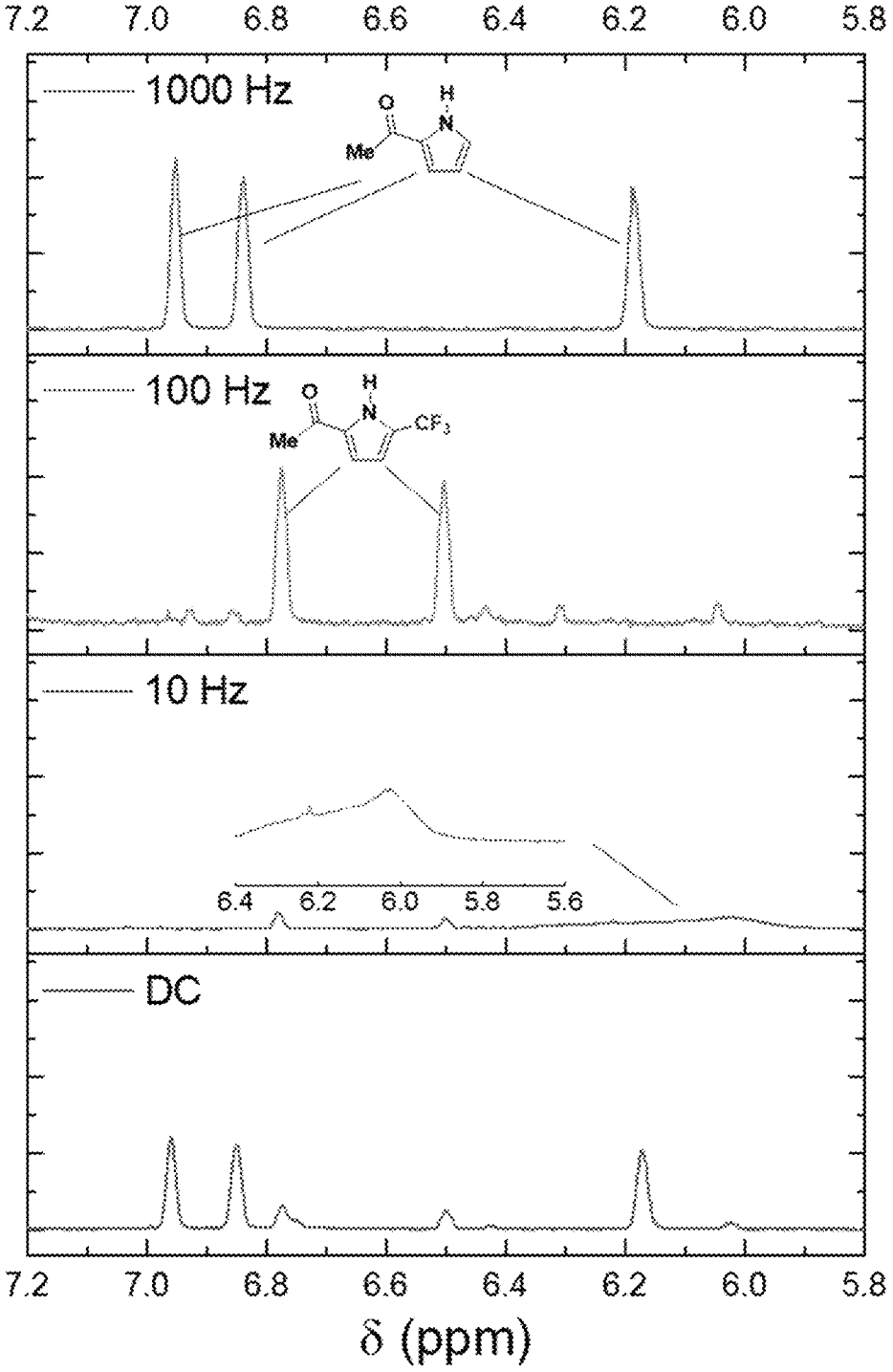

NMR analysis of products using AC with different frequencies and DC are shown in FIGS. 17A and 17B. Specifically, FIG. 17A shows the $^{19}$F-NMR spectra. FIG. 17B shows $^1$H-NMR spectra.

Figure 18A:
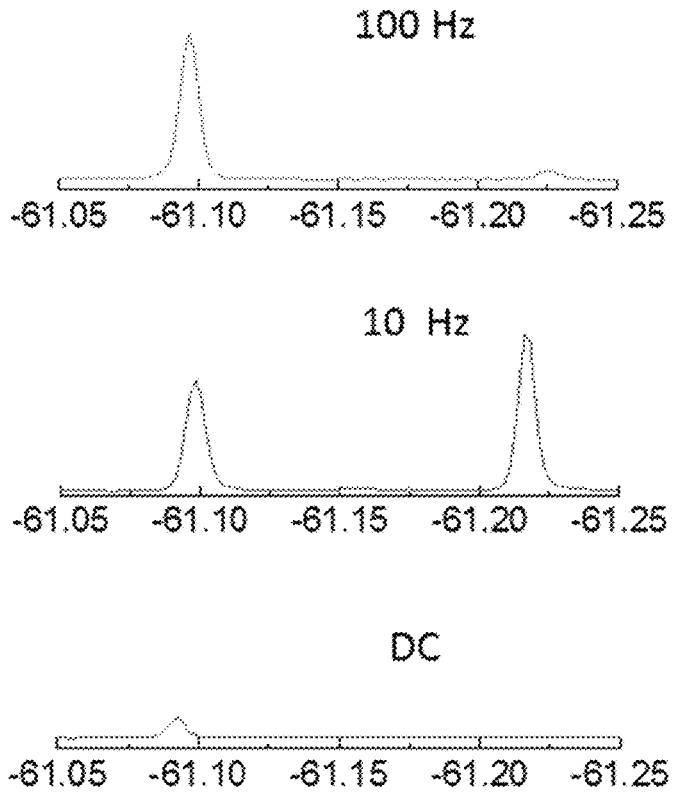
FIGS. 18A-18MM. Regioselectivity. (18A) Frequency showing 100 Hz, 10 Hz, and control DC data. (18B) Baran's work is illustrating results obtained for the pyrrole substrate reaction using an anodic mechanism. (18C) Comparison of frequencies 100 Hz and 10 Hz with Baran's work (O'Brien, et al., *Angew. Chem., Int. Ed.* 2014, 53 (44), 11868-11871). (18D) General procedure for the synthesis of pyrrole amides/ester substrates. (18E) Amide product 28. (18F) Compound 29. (18G) Compound 30. (18H) Compound 31. (18I) General procedure for the synthesis of aryl pyrroles via microwave reaction. (18J) Cross-coupling product 32. (18K). General procedure for the synthesis of furoyl amides. (18L) Coupling amide product 33. (18M) Coupling amide product 34. (18N) Coupling amide product 35. (18O) General procedure for the synthesis of thiophene amides. (18P) Coupling amide product 36. (18Q) Coupling amide product 37. (18R) General procedure for trifluoromethylation and instrumental setup for the other substrates. (18S) Trifluoromethylated pyrrole 5. (18T) Compound 7. (18U) Compound 8. (18V) Compound 9. (18) Compound 10. (18Y) Compound 11. (18X) Compound 12. (18Z) Compound 13. (18AA) Compound 14. (18BB) Compound 15. (18CC) Compound 16. (18DD) Compound 17. (18EE) Compound 18. (18FF) Compound 19. (18GG) Compound 20. (18HH) Compound 21. (18II) Compound 22. (18JJ) Compound 23. (18KK) Compound 24. (18LL) TEMPO trapping control experiment. (18MM). $^{19}$F NMR spectrum of the mixture after the TEMPO trapping experiment. Peak A at 55.9 ppm corresponds to the TEMPO-$CF_3$ adduct.
Figure 18B:
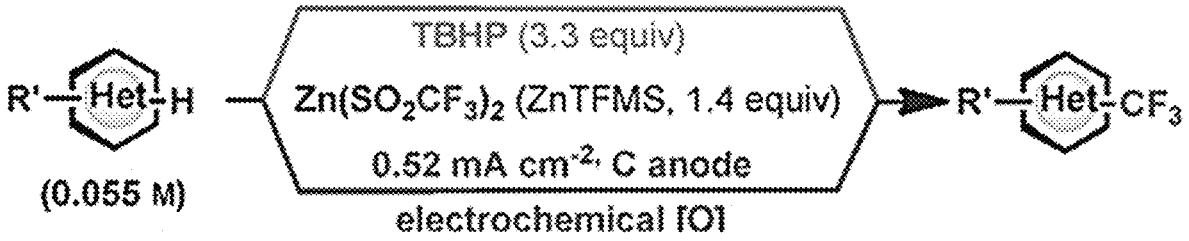
FIG. 18B (prior art)
Figure 18C:
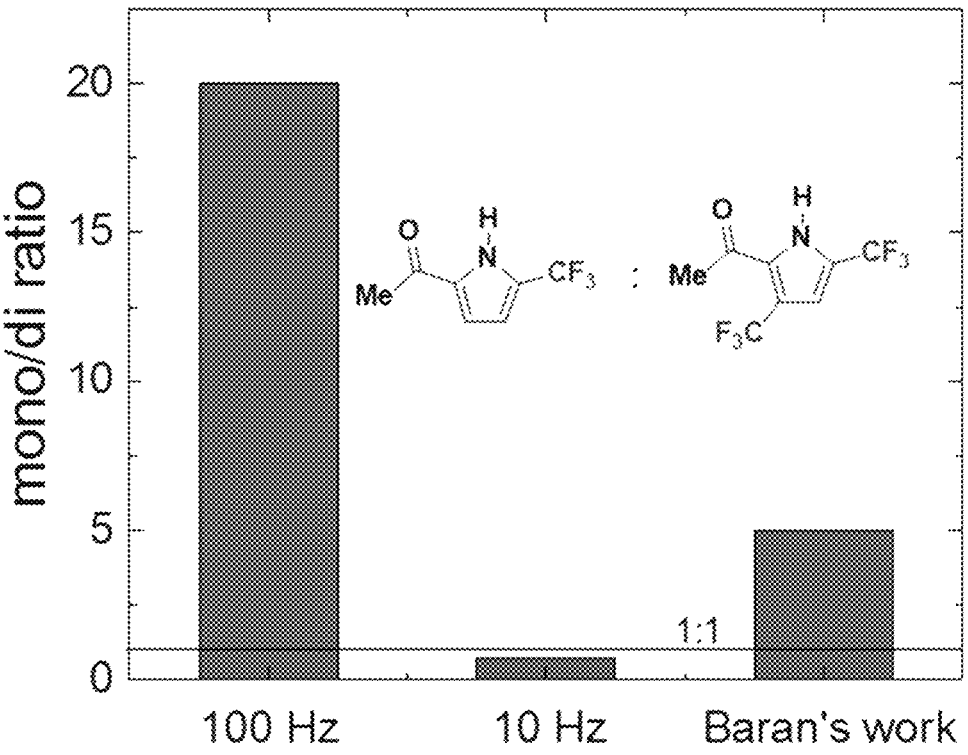

FIGS. 18A-18C show the regioselectivity between monotrifluoromethylated and bistrifluoromethylated products. FIG. 18A depicts the regioselectivity at AC frequencies of 100 Hz, 10 Hz, and DC. FIG. 18B illustrates the anodic trifluoromethylation reaction for pyrrole in the literature (Baran and coworkers, Angew. Chem., Int. Ed., 2014, 53, 11868-11871). FIG. 18C shows the comparison of the product regioselectivity between the ACE method at frequencies of 100 Hz and 10 Hz and the anodic method previously reported in the literature.

Methods and reagents used in the organic electrosynthesis for the trifluoromethylation of heteroarenes using ACE. Bulk $CF_3SO_2Cl$ reagent was purchased from Sigma Aldrich and used without further purification. Bulk $CF_3SO_2C$ reagent was stored in a glove box freezer at 20° C., and fresh aliquots were removed from the glove box and added immediately to the reaction. $K_2HPO_4$ was purchased from Sigma Aldrich and used after drying (powdered and dried/stored in an oven at 140° C.). $LiClO_4$ (99.99%) was purchased from Sigma-Aldrich and used without further purification. Dry solvents were obtained from an SG Waters solvent system utilizing activated alumina columns under argon or purchased from Sigma-Aldrich in Sure/Seal™ bottles. All chemicals and reagents were obtained from commercial vendors and used without further purification. Analytical thin-layer chromatography (TLC) was routinely used to monitor the progress of the reactions. TLC was performed using pre-coated glass plates with 230-400 mesh silica gel impregnated with a fluorescent indicator (250 nm). Visualization was accomplished using UV light, potassium permanganate, or phosphomolybdic acid. All electrochemical trifluoromethylation reactions were carried out on a 0.25-0.5 mmol scale unless otherwise stated. Flash chromatography was performed on silica gel flash chromatography columns, Biotage Isolera or Teledyne Isco CombiFlash $R_f$ system utilizing normal phase pre-column cartridges and gold high-performance columns. Purifications were performed using ethyl acetate/n-hexane eluting with a gradient method starting at 0:100 ethyl acetate:n-hexane and ending at 100:0 ethyl acetate:n-hexane. Crude $^{19}F$ NMR yields of all trifluoromethylated arenes were determined using hexafluorobenzene ($PhF_6$) as an internal standard. Organic solutions were concentrated by rotary evaporation below 25° C. at 60 mbar unless otherwise stated. Glassy carbon (vitreous) plates (100 mm×100 mm) were purchased from SPI Supplies.

Instrumentation used in the organic electrosynthesis for the trifluoromethylation of heteroarenes using ACE. All proton ($^1H$) nuclear magnetic resonance spectra were recorded on a 400 or 500 or 600 MHz spectrometer. All carbon ($^{13}C$) nuclear magnetic resonance spectra were recorded on a 101 or 125 or 151 MHz NMR spectrometer. All fluorine ($^{19}F$) nuclear magnetic resonance spectra were recorded on a 376 MHz NMR spectrometer. Chemical shifts were expressed in parts per million (δ scale) and were referenced to residual $CHCl_3$ ($^1H$: δ 7.26 ppm, $^{13}C$: δ 77.16 ppm) and $C_6F_6$ ($^{12}F$: δ−163 ppm). Data are presented as follows: chemical shift, multiplicity (s=singlet, d=doublet, t=triplet, q=quartet, m=multiplet, and bs=broad singlet), integration, and coupling constant in hertz (Hz). High-resolution TOF mass spectrometry utilizing electrospray ionization in positive mode or electron ionization was performed to confirm the identity of the compounds. All electrochemical reactions were carried out using a function generator (Agilent 33210A). The discharge voltage, frequency, and waveform were monitored using an oscilloscope (SIGLENT Technologies SDS1202X-E). Voltammetry experiments were carried out using a CHI 650E potentiostat.

Figure 18D:
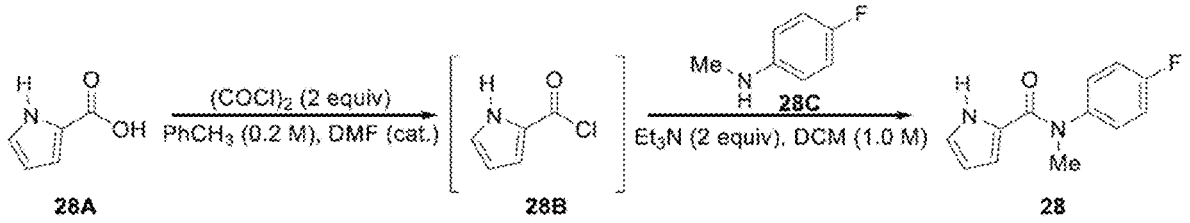

FIGS. 18D-18H. show the general procedure for the synthesis of pyrrole amides/esters and structures. In FIG. 18D, a 25 mL oven-dried Schlenk flask was charged with pyrrole-2-carboxylic acid 28A (222 mg, 2 mmol, 1 equiv) in toluene (10 mL) under argon. Oxalyl chloride (0.34 mL, 4 mmol, 2 equiv) was subsequently added to the reaction, followed by DMF (2 drops). The resulting mixture was heated to 65° C. in an oil bath and stirred for 1 h under argon. The mixture was then allowed to cool to room temperature. The solvent was removed in vacuo to afford the pyrrole acid chloride 28B a brown amorphous solid, which was used without further purification. The pyrrole acid chloride 28B was dissolved in DCM (2 mL) and added to a stirring solution of aniline 28C (500 mg, 4 mmol, 2 equiv.) in DCM under argon. $Et_3N$ (0.55 mL, 4 mmol, 2 equiv) was added dropwise to the solution and the resulting mixture was stirred at room temperature overnight.

The reaction mixture was monitored by TLC. Upon completion, a saturated aqueous $NH_4Cl$ solution was added to the reaction and extracted with DCM (3×50 mL). The combined organic extract was washed with a saturated aqueous NaCl solution (1×50 mL), dried over $Na_2SO_4$, and concentrated in vacuo. The crude residue was purified via flash chromatography (20:80 to 50:50 EtOAc:Hexane) to give the coupling amide product 28 (313.9 mg, 1.44 mmol, 72%) as a grey amorphous solid.

Figure 18E:
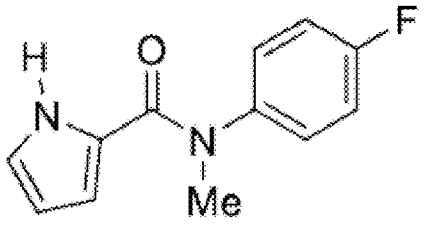

In FIG. 18E, amide product 28, the $^1H$ NMR ($CDCl_3$, 400 MHz) results show: δ=10.22 (bs, 1H), 7.31-7.22 (m, 2H), 7.16-7.10 (m, 2H), 6.86-6.78 (m, 1H), 5.94 (q, J=2.6 Hz, 1H), 4.98 (s, 1H), 3.41 (s, 3H); The $^{13}C$ NMR ($CDCl_3$, 125 MHz) results show: δ=162.1 (d, J=248.2 Hz), 161.6, 129.9 (d, J=8.6 Hz), 124.9, 121.1, 116.7 (d, J=22.6 Hz), 113.8, 109.6, 38.6; The $^{19}F$ NMR ($CDCl_3$, 376 MHz) results show: δ=−112.8; The High Resolution Mass Spectrometry (HRMS) (TOF Cl+) m/z results show: $[M+H]^+$ Calcd. for $C_{12}H_{12}FN_{2O}$ 219.0934 and found: 219.0922.

Figure 18F:
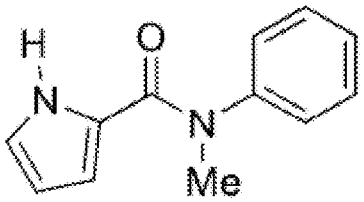

In FIG. 18F, Compound 29 was synthesized from N-methylaniline (0.54 ml, 5 mmol) using the same procedure to synthesize compound 28. The crude residue was purified via flash chromatography (20:80 to 50:50 EtOAc:Hexane) to give pure compound 29. The Isolated Yield was measured at 66% (264 mg, 1.32 mmol) as a white amorphous solid. The $^1H$ NMR ($CDCl_3$, 600 MHz) results show: δ=9.87 (bs, 1H), 7.47-7.39 (m, 3H), 7.30-7.27 (m, 2H), 6.81 (td, J=2.7, 1.3 Hz, 1H), 5.90 (dt, J=3.9, 2.6 Hz, 1H), 4.94-4.92 (m, 1H), 3.43 (s, 3H); The $^{13}C$ NMR ($CDCl_3$, 151 MHz) results show: δ=161.5, 144.3, 129.8, 128.2, 128.2, 125.1, 120.8, 113.7, 109.6, 38.5; The HRMS (TOF Cl+) m/z results show: $[M+H]^+$ Calcd. for $C_{12}H_{13}N_2O$, 201.1028 and found: 201.1016.

Figure 18G:
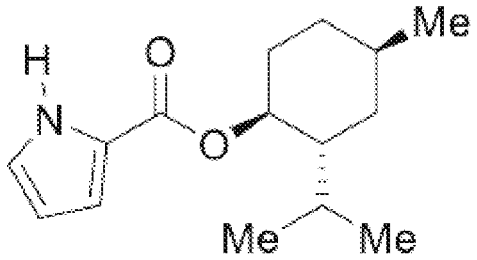

In FIG. 18G, Compound 30 was synthesized from L-menthol (342.2 mg, 4.2 mmol) using the same procedure to synthesize compound 28. The crude residue was purified via flash chromatography (20:80 to 40:60 EtOAc:Hexane) to give pure compound 30. The Isolated Yield was measured at 82% (408.9 mg, 1.64 mmol) as a grey amorphous solid. The $^1H$ NMR ($CDCl_3$, 400 MHz) results show: δ=9.19 (s, 1H), 7.08-6.79 (m, 2H), 6.28-6.25 (m, 1H), 4.87 (td, J=10.9, 4.4 Hz, 1H), 2.09 (dtd, J=12.0, 4.0, 1.7 Hz, 1H), 1.94 (td, J=7.0, 2.7 Hz, 1H), 1.71 (dd, J=11.5, 2.7 Hz, 2H), 1.59-1.45 (m, 2H), 1.17-1.03 (m, 2H), 0.91 (t, J=6.7 Hz, 7H), 0.79 (d, J=6.9 Hz, 3H); The $^{13}C$ NMR ($CDCl_3$, 151 MHz) results show: δ=160.8, 122.5, 114.9, 110.3, 74.2, 47.3, 41.1, 34.3, 31.4, 26.5, 23.7, 22.0, 20.7, 16.6; The HRMS (TOF Cl+) m/z results show: $[M+H]^+$ Calcd. for $C_{15}H_{24}NO_2$ 250.1802 and found: 250.1807.

Figure 18H:
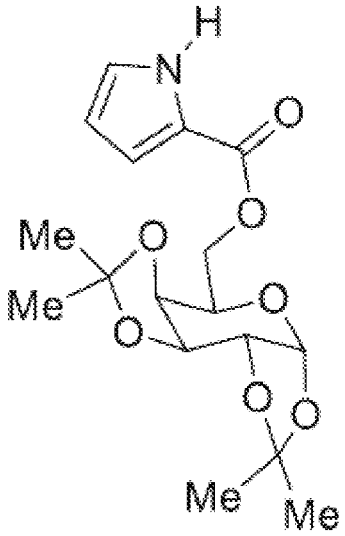

In FIG. 18H Compound 31 was synthesized from diacetone D-galactal (572 mg, 2.2 mmol) using the same procedure to synthesize compound 28. The crude residue was purified via flash chromatography (20:80 to 40:60 EtOAc:

Hexane) to give pure compound 31. The Isolated Yield was measured at 62% (218.9 mg, 1.24 mmol) as a yellow oil. The $^1$H NMR ($CDCl_3$, 400 MHz) results show: δ=9.15 (bs, 1H), 6.96 (ddq, J=6.9, 2.7, 1.2 Hz, 2H), 6.26 (dt, J=3.7, 2.5 Hz, 1H), 5.56 (d, J=5.0 Hz, 1H), 4.64 (dd, J=7.9, 2.5 Hz, 1H), 4.49 (dd, J=11.5, 5.0 Hz, 1H), 4.40-4.28 (m, 3H), 4.14 (ddd, J=7.2, 4.9, 1.9 Hz, 1H), 1.51 (s, 3H), 1.47 (s, 3H), 1.35 (s, 3H), 1.33 (s, 3H); The $^{13}$C NMR ($CDCl_3$, 101 MHz) results show: δ=160.8, 123.1, 115.8, 110.4, 109.6, 108.8, 71.1, 70.7, 70.5, 66.2, 63.1, 26.0, 26.0, 25.0, 24.5; The HRMS (TOF Cl+) m/z results show: $[M+H]^+$ Calcd. for $C_{17}H_{24}NO_7$ 354.1553 and found: 354.1547.

Figure 18I:
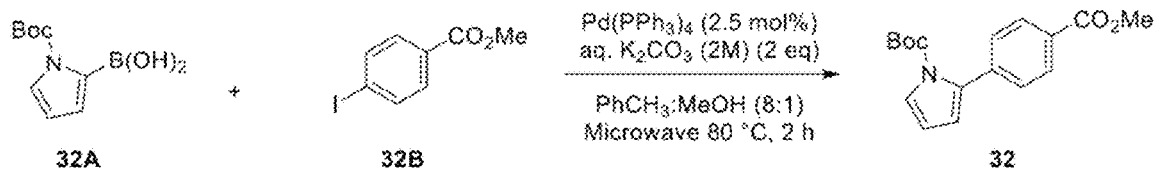
Figure 18J:
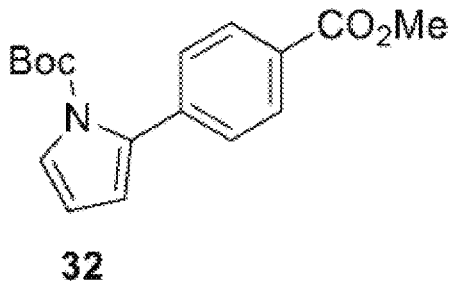

FIGS. 18I and 18J show the general procedure for the synthesis of aryl pyrroles via microwave reaction and structures. In FIG. 18I, A 20 mL Biotage microwave reaction vial was charged with $Pd(PPh_3)_4$ (29.0 mg, 0.025 mmol, 2.5 mol %), (1-(tert-butoxycarbonyl)-1H-pyrrol-2-yl)boronic acid 32A (211.0 mg, 1.0 mmol, 1.0 equiv.), and methyl 4-iodobenzoate 32B (393.0 mg, 1.5 mmol, 1.5 equiv.). The vial was then sealed with the approved seal for the Biotage reactor and was evacuated under high vacuum for 30 min. The reaction vial was then refilled with argon/nitrogen, followed by sequential addition of 2 M aq. $K_2CO_3$ (1 mL) and an 8:1 mixture of toluene and methanol (4 mL). The seal mixture was then placed in the microwave reactor and allowed to run at 80° C. for 2 h. Upon the completion, the reaction mixture was treated with saturated aqueous NaCl and extracted with ethyl acetate (3×10 mL). The combined organic extract was dried over $Na_2SO_4$ and concentrated in vacuo. The crude oil was then purified over silica using the solvent gradient (0:100 to 20:80 EtOAc/Hexane) to give the cross-coupling product 32 (247 mg, 0.82 mmol, 82%) as a yellow oil.

In FIG. 18J, Cross-coupling product 32, the $^1$H spectra of 32 matched with the literature report (Honraedt, *Chem. Commun.* 2014, 50 (40), 5236-5238). The $^1$H NMR ($CDCl_3$, 400 MHz) results show: δ=8.02 (d, J=8.3 Hz, 2H), 7.49-7.33 (m, 3H), 6.25 (t, J=2.4 Hz, 2H), 3.92 (s, 3H), 1.37 (s, 9H).

FIGS. 18K-18N show the general procedure for the synthesis of furoyl amides and structures.

Figure 18K:
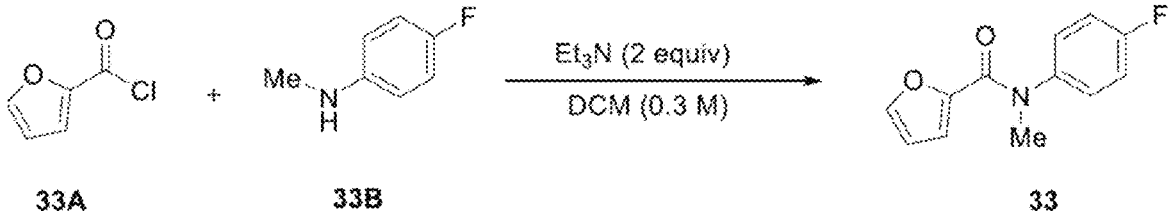

In FIG. 18K, a 25 mL oven-dried Schlenk flask was charged with 2-furoyl chloride 33A (400 mg, 3.06 mmol, 1 equiv), methylene chloride (9 mL) under argon. Triethylamine (0.85 mL, 6.12 mmol, 2 equiv) was then added to the solution. 4-Fluoro-N-methylaniline 33B (0.44 mL, 3.68 mmol, 1.2 equiv) was added dropwise to the solution. The resulting mixture was stirred under argon overnight at room temperature. The reaction mixture was diluted with water and extracted with ethyl acetate (3×50 mL). The combined organic extract was dried over $Na_2SO_4$ and concentrated in vacuo. The crude residue was purified via gradient flash chromatography (0:100 to 50:50 EtOAc/Hexane) to give the coupling amide product 33 (435.5 mg, 1.98 mmol, 65%) as a white amorphous solid.

Figure 18L:
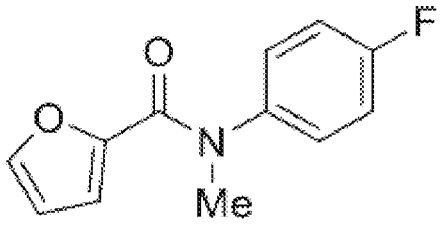

In FIG. 18L, Coupling amide product 33, the $^1$H NMR ($CDCl_3$, 400 MHz) results show: δ=7.33-7.28 (m, 1H), 7.22-7.15 (m, 2H), 7.14-7.05 (m, 2H), 6.24 (dd, J=3.5, 1.7 Hz, 1H), 5.99 (d, J=3.3 Hz, 1H), 3.41 (s, 3H); The $^{13}$C NMR ($CDCl_3$, 151 MHz) results show: δ=161.7 (d, J=248.0 Hz), 159.3, 147.0, 144.3, 140.2 (d, J=3.3 Hz), 129.1 (d, J=8.6 Hz), 116.5, 116.5 (d, J=22.7 Hz), 111.0, 38.6; The $^{19}$F NMR ($CDCl_3$, 376 MHz) results show: δ=−113.4; The HRMS (TOF Cl+) m/z results show: $[M+H]^+$ Calcd. for $C_{12}H_{11}FNO_2$ 220.0774 and found: 220.0771.

Figure 18M:
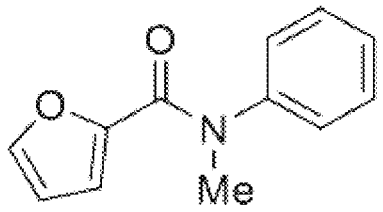

In FIG. 18M, coupling amide product 34 was synthesized from N-methylaniline (0.40 ml, 3.67 mmol) using the same procedure to synthesize compound 33. The crude residue was purified via gradient flash chromatography (0:100 to 50:50 EtOAc/Hexane) to give the coupling amide product 34. The Isolated Yield was measured at 69% (429.8 mg, 2.13 mmol) as a white amorphous solid. The $^1$H and the $^{13}$C NMR spectra of 34 matched with the literature report. (Wang, et al., Tetrahedron Lett. 2013, 54 (46), 6233-6236). The $^1$H NMR ($CDCl_3$, 600 MHz) results show: δ=7.43-7.38 (m, 2H), 7.39-7.33 (m, 1H), 7.31 (dd, J=1.7, 0.8 Hz, 1H), 7.22-7.19 (m, 2H), 6.19 (dd, J=3.6, 1.7 Hz, 1H), 5.83 (d, J=3.5 Hz, 1H), 3.44 (s, 3H); The $^{13}$C NMR ($CDCl_3$, 151 MHz): 5=159.4, 147.1, 144.2, 144.2, 129.6, 127.8, 127.4, 110.9, 38.4; The HRMS (TOF Cl+) m/z results show: $[M+H]^+$ Calcd. for $C_{12}H_{12}NO_2$ 202.0868 and found: 202.0864.

Figure 18N:
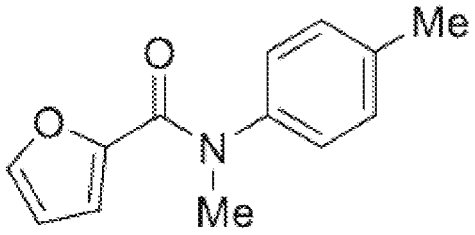
Figure 180:
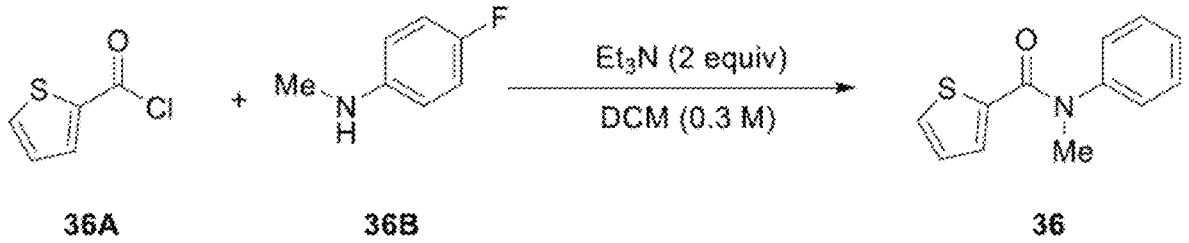

In FIG. 18N, coupling amide product 35 was synthesized from N,4-dimethylaniline (0.46 ml, 3.67 mmol) using the same procedure to synthesize compound 33. The crude residue was purified via gradient flash chromatography (0:100 to 50:50 EtOAc/Hexane) to give the coupling amide product 35. The Isolated Yield was measured at 69% (447.1 mg, 2.08 mmol) as white amorphous solid. The $^1$H NMR ($CDCl_3$, 600 MHz) results show: δ=7.34 (dd, J=1.7, 0.8 Hz, 1H), 7.20 (d, J=7.7 Hz, 2H), 7.10-7.07 (m, 2H), 6.19 (dd, J=3.5, 1.7 Hz, 1H), 5.77 (s, 1H), 3.41 (s, 3H), 2.40 (s, 3H); The $^{13}$C NMR ($CDCl_3$, 151 MHz) results show: δ=159.4, 147.1, 144.2, 141.5, 137.8, 130.2, 127.2, 116.2, 110.8, 38.5, 21.1; The HRMS (TOF Cl+) m/z results show: $[M+H]^+$ Calcd. for $C_{13}H_{14}NO_2$ 216.1025 and found: 216.1017.

Figure 18P:
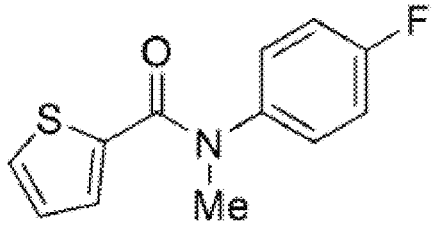
Figure 18Q:
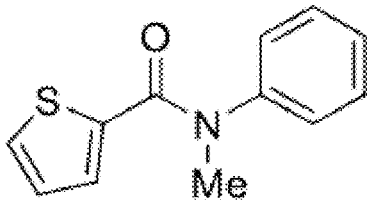

FIGS. 18O-18Q show the general procedure for the synthesis of thiophene amides and structures. In FIG. 18O, a 25 mL oven dried Schlenk flask was charged with 2-thiophenecarbonyl chloride 36A (400 mg, 3.06 mmol, 1 equiv) and methylene chloride (9 mL) under argon. Triethylamine (0.85 mL, 6.12 mmol, 2 equiv) was added in one portion to the solution. 4-Fluoro-N-methylaniline 36B (0.44 mL, 3.68 mmol, 1.2 equiv) was added dropwise to the solution. The reaction mixture was diluted with water and extracted with ethyl acetate (3×50 mL). The combined organic extract was dried over $Na_2SO_4$ and concentrated in vacuo. The crude residue was purified via gradient flash chromatography (0:100 to 50:50 EtOAc/Hexane) to give the coupling amide product 36 (465.4 mg, 2.14 mmol, 70%) as a white amorphous solid.

In FIG. 18P, Coupling amide product 36, the $^1$H NMR ($CDCl_3$, 600 MHz) results show: δ=7.30 (dd, J=4.5, 1.7 Hz, 1H), 7.24-7.19 (m, 2H), 7.11-7.06 (m, 2H), 6.82-6.79 (m, 2H), 3.41 (s, 3H); The $^{13}$C NMR ($CDCl_3$, 151 MHz) results show: δ=162.8 (d, J=23.9 Hz), 161.2, 140.3 (d, J=3.3 Hz), 137.7, 132.3, 130.6, 129.8 (d, J=8.6 Hz), 126.6, 116.7 (d, J=22.6 Hz), 39.1; The $^{19}$F NMR ($CDCl_3$, 376 MHz) results show: δ=−112.7; The HRMS (TOF Cl+) m/z results show: $[M+H]^+$ Calcd. for $C_{12}H_{11}FNOS$ 236.0545 and found: 236.0541.

In FIG. 18Q, coupling amide product 37 was synthesized from N-methylanline (0.40 ml, 3.68 mmol) using the same procedure to synthesize compound 36. The crude residue was purified via gradient flash chromatography (0:100 to 50:50 EtOAc/Hexane) to give the coupling amide product 37. The Isolated Yield was measured at 59.3% (410.8 mg, 1.89 mmol) as an off white amorphous solid. The $^1$H and the $^{13}$C NMR spectras of 37 matched with the literature report (O'Brien, et al., *Angew. Chem., Int. Ed.* 2014, 53 (44), 11868-11871); The $^1$H NMR ($CDCl_3$, 600 MHz): 5=7.43-7.35 (m, 3H), 7.29 (dd, J=5.0, 1.2 Hz, 1H), 7.26-7.23 (m, 2H), 6.78 (dd, J=5.0, 3.8 Hz, 1H), 6.73 (dd, J=3.9, 1.2 Hz, 1H), 3.45 (s, 3H); The $^{13}$C NMR ($CDCl_3$, 151 MHz): δ=162.7, 144.3, 138.2, 132.0, 130.4, 129.7, 128.1, 128.0, 126.6, 39.0.

Figure 18R:
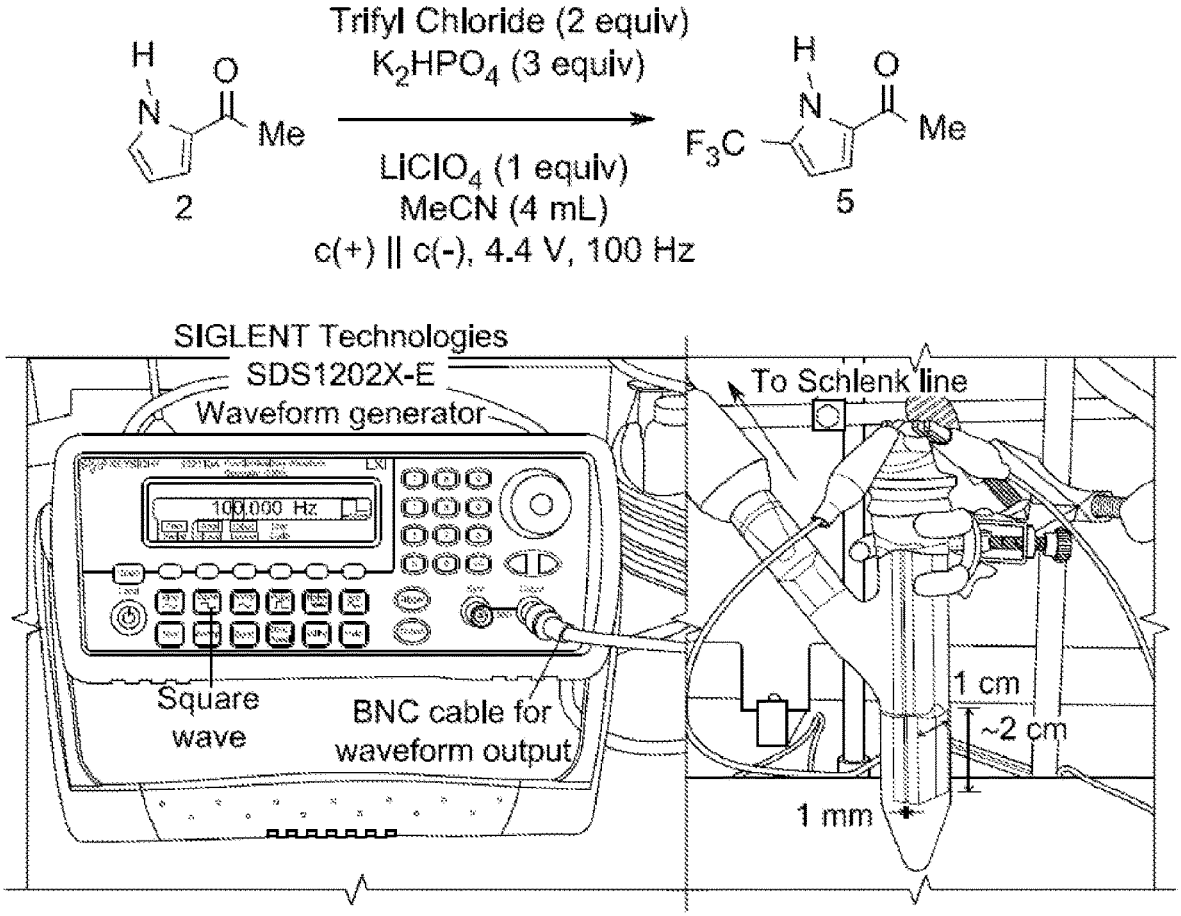

FIGS. 18R-18KK show the general procedure for trifluoromethylation, instrumental setup, and structures. In FIG. 18R, to an oven-dried 10-mL conical Schlenk flask was charged with a triangular magnetic stir bar, $LiClO_4$ (53 mg, 0.5 mmol, 1.0 equiv), and $K_2HPO_4$ (269 mg, 1.5 mmol, 3.0 equiv) under argon. In a separate vial, the 2-acetyl pyrrole 2 (55 mg, 0.5 mmol, 1.0 equiv) was dissolved in anhydrous acetonitrile (4 mL) under argon. After the conical Schlenk flask was evacuated and refilled with argon (3×), the pyrrole solution was then added to the flask under the argon. The reaction mixture was subjected to the freeze-pump-thaw process three times. After the freeze-pump-thaw process was completed, trifluoromethanesulfonyl chloride (106 μL, 1 mmol, 2 equiv) was added to the reaction mixture. Two carbon plate electrodes (3 mm in thickness, 1 cm in width, and 10 cm in length) were then inserted into the reaction flask with an electrode-electrode separation of 1 mm and were connected to a waveform generator (see FIG. 18R). The carbon electrodes were partially immersed (2 cm) in the solution. The output voltage was set to 4.4 V, and the reaction mixture was allowed to stir at room temperature while the current was passing through the reaction medium. After the reaction mixture had been stirring for 24 h, the electrodes were removed and the internal standard hexafluorobenzene (30 μL, 0.25 mmol, 0.5 equiv) was added to the reaction mixture and stirred for 2 min. An aliquot of the crude mixture was removed and used for crude conversion analysis. The conversion of pyrrole 2 to trifluoromethylated pyrrole 5 was determined using $^{19}F$ NMR. After the crude mixture was analyzed using $^{19}F$ NMR, it was diluted with deionized water (5 mL) and extracted with dichloromethane (3×15 mL). The combined organic extract was washed with saturated aqueous NaCl, dried over $Na_2SO_4$, and concentrated in vacuo at 80 mbar. The crude residue was purified by gradient flash chromatography (95:5 to 90:10, petroleum ether/ethyl acetate) to yield 5 (74.3 mg, 0.42 mmol, 84%) as a white amorphous solid.

Electrochemical trifluoromethylation of 2 was also carried out at the 1 mmol scale using the same reaction and purification conditions as described above. The only difference is that 1 mmol of 2 and 2 mmol of trifluoromethanesulfonyl chloride was used in the synthesis. The isolated yield of 5 was 64% (113 mg, 0.64 mmol).

Figure 18S:
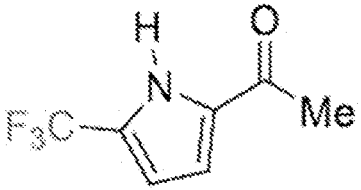

In FIG. 18S, Trifluoromethylated pyrrole 5, the $^1H$ and the $^{19}F$ NMR spectra of 5 matched with the literature report (O'Brien, et al., *Angew. Chem., Int. Ed.* 2014, 53 (44), 11868-11871). The voltage was measured at 4.4 V. The $^1H$ NMR ($CDCl_3$, 600 MHz) results show: δ=9.42 (bs, 1H), 6.86 (d, J=3.9 Hz, 1H), 6.61 (d, J=3.2 Hz, 1H), 2.48 (s, 3H); The $^{19}F$ NMR (CDCl3, 376 MHz) results show: δ=−60.8.

Figure 18T:
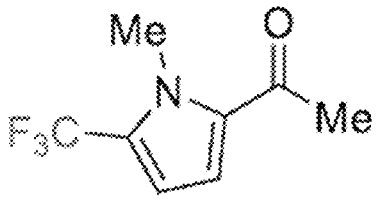

In FIG. 18T, Compound 7, the 1H and the $^{19}F$ NMR spectra of 7 matched with the literature report (Natte, et al., *Angew. Chem., Int. Ed.* 2016, 55, 2782-2786). Compound 7 was synthesized from 1-(1-methyl-1H-pyrrol-2-yl)ethan-1-one (61.1 mg, 0.5 mmol) using the same procedure to synthesize compound 5. The crude residue was purified by gradient flash chromatography (95:5 to 90:10, petroleum ether/ethyl acetate) to yield compound 7. The voltage was measured at 4.0 V. The Isolated Yield was measured at 43% (41.1 mg, 0.22 mmol) as a white amorphous solid. The $^1H$ NMR ($CDCl_3$, 400 MHz) results show: δ=6.89 (d, J=4.3 Hz, 1H), 6.55 (d, J=4.2 Hz, 1H), 4.02 (s, 3H), 2.48 (s, 3H); The $^{19}F$ NMR ($CDCl_3$, 376 MHz) results show: δ=−60.5.

Figure 18U:
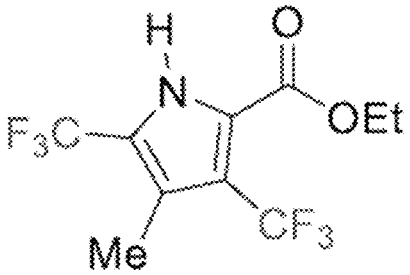

In FIG. 18U, Compound 8 was synthesized from ethyl 4-methyl-1H-pyrrole-2-carboxylate (76.8 mg, 0.5 mmol) using the same procedure to synthesize compound 5. The crude residue was purified by gradient flash chromatography (95:5 to 90:10, petroleum ether/ethyl acetate) to yield compound 8. The voltage was measured at 4.8 V. The Isolated Yield was measured at 42% (60.7 mg, 0.21 mmol) as a white amorphous solid. The $^1H$ NMR ($CDCl_3$, 400 MHz) results show: δ=9.02 (bs, 1H), 4.34 (q, J=7.2 Hz, 2H), 2.40 (q, J=1.5 Hz, 3H), 1.36 (t, J=7.1 Hz, 3H); The $^{13}C$ NMR ($CDCl_3$, 151 MHz) results show: δ=162.5, 125.5 (q, J=2.5 Hz), 124.6, 124.3, 124.0, 123.7, 123.6, 123.2, 121.9, 121.0, 119.2, 118.9, 118.5, 118.3, 118.1, 116.6, 116.4-116.3 (m), 115.7, 60.9, 13.8, 9.9; The $^{19}F$ NMR ($CDCl_3$, 376 MHz) results show: δ=−59.2, −59.8; The HRMS (TOF Cl+) m/z results show: $[M+H]^+$ Calcd. for $C_{10}H_{10}F_6NO_2$ 290.0616 and found: 290.0612.

Figure 18V:
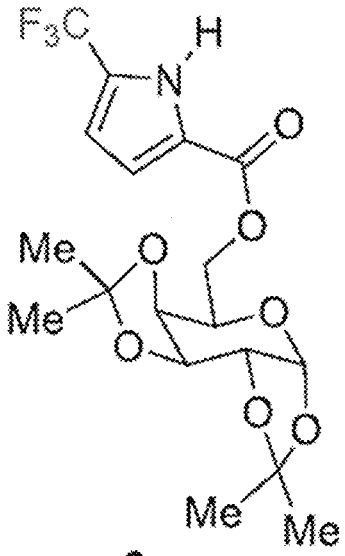

In FIG. 18V, Compound 9 was synthesized from compound 31 (176.7 mg, 0.5 mmol) using the same procedure to synthesize compound 5. The crude residue was purified by gradient flash chromatography (95:5 to 90:10, petroleum ether/ethyl acetate) to yield compound 9. The voltage was measured at 3.3 V. The Isolated Yield was measured at 53% (116.7 mg, 0.27 mmol) as a white amorphous solid. The $^1H$ NMR ($CDCl_3$, 400 MHz) results show: δ=9.47 (s, 1H), 6.93 (s, 1H), 6.59 (s, 1H), 5.56 (d, J=5.0 Hz, 1H), 4.65 (dd, J=7.9, 2.5 Hz, 1H), 4.52 (dd, J=11.5, 4.6 Hz, 2H), 4.30 (dd, J=7.8, 1.9 Hz, 2H), 4.18-4.11 (m, 1H), 1.51 (s, 3H), 1.47 (s, 3H), 1.35 (s, 3H), 1.34 (s, 3H); The $^{13}C$ NMR ($CDCl_3$, 151 MHz) results show: δ=160.4, 124.8, 124.7 (q, J=40.0 Hz), 120.4 (q, J=267.5 Hz), 115.5, 110.9, 109.8, 108.9, 96.3, 71.0, 70.7, 70.4, 66.1, 64.0, 25.9, 24.9, 24.5; The $^{19}F$ NMR ($CDCl_3$, 376 MHz) results show: δ=−60.5. The HRMS (TOF Cl+) m/z results show: $[M+H]^+$ Calcd. for $C_{18}H_{23}F_3NO_7$ (M+H)+ 422.1427 and found: 422.1414.

Figure 18W:
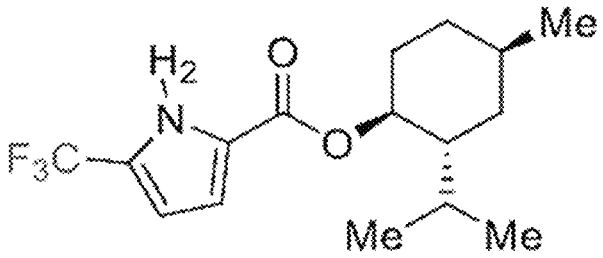

In FIG. 18W, Compound 10 was synthesized from compound 30 (124.6 mg, 0.5 mmol) using the same procedure to synthesize compound 5. The crude residue was purified by gradient flash chromatography (95:5 to 90:10, petroleum ether/ethyl acetate) to yield compound 10. The voltage was measured at 3.0 V. The Isolated Yield was measured at 61% (96.7 mg, 0.31 mmol) as a white amorphous solid. The $^1H$ NMR ($CDCl_3$, 400 MHz) results show: =9.55 (s, 1H), 6.86 (q, J=1.8, 1.3 Hz, 1H), 6.63-6.56 (m, 1H), 4.91 (td, J=10.9, 4.4 Hz, 1H), 2.13-2.01 (m, 1H), 1.91 (td, J=7.0, 2.7 Hz, 1H), 1.73 (dt, J=11.5, 2.9 Hz, 2H), 1.62-1.44 (m, 3H), 1.19-1.03 (m, 2H), 0.92 (t, J=6.9 Hz, 6H), 0.79 (d, J=6.9 Hz, 3H); The $^{13}C$ NMR ($CDCl_3$, 151 MHz) results show: δ=161.2, 126.2, 124.4 (d, J=40 Hz), 121 (q, J=268 Hz), 114.6, 110.8 (q, J=3 Hz), 75.4, 47.1, 40.9, 34.2, 31.4, 26.5, 23.7, 22.0, 20.6, 16.5; The $^{19}F$ NMR ($CDCl_3$, 376 MHz) results show: δ=−62.9. The HRMS (TOF Cl+) m/z results show: $[M+H]^+$ Calcd. for $C_{16}H_{23}F_3NO_2$ (M+H)+318.1681 and found: 318.1675.

Figure 18Y:
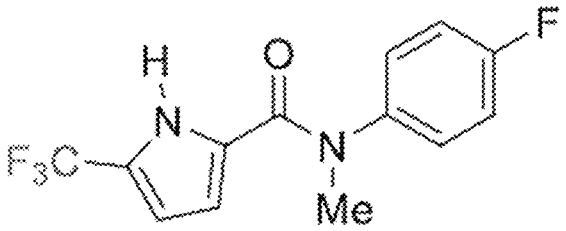

In FIG. 18Y, Compound 11 was synthesized from compound 28 (109.2 mg, 0.5 mmol) using the same procedure to synthesize compound 5. The crude residue was purified by gradient flash chromatography (95:5 to 80:20, petroleum ether/ethyl acetate) to yield compound 11. The voltage was measured at 3.0 V. The Isolated Yield was measured at 56% (60.7 mg, 0.21 mmol) as a white amorphous solid. The $^1H$ NMR ($CDCl_3$, 600 MHz) results show: δ=11.32 (bs, 1H), 7.26 (ddd, J=8.8, 4.8, 1.5 Hz, 2H), 7.15 (td, J=8.4, 1.4 Hz, 2H), 6.23 (s, 1H), 4.90 (s, 1H), 3.43 (s, 3H); The $^{13}C$ NMR ($CDCl_3$, 151 MHz) results show: δ=162.3 (d, J=249.2 Hz), 160.9, 139.8 (d, J=3.2 Hz), 129.7 (d, J=8.7 Hz), 127.4, 123.0 (q, J=39.8 Hz), 121.6, 119.8, 117.0, 116.9, 113.4, 110.1 (q, J=2.9 Hz), 38.8; The $^{19}F$ NMR ($CDCl_3$, 376 MHz): δ=−62.7, −114.6; The HRMS (TOF Cl+) m/z results show: $[M+H]^+$ Calcd. for $C_{13}H_{11}F_4N_2O$, 287.0808 and found: 287.0802.

Figure 18X:
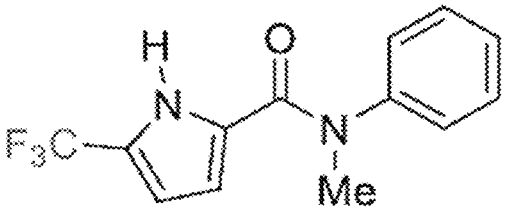

In FIG. 18X, Compound 12 was synthesized from compound 29 (100.2 mg, 0.5 mmol) using the same procedure to synthesize compound 5. The crude residue was purified by gradient flash chromatography (95:5 to 80:20, petroleum ether/ethyl acetate) to yield compound 12. The voltage was measured at 3.0 V. The Isolated Yield was measured at 44% (29.5 mg, 0.11 mmol) as a white amorphous solid. The $^{1}H$ NMR ($CDCl_3$, 400 MHz) results show: δ=10.10 (bs, 1H), 7.51-7.41 (m, 3H), 7.28 (dd, J=7.5, 2.1 Hz, 2H), 6.21 (t, J=2.9 Hz, 1H), 4.83 (d, J=3.9 Hz, 1H), 3.44 (s, 3H); The $^{13}C$ NMR ($CDCl_3$, 151 MHz) results show: δ=158.2, 149.2, 143.4, 142.5 (q, J=43.1 Hz), 129.6, 128.1, 127.1, 116.0, 112.0 (q, J=2.8 Hz), 38.5; The $^{19}F$ NMR ($CDCl_3$, 376 MHz) results show: δ=−60.2; The HRMS (TOF Cl+) m/z results show: $[M+H]^+$ Calcd. for $C_{13}H_{12}F_3N_2O$, 269.0896 and found: 269.0897.

Figure 18Z:
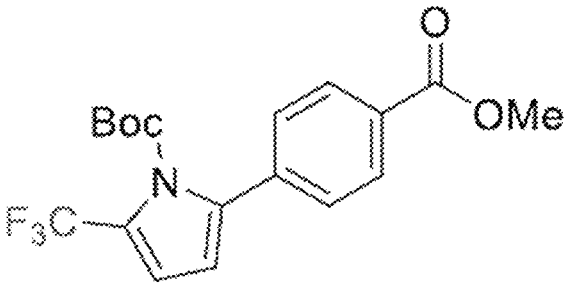
Figure 18A:
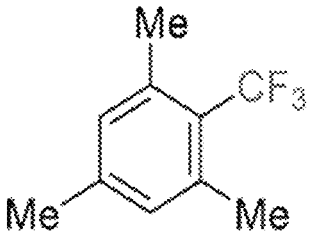
Figure 18B:
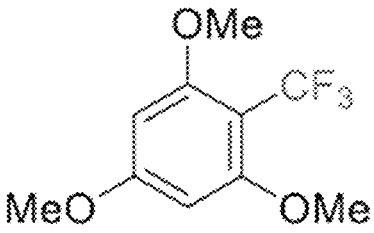
Figure 18C:
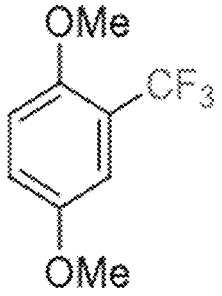
Figure 18D:
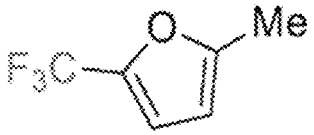
Figure 18E:
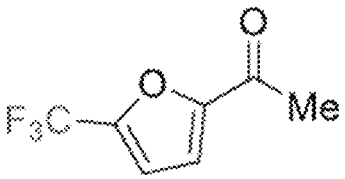
Figure 18F:
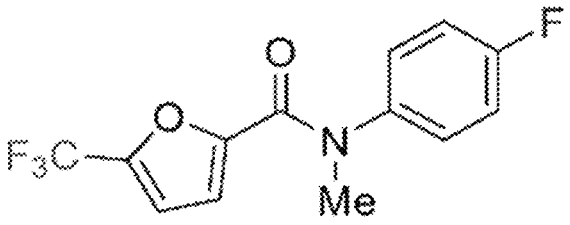
Figure 18G:
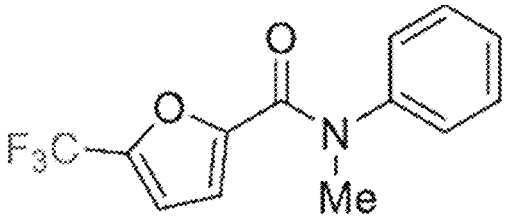
Figure 18H:
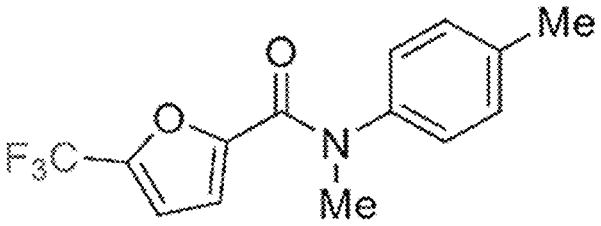
Figure 18I:
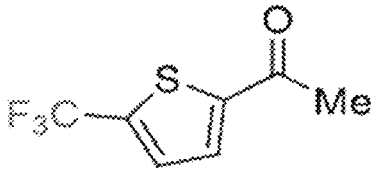
Figure 18J:
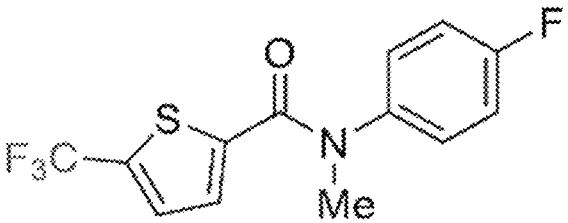
Figure 18K:
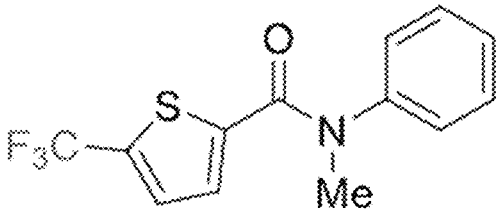
Figure 18L:
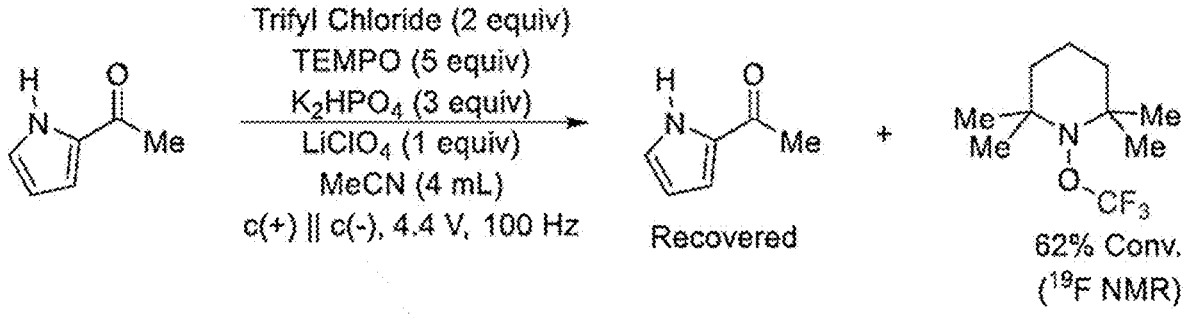
Figure 18M:
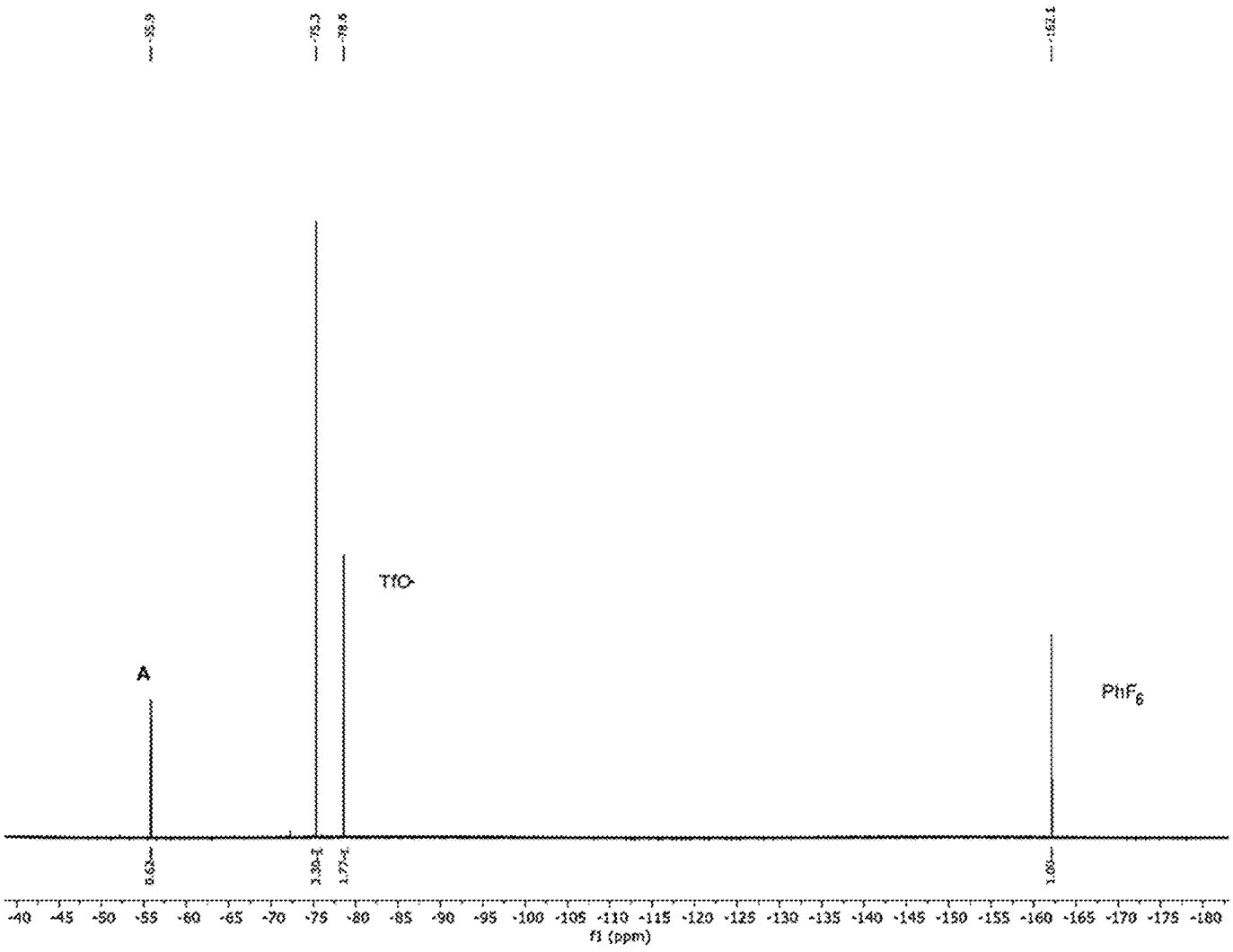

In FIG. 18Z, Compound 13 was synthesized from compound 32 (100.2 mg, 0.5 mmol) using the same procedure to synthesize compound 5. The crude residue was purified by gradient flash chromatography (95:5 to 90:10, petroleum ether/ethyl acetate) to yield compound 13. The voltage was measured at 2.8 V. The Isolated Yield was measured at 61% (112.6 mg, 0.31 mmol) as a yellow oil. The $^{1}H$ NMR ($CDCl_3$, 400 MHz) results show: =8.06 (d, J=8.3 Hz, 2H), 7.41 (d, J=8.2 Hz, 2H), 6.74 (d, J=3.7 Hz, 1H), 6.25 (d, J=3.6 Hz, 1H), 3.94 (s, 3H), 1.39 (s, 9H); The $^{13}C$ NMR ($CDCl_3$, 151 MHz) results show: 166.7, 147.8, 137.5, 129.4, 128.4, 123.8 (q, J=45.3 Hz), 120.5 (q, J=271.8 Hz), 115.8-115.2 (m), 112.1, 86.1, 52.2, 27.2; The $^{19}F$ NMR ($CDCl_3$, 376 MHz) results show: δ=−57.9; The HRMS (TOF Cl+) m/z: $[M+H]^+$ Calcd. for $C_{18}H_{19}F_3NO_4$ 370.1261 and found: 370.1273.

In FIG. 18AA, Compound 14 was synthesized from mesitylene (60.2 mg, 0.5 mmol) using the same procedure to synthesize compound 5. Since compound 14 is too volatile, only the $^{19}F$ crude conversion was reported. The $^{1}H$ and the $^{19}F$ NMR spectra of 14 matched with the literature report (Nagib, et al., *Nature* 2011, 480, 224). The voltage was measured at 3.6 V. The $^{19}F$ Crude Conversion was measured at 64%. The crude H NMR ($CDCl_3$, 400 MHz) results show: δ=δ 6.79 (s, 2H), 2.36 (dd, J=12.0, 2.5 Hz, 3H), 2.29 (d, J=3.6 Hz, 6H). The crude $^{19}F$ NMR ($CDCl_3$, 376 MHz) results show: δ=−54.3, −75.9 (trifluoromethanesulfonyl chloride), and −163 (hexafluorobenzene).

In FIG. 18BB, Compound 15 was synthesized from 1,3,5-trimethoxy benzene (84.2 mg, 0.5 mmol) using the same procedure to synthesize compound 5. The crude residue was purified by gradient flash chromatography (95:5, petroleum ether/ethyl acetate) to yield compound 15. The $^{1}H$ and the $^{19}F$ NMR spectra of 15 matched with the literature report (Jud, W et al., *Org. Lett.* 2019, 21, 7970-7975). The voltage was measured at 4.8 V. The Isolated Yield was measured at 42% (49.6 mg, 0.21 mmol) as a white amorphous solid. The $^{1}H$ NMR ($CDCl_3$, 400 MHz) results show: δ=6.09 (s, 2H), 3.77 (s, 9H); The $^{19}F$ NMR ($CDCl_3$, 376 MHz) results show: δ=−54.2.

In FIG. 18CC, Compound 16 was synthesized from compound 1,4-dimethoxy benzene (84.2 mg, 0.5 mmol) using the same procedure to synthesize compound 5. The crude residue was purified by gradient flash chromatography (95:5, petroleum ether/ethyl acetate) to yield compound 16. The $^{1}H$ and the $^{19}F$ NMR spectra of 16 matched with the literature report (Jud, W et al., *Org. Lett.* 2019, 21, 7970-7975). The voltage was measured at 3.0 V. The Isolated Yield was measured at 25% (25.6 mg, 0.13 mmol) as a white amorphous solid. The $^{1}H$ NMR ($CDCl_3$, 400 MHz) results show: =7.12 (d, J=3.1 Hz, 1H), 7.02 (dd, J=9.0, 3.1 Hz, 1H), 6.94 (d, J=9.0 Hz, 1H), 3.86 (s, 3H), 3.80 (s, 3H); The $^{19}F$ NMR ($CDCl_3$, 376 MHz) results show: δ=−62.4

In FIG. 18DD, Compound 17 was synthesized from compound 2-methylfuran (41.1 mg, 0.5 mmol) using the same procedure to synthesize compound 5. Since compound 17 is too volatile, only $^{19}F$ crude conversion was reported. The $^{1}H$ and the $^{19}F$ NMR spectra of 17 matched with the literature report (Nagib, et al., *Nature* 2011, 480, 224). The voltage was measured at 2.8 V. The $^{19}F$ Crude Conversion was measured at 43%. The $^{1}H$ NMR ($CDCl_3$, 400 MHz) results show: δ=δ 6.58 (d, J=2.3 Hz, 1H), 5.96 (d, J=3.2 Hz, 1H), 2.22 (s, 3H); The $^{19}F$ NMR ($CDCl_3$, 376 MHz) results show: δ=−64.5, −75.9 (trifluoromethanesulfonyl chloride), and −163 (hexafluorobenzene).

In FIG. 18EE, Compound 18 was synthesized from 1-(furan-2-yl)ethan-1-one (55.1 mg, 0.5 mmol) using the same procedure to synthesize compound 5. Since compound 18 is too volatile, only the $^{19}F$ crude conversion was reported. The $^{1}H$ and the $^{19}F$ NMR spectra of 18 matched with the literature report (Yin, et al., *Chemrxiv.* 2020, DOI: 10.26434/Chemrxiv.11973648.V1). The voltage was measured at 2.8 V. The $^{19}F$ Crude Conversion was measured at 32%. The $^{1}H$ NMR ($CDCl_3$, 400 MHz) results show: δ=7.08 (t, J=5.1 Hz, 1H), 6.87-6.80 (m, 1H), 2.39 (s, 3H); The $^{19}F$ NMR ($CDCl_3$, 376 MHz) results show: δ=−65.2, −75.9 (trifluoromethanesulfonyl chloride), and −163 (hexafluorobenzene).

In FIG. 18FF, Compound 19 was synthesized from N-(4-fluorophenyl)-N-methylfuran-2-carboxamide (109.6 mg, 0.5 mmol) using the same procedure to synthesize compound 5. The crude residue was purified by gradient flash chromatography (95:5 to 80:20, petroleum ether/ethyl acetate) to yield compound 19. The voltage was measured at 3.3 V. The Isolated Yield was measured at 28% (40.2 mg, 0.14 mmol) as a white amorphous solid. The H NMR ($CDCl_3$, 600 MHz) results show: δ=7.18-7.15 (m, 2H), 7.09-7.06 (m, 2H), 6.62 (s, 1H), 6.38 (s, 1H), 3.41 (s, 3H); The $^{13}C$ NMR ($CDCl_3$, 151 MHz) results show: δ=162.0 (d, J=248.7 Hz), 149.1, 139.4 (d, J=3.3 Hz), 128.8 (d, J=8.8 Hz), 119.1, 117.3, 116.6, 116.4, 116.3, 112.0 (q, J=2.8 Hz), 38.6. The $^{19}F$ NMR ($CDCl_3$, 376 MHz) results show: δ=−63.5, −115.5; The HRMS (TOF Cl+) m/z results show: $[M+H]^+$ Calcd. for $C_{13}H_{10}F_4NO_2$ 288.0648 and found: 288.0644.

In FIG. 18GG, Compound 20 was synthesized from N-methyl-N-phenylfuran-2-carboxamide (100.6 mg, 0.5 mmol) using the same procedure to synthesize compound 5. The crude residue was purified by gradient flash chromatography (95:5 to 80:20, petroleum ether/ethyl acetate) to yield compound 20. The Voltage was measured at 3.0 V. The Isolated Yield was measured at 43% (57.8 mg, 0.22 mmol) as a white amorphous solid. The $^{1}H$ NMR ($CDCl_3$, 400 MHz) results show: =7.42-7.36 (m, 3H), 7.23-7.16 (m, 2H), 6.59 (d, J=3.1 Hz, 1H), 6.22 (s, 1H), 3.45 (s, 3H); The $^{13}C$ NMR ($CDCl_3$, 151 MHz) results show: δ=158.2, 149.1, 143.4, 142.5 (q, J=43.2 Hz), 129.6, 128.1, 127.1, 118.3 (q, J=268.0 Hz), 115.6, 112.0 (q, J=2.8 Hz), 38.5; The $^{19}F$ NMR ($CDCl_3$, 376 MHz) results show: δ=−64.7. The HRMS (TOF Cl+) m/z: $[M+H]^+$ Calcd. for $C_{13}H_{11}F_3NO_2$ 270.0742 and found: 270.0737.

In FIG. 18HH, Compound 21 was synthesized from N-methyl-N-(p-tolyl)furan-2-carboxamide (107.6 mg, 0.5 mmol) using the same procedure to synthesize compound 5. The crude residue was purified by gradient flash chromatography (95:5 to 80:20, petroleum ether/ethyl acetate) to yield compound 21. The voltage was measured at 3.0 V. The Isolated Yield was measured at 44% (62.3 mg, 0.22 mmol) as a white amorphous solid. The $^{1}H$ NMR ($CDCl_3$, 600 MHz) results show: δ=7.19 (d, J=7.8 Hz, 2H), 7.06 (d, J=7.9

Hz, 2H), 6.57 (s, 1H), 6.06 (s, 1H), 3.41 (s, 3H), 2.37 (s, 3H); The $^{13}C$ NMR ($CDCl_3$, 151 MHz) results show: δ=158.2, 149.1, 142.5 (q, J=42.9 Hz), 140.8, 138.2, 130.2, 126.9, 118.3 (q, J=268.8 Hz), 115.9, 112.0 (q, J=2.8 Hz), 38.5, 21.0; The $^{19}F$ NMR ($CDCl_3$, 376 MHz) results show: δ=−64.6; The HRMS (TOF Cl+) m/z: $[M+H]^+$ Calcd. for $C_{14}H_{13}F_3NO_2$ 284.2582 and found: 284.0891.

In FIG. 18II, Compound 22 was synthesized from 1-(thiophen-2-yl)ethan-1-one (63.1 mg, 0.5 mmol) using the same procedure to synthesize compound 5. Since compound 22 is too volatile, only $^{19}F$ crude conversion was reported. The $^{1}H$ and the $^{19}F$ NMR spectra of 22 matched with the literature report (Nagib, et al., *Nature* 2011, 480, 224). The voltage was measured at 2.8 V. The $^{19}F$ Crude Conversion was measured at 28%. The $^{1}H$ NMR ($CDCl_3$, 400 MHz) results show: δ=7.54 (d, J=3.9 Hz, 1H), 7.37 (d, J=3.9 Hz, 1H), 2.47 (s, 3H). The $^{19}F$ NMR ($CDCl_3$, 376 MHz) results show: δ=−57.0, −75.9 (trifluoromethanesulfonyl chloride), and −163 (hexafluorobenzene).

In FIG. 18JJ, Compound 23 was synthesized from N-(4-fluorophenyl)-N-methylthiophene-2-carboxamide (117.6 mg, 0.5 mmol) using the same procedure to synthesize compound 5. The crude residue was purified by gradient flash chromatography (95:5 to 80:20, petroleum ether/ethyl acetate) to yield compound 23. The voltage was measured at 3.3 V. The Isolated Yield was measured at 28% (42.5 mg, 0.14 mmol) as a white amorphous solid. The $^{1}H$ NMR ($CDCl_3$, 400 MHz) results show: δ=7.25-7.20 (m, 2H), 7.15 (d, J=2.1 Hz, 1H), 7.12 (d, J=8.5 Hz, 2H), 6.67 (d, J=2.7 Hz, 1H), 3.43 (s, 3H); The $^{13}C$ NMR ($CDCl_3$, 126 MHz) results show: δ=163.3, 161.4 (d, J=8.7 Hz), 141.3, 139.5 (d, J=3.2 Hz), 135.4 (q, J=38.3 Hz), 131.2, 129.8 (d, J=8.7 Hz), 127.7, 121.9 (q, J=269.5 Hz), 117.0, 39.3; The $^{19}F$ NMR ($CDCl_3$, 376 MHz) results show: δ=−56.0, −111.5; The HRMS (TOF Cl+) m/z results show: $[M+H]^+$ Calcd. for $C_{13}H_{10}F_4NOS$ 304.0419 and found: 304.0408.

In FIG. 18KK, Compound 24 was synthesized from N-methyl-N-phenylthiophene-2-carboxamide (108.6 mg, 0.5 mmol) using the same procedure to synthesize compound 5. The crude residue was purified by gradient flash chromatography (95:5 to 80:20, petroleum ether/ethyl acetate) to yield compound 24. The voltage was measured at 3.0 V. The Isolated Yield was measured at 28% (39.9 mg, 0.14 mmol) as a white amorphous solid. The $^{1}H$ NMR ($CDCl_3$, 400 MHz) results show: =7.44 (d, J=6.8 Hz, 3H), 7.25 (d, J=7.7 Hz, 2H), 7.08 (d, J=4.1 Hz, 1H), 6.56 (d, J=4.3 Hz, 1H), 3.46 (s, 3H); The $^{13}C$ NMR ($CDCl_3$, 151 MHz) results show: δ=161.4, 143.5, 141.8, 135.1 (q, J=38.2 Hz), 131.0, 130.1, 128.7, 127.9, 127.7 (q, J=3.7 Hz), 122.8, 39.1; The $^{19}F$ NMR ($CDCl_3$, 376 MHz) results show: =−56.0. HRMS (TOF Cl+) m/z: $[M+H]^+$ Calcd. for $C_{13}H_{11}F_3NOS$ 286.0508 and found: 286.0510.

In FIG. 18LL, TEMPO trapping was used as the control experiment. Following the standard procedure for trifluoromethylation, TEMPO radical (5 equiv) was added to the reaction mixture. After 24 hours, the internal standard, trifluorobenzene (30 μL) was added to the crude reaction and $^{19}F$ was taken. 62% of the TEMPO-CF3 adduct was observed based on the $^{19}F$ NMR conversion (Peak A in FIG. 18MM) (Wei, et al., *Adv. Synth. Catal.* 2019, 361, 5490-5498; Wang, et al., *Org. Lett.* 2015, 17, 5698-5701). The addition of the radical scavenger showed that the reaction was inhibited completely. There was no product observed, and the 2-acetyl pyrrole was recovered.

FIG. 18MM show the $^{19}F$ NMR spectrum of the mixture after the TEMPO trapping experiment. Peak A at 55.9 ppm corresponds to the TEMPO-CF3 adduct.

FIGS. 19A-21K illustrate the selective heterodifunctionalization of alkenes using ACE. Alkenes contain at least one carbon-carbon double bond or the unsaturated hydrocarbon compound of a carbon double bond. Examples of alkenes include ethylene, propylene, butadiene, 1-butylene, isobutene, isoprene, and cyclopentadiene.

Figure 19A:
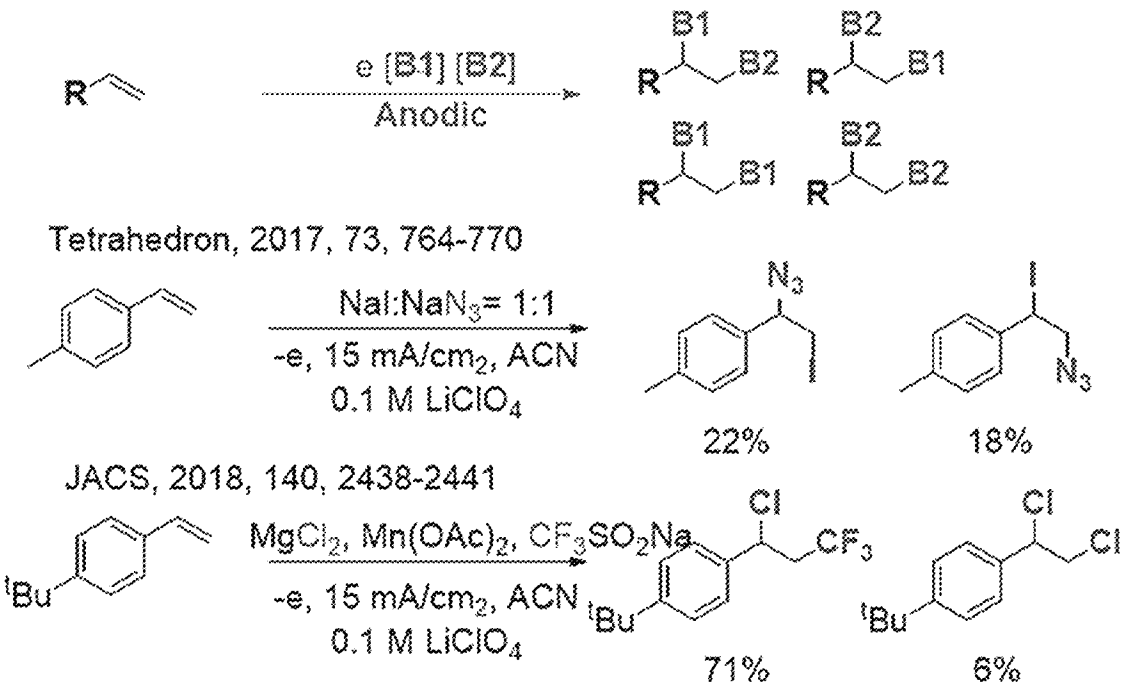
FIGS. 19A-19D. (19A) Anodic heterodifunctionalization. Existing strategy for anodic difunctionalization of alkenes. (19B) Proposed ACE heterodifunctionalization of alkenes. [A]: $CF_3^-$, $CF_2H^-$, $R^-$, $H^-$, $HCO_2^-$, $X^-$ (X=Cl, Br, $SCF_3$); [B]: $X^-$ (X=Cl, Br, I, F, $N_3^-$, $CN^-$), $RO^-$, $RS^-$, $RNH^-$, $RSO_2^-$, $CF_3^-$, $R^-$, $H^-$. (12C) Selective chlorotrifluoromethylation of alkenes using ACE. (12D) Selective bromotrifluoromethylation of alkenes using ACE.

Carbon-carbon double bonds are prevalent in biologically active compounds and synthetic intermediates. Heterodifunctionalization of alkenes has attracted significant attention from synthetic chemists because it has the advantage of introducing two functional groups into vicinal carbons of common alkene moieties in a single operation. The existing strategies for electrochemical heterodifunctionalization of alkenes are mostly based on the electrochemical oxidation of two different reagents to generate two different reactive species. (Martins, et al., *ChemElectroChem* 2019, 6 (5), 1300-1315; Sauer, et al., *ACS Catal.* 2018, 5175-5187; Siu, et al., *Acc. Chem. Res.* 2020, 53 (3), 547-560) Because they are simultaneously electrogenerated, the heterodifunctionalization reaction can easily lose control over the regioselectivity, leading to a complex mixture of difunctionalized products that reflect the statistics of the addition reaction kinetics (FIG. 19A). For example, Zeng et al. (Yan, et al., *Tetrahedron* 2017, 73 (6), 764-770) obtained a 1:1 ratio of Markovnikov and anti-Markovnikov regioisomers when they performed anodic azidoiodination of p-methyl styrene using NaI and $NaN_3$ in acetonitrile. The currently utilized solution to this regioselectivity problem is to control the reaction kinetics of the two different reactive species by chemical means. For example, to achieve regioselective chlorotrifluoromethylation of alkenes, Lin et al. (Ye, et al., *J. Am. Chem. Soc.* 2018, 140 (7), 2438-2441) used a Mn catalyst to stabilize the Cl radical species so that the first step is dominated by the addition of the transient $CF_3$ radical to the alkene substrate (FIG. 19A). This strategy relies on the discovery of suitable catalysts that can selectively stabilize only one of the two reactive species and mediate atom transfer, which remains a challenge.

Figure 19B:
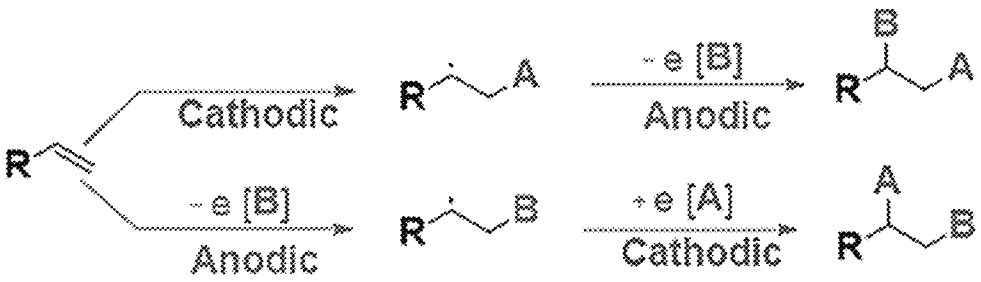
Figure 19C:
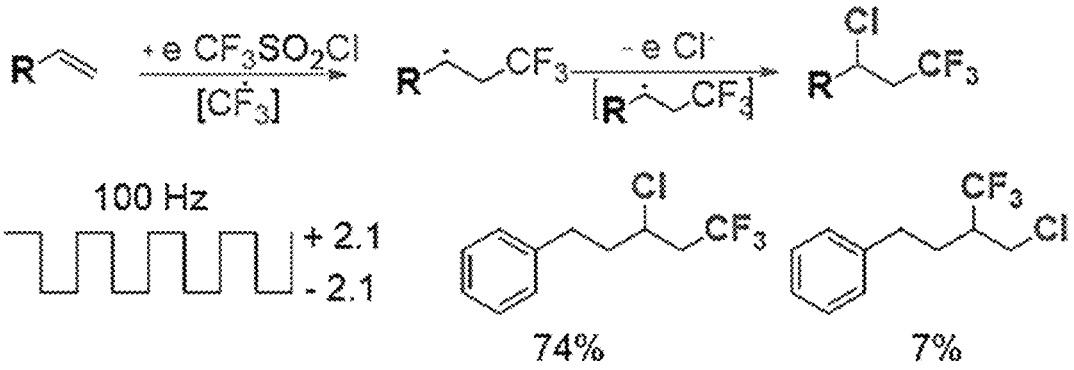

Instead of performing the two functionalization steps under the same anodic condition, the ACE method performs one at a time using two different electrode potentials. More specifically, one reactive species is generated during the AC waveform's cathodic pulse, and the other during the anodic pulse. In this way, two functionalization steps were temporally separated, enabling the selective heterodifunctionalization of alkenes (FIG. 19B). FIG. 19B indicates a list of common functional groups that can be added to alkenes under cathodic or anodic condition, as follows: [A]: $CF_3^-$, $CF_2H^-$, $R^-$, $H^-$, $HCO_2^-$, $X^-$ (X=Cl, Br, $SCF_3$); [B]: $X^-$ (X=Cl, Br, I, F, $N_3^-$, $CN^-$), $RO^-$, $RS^-$, $RNH^-$, $RSO_2^-$, $CF_3^-$, $R^-$, $H^-$ (Martins, et al., *ChemElectroChem* 2019, 6 (5), 1300-1315; Tang, et al., *Chem. Soc. Rev.* 2015, 44 (5), 1070-1082; Koike, et al., *Chem* 2018, 4 (3), 409-437). For example, the addition of the $CF_3$ group to alkenes can be accomplished by reducing $CF_3SO_2Cl$ and Togni reagent or by oxidizing $NaSO_2CF_3$ to $CF_3$ radicals, which undergo a radical addition pathway. Halogen can be added to an alkene by oxidizing the halide ions to their radical forms or by trapping electrogenerated carbocations.

The feasibility of this approach was tested using chlorotrifluoromethylation of alkene as a model reaction. A 100 Hz square waveform was applied to sequentially reduce $CF_3SO_2Cl$ to $CF_3$ radicals and oxidize the α-$CF_3$ alkyl radical intermediates to carbocations that are later trapped by $Cl^-$ (FIG. 19C). 4-phenyl butene was used as the model substrate, and a $^{19}F$ NMR conversion of 74% was obtained for the desired regioselective chlorotrifluoromethylated product and only 7% of its regioisomer. No homodifunctionalized products found in Lin's reaction were observed (FIG. 19A).

During reaction optimization (FIG. 20), a frequency of f (10-1000 Hz) and $V_{real,\ peak}$ (2.8-1.5 V) was varied. This work revealed that chlorotrifluoromethylation of 4-phenyl butene at 100 Hz and 2.1 V (entry 5) using 2 equiv of triflyl chloride, 0.1 equiv of triethylamine, and $LiClO_4$ as an electrolyte in acetonitrile for 48 h afforded the desired regioselective chlorotrifluoromethylated product in 66% yield. The selectivity between the two regioisomers product (1/2) was found to be 11:1 based on the isolated yield. Both f and V strongly affected the yield and selectivity (entry 2-4 and 6-7). The results were compared to paired electrolysis with constant voltage (entry 8), and only 31% of the desired product was obtained with 55% of its regioisomer.

This control DC experiment was conducted using a commercially available electrasyn 2.0 instrument, and the poor selectivity between two regioisomers of 1:2 resulted. Another important factor observed in this reaction scheme is the critical role of triethylamine ($Et_3N$) towards the reaction completion. The reaction only occurs in the presence of a catalytical amount (7 uL) of $Et_3N$, and $2^{nd}$ addition of $Et_3N$ after 24 hours is required to complete the reaction. It was hypothesized that this acts as an initiator to drive this sequential reaction under the ACE method.

Figure 20:
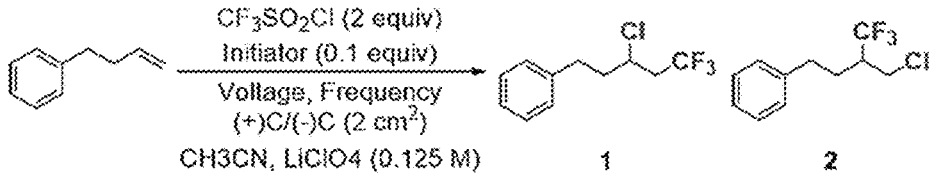
FIG. 20. The depicted reaction was conducted using 0.5 mmol of 4-phenyl butene (1 equiv) in 4 ml of acetonitrile. [b]The conversion and the ratio of 1/2 were determined by $^{19}$F NMR using hexafluorobenzene as the internal standard. [c] Isolated yield. [d]0.1 equiv of $Et_3N$ were added in every 24 hours. [e]DC reaction was conducted by using electrasyn 2.0.

Overall, the results in FIG. 20 confirm the ability to perform chlorotrifluoromethylation of alkenes using the ACE.

Next, the substrate scope for chlorotrifluoromethylation was evaluated using the disclosed ACE method. As outlined in FIG. 21B, the frequency was kept at 100 Hz, and the voltage was varied between 1.8 V and 2.5 V to obtain the highest yields for different substrates.

Figure 19D:
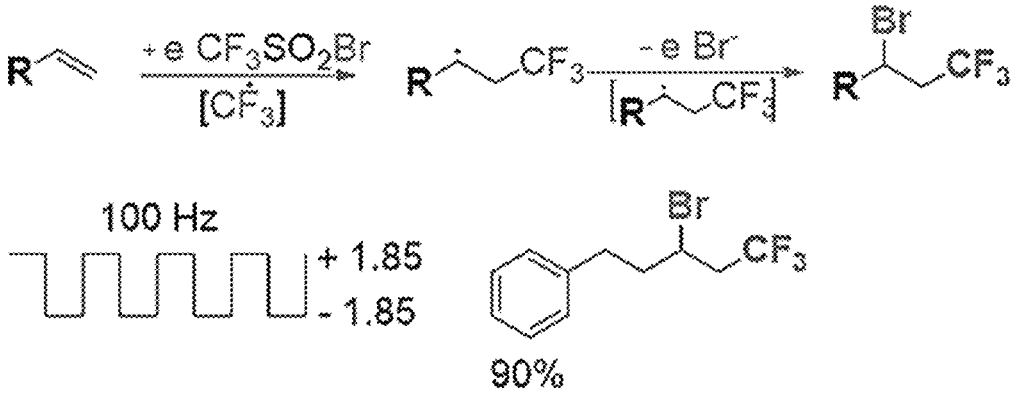

The bromotrifluoromethylation of alkene using $CF_3SO_2Br$ reagent was also assessed. Based on the theory mentioned above, a 100 Hz square waveform was applied to sequentially reduce $CF_3SO_2Br$ to $CF_3$ radicals and oxidize the $\alpha$-$CF_3$ alkyl radical intermediates to carbocations that are later trapped by Br (FIG. 19D). The 4-phenyl butene was used as the model substrate, and a $^{19}F$ NMR conversion of 90% was obtained for the desired bromotrifluoromethylated product with an isolated yield of 88%. No regioisomer products were observed as observed in the chlorotrifluoromethylation reaction. Most importantly, the reaction was completed within two hours.

Figure 21A:
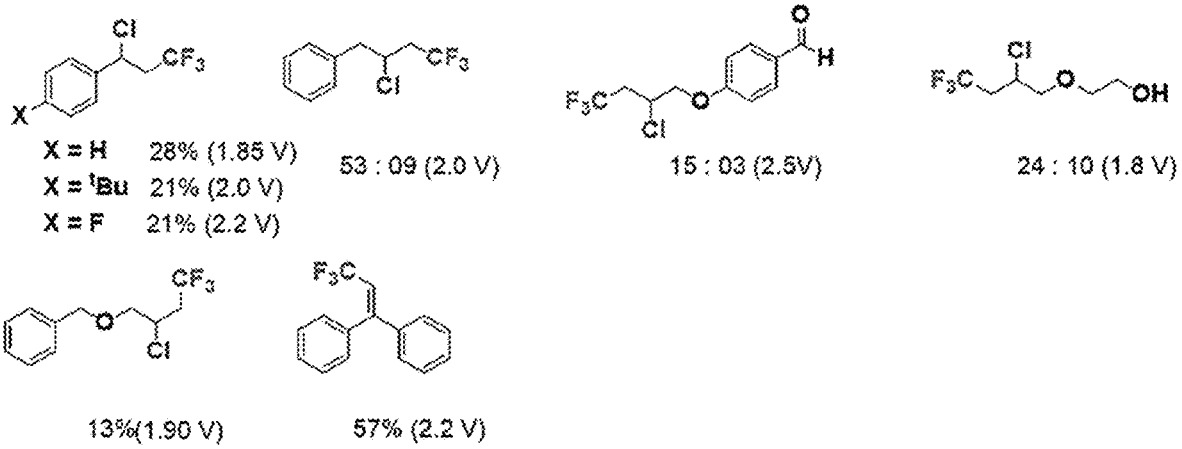
FIGS. 21A-21K Scope of selectivity. [a]All reactions were carried out on a 0.5 mmol scale. Yield determined by $^{19}$F NMR using hexafluorobenzene as the internal standard. (21B-21K) General procedure for heterodifunctionalization. (21B) Chlorotrifluoromethylation synthesis and instrumental setup. (21C) Bromotrifluoromethylation synthesis. (21D) Compound 3. (21E) Compound 4. (21F) Compound 5. (21G) Compound 6. (21H) Compound 7. (21I) Compound 8. (21J) Compound 9. (21K) Compound 10.
Figure 21B:
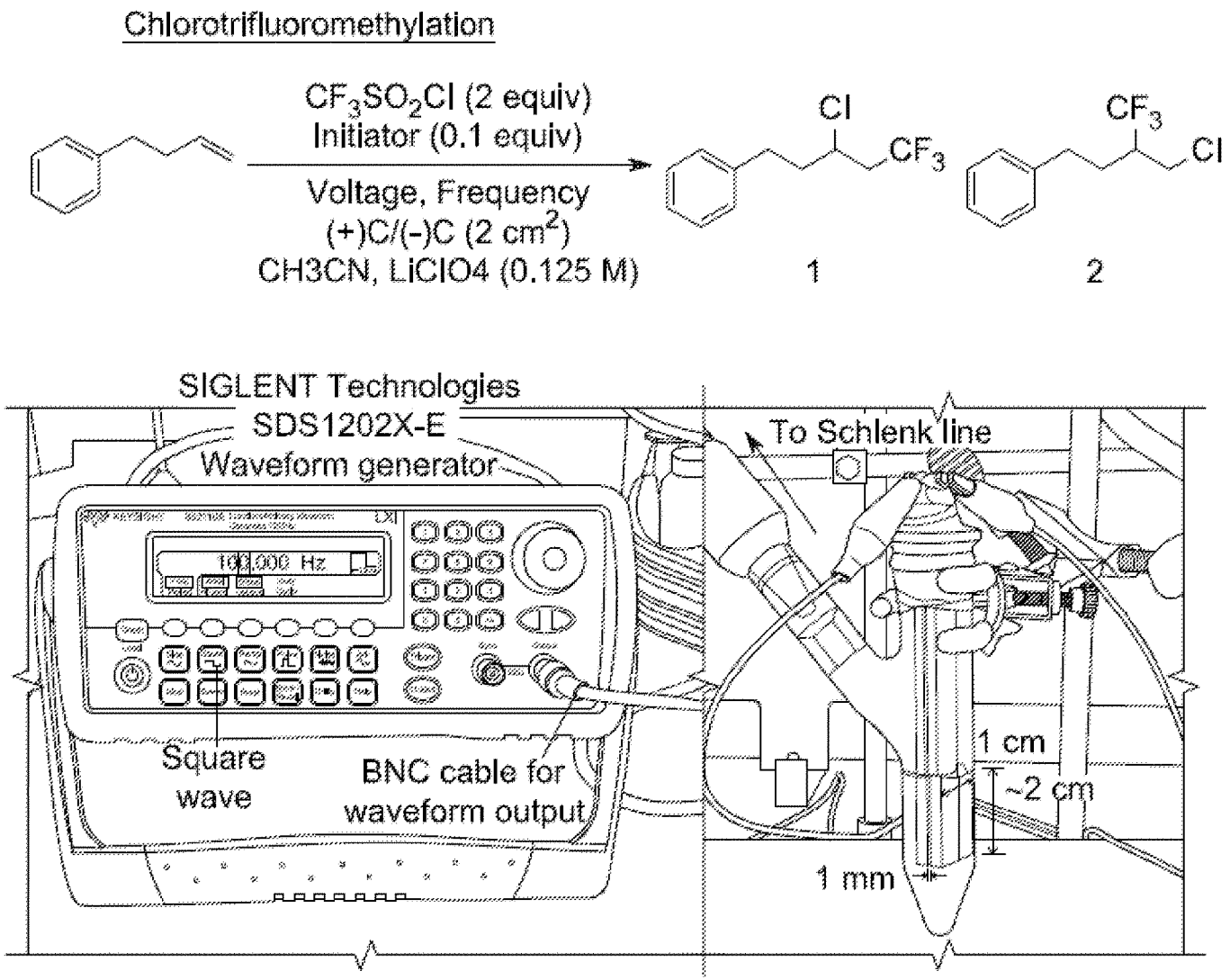

FIGS. 21B-21K describe the general procedure for chlorotrifluoromethylation and bromotrifluoromethylation. FIG. 21B describes the chlorotrifluoromethylation synthesis and instrumental setup. To an oven-dried 10-mL conical Schlenk flask was charged with a triangular magnetic stir bar, $LiClO_4$ (53 mg, 0.5 mmol, 1.0 equiv), $Et_3N$ (7 μL, 0.05 mmol, 0.1 equiv), 4-phenyl-butene (75 μL, 0.5 mmol, 1.0 equiv) and anhydrous acetonitrile (4 mL) under argon. After that, trifluoromethanesulfonyl chloride (106 μL, 1 mmol, 2 equiv) was added to the reaction mixture. Two carbon plate electrodes (3 mm in thickness, 1 cm in width, and 10 cm in length) were then inserted into the reaction flask with an electrode-electrode separation of 1 mm and were connected to a waveform generator (see the photograph above). The carbon electrodes were partially immersed (2 cm) in the solution. The output voltage was set to 2.1 V. The frequency of the square waveform was set to 100 Hz. The reaction mixture was allowed to stir at room temperature while the current was passing through the reaction medium. After the reaction mixture had been stirring for 24 h, the electrodes were removed, and the internal standard hexafluorobenzene (30 μL, 0.25 mmol, 0.5 equiv) was added to the reaction mixture and stirred for 2 min. An aliquot of the crude mixture was removed and used for crude conversion analysis. The conversion of 4-phenyl-butene to regioselective chlorotrifluoromethylated products (1/2) was determined using $^{19}F$ NMR.

After the crude mixture was analyzed using $^{19}F$ NMR, it was diluted with deionized water (5 mL) and extracted with ethyl acetate (3×15 mL). The combined organic extract was washed with saturated aqueous NaCl, dried over $Na_2SO_4$, and concentrated in vacuo at 80 mbar. The crude residue was purified by gradient flash chromatography (100% hexanes) to yield 1 (78 mg, 0.33 mmol, 66%) as a colorless oil.

Figure 21C:
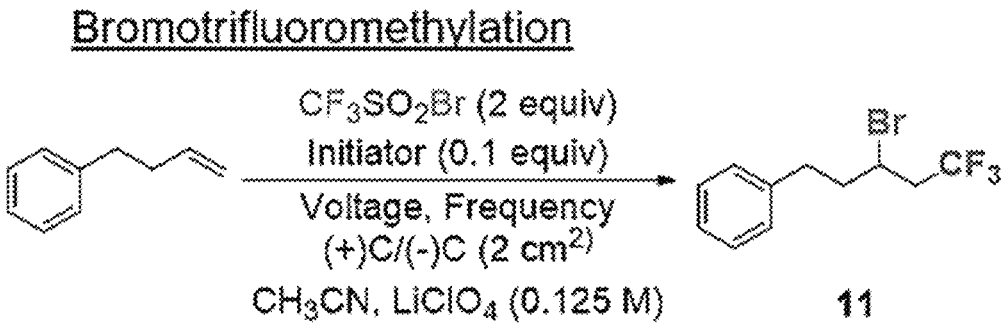

FIG. 21C describes the bromotrifluoromethylation synthesis. The same procedure to synthesize compound 1 was used for the bromotrifluromethylation reaction. However, instead of trifluoromethanesulfonyl chloride, trifluoromethanesulfonyl bromide (108 μL, 1 mmol, 2 equiv) was added to the reaction mixture. Instead of a waveform generator, an AC power source (61501 Programmable AC Source 500VA, Chroma Systems Solutions, Inc.) was used to supply the 100 Hz square waveform. The output voltage was set to 0.85 V. After the crude mixture was analyzed using $^{19}F$ NMR, it was diluted with deionized water (5 mL) and extracted with ethyl acetate (3×15 mL). The combined organic extract was washed with saturated aqueous NaCl, dried over $Na_2SO_4$, and concentrated in vacuo at 80 mbar. The crude residue was purified by gradient flash chromatography (100% n-pentane) to yield 11 (124 mg, 0.44 mmol, 88%) as a colorless oil.

Figure 21D:
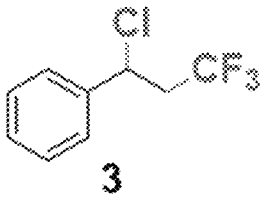

In FIG. 21D, Compound 3 was synthesized from compound styrene (94 μL, 0.5 mmol) using the same procedure to synthesize compound 1. Only $^{19}F$ crude conversion was reported. The voltage was measured at 1.85 V. The $^{19}F$ Crude Conversion was measured at 28%.

Figure 21E:
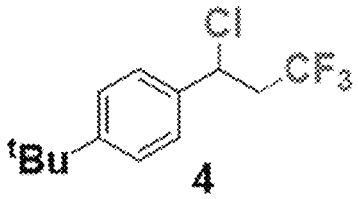

In FIG. 21E, Compound 4 was synthesized from compound 4-tert-butylstyrene (92 μL, 0.5 mmol) using the same procedure to synthesize compound 1. Only $^{19}F$ crude conversion was reported. The voltage was measured at 2.0 V. The $^{19}F$ Crude Conversion was measured at 21%.

Figure 21F:
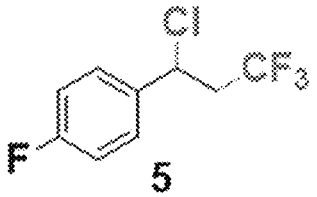

In FIG. 21F, Compound 5 was synthesized from compound 4-fluorostyrene (60 μL, 0.5 mmol) using the same procedure to synthesize compound 1. Only $^{19}F$ Crude Conversion was reported. The voltage was measured at 2.2 V. The $^{19}F$ Crude Conversion was measured at 21%.

Figure 21G:
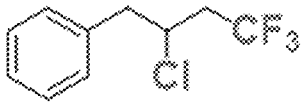

In FIG. 21G, Compound 6 was synthesized from compound allylbenzene (66 μL, 0.5 mmol) using the same procedure to synthesize compound 1. Only $^{19}F$ crude conversion was reported. The voltage was measured at 2.0 V. The $^{19}F$ Crude Conversion was measured at 53%.

Figure 21H:
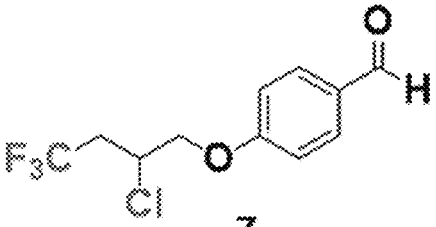

In FIG. 21H, Compound 7 was synthesized from compound 4-allyloxybenzaldehyde (77 μL, 0.5 mmol) using the same procedure to synthesize compound 1. Only $^{19}F$ Crude Conversion was reported. The voltage was measured at 2.5 V. The $^{19}F$ Crude Conversion was measured at 13%.

Figure 21I:
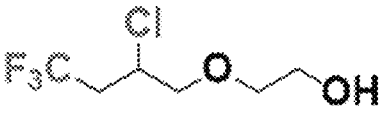

In FIG. 21I, Compound 8 was synthesized from compound 2-allyloxyethanol (54 μL, 0.5 mmol) using the same procedure to synthesize compound 1. Only $^{19}F$ Crude Conversion was reported. The voltage was measured at 1.8 V. The $^{19}F$ Crude Conversion was measured at 24%.

Figure 21J:
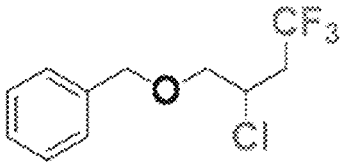

In FIG. 21J, Compound 9 was synthesized from compound allyl benzyl ether (77 μL, 0.5 mmol) using the same procedure to synthesize compound 1. Only $^{19}F$ crude conversion was reported. The voltage was measured at 1.90 V. The $^{19}F$ Crude Conversion was measured at 13%.

Figure 21K:
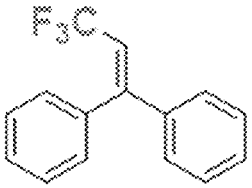

In FIG. 21K, Compound 10 was synthesized from compound 1,1-diphenylethylene (88 μL, 0.5 mmol) using the same procedure to synthesize compound 1. Only $^{19}F$ crude conversion was reported. The voltage was measured at 2.2 V. The $^{19}F$ Crude Conversion was measured at 57%.

The described method's reaction scope can be expanded by replacing $Cl^-/Br^-$ with other nucleophiles, such as alcohol, water, nitrile, amine, and azide, to establish a library for trifluoromethylative heterodifunctionalization reactions of alkenes. By incorporating the nucleophile groups in the substrate, the nucleophilic cyclization can be performed (Noto, et al., *The Journal of Organic Chemistry* 2016, 81 (16), 7064-7071).

Within this disclosure, alcohols include any of a series of hydroxyl compounds, the simplest of which are derived from saturated hydrocarbons, have the general formula $C_nH_{2n}+1OH$, and include ethanol and methanol. Exemplary primary alcohols include butanol, hexanol, heptanol, octanol, nananol, decanol, dodecanol, tetradecanol, and hexadecanol.

Nitrile is classified as an organic chemical molecule that contains a functional group of —C≡N.

Amines contain a nitrogen atom with a lone pair. Examples of primary amines include methylamine, ethylamine, propylamine, butylamine, pentylamine, hexylamine, heptylamine, octylamine, 2-ethylhexylamine, cyclohexylamine (CHA), ethanolamine, dimethylaminopropylamine (DMAPA), diethylaminopropylamine, aminoethylpiperazine, aminoethylmorpholine, N-aminoethyl-N'-methylpiperazine, and aminopropyldiethanolamine.

Azides contain the anion N- and may be carbon-azides, i.e., an azide bonded to a carbon. Azides can react with compounds containing one or more carbon triple and nitriles.

ACE for performing heterodifunctionalization reactions that are initiated by an anodic reaction are also disclosed. For example, the dicarbofunctionalization of styrenes (a chemical compound that contains the formula of $C_6H_5CH{=}CH_2$) with $CO_2$ and $NaSO_2CF_3$ (Yatham, et al., *Angew. Chem., Int. Ed.* 2017, 56 (36), 10915-10919) starts with the oxidative generation of CF radicals from $NaSO_2CF_3$. $CF_3$ radicals react with styrenes to produce radical intermediates, which undergoes reductive carboxylation with $CO_2$. This approach provides ACE as a general strategy for regioselective heterodifunctionalization of alkenes.

Figure 22:
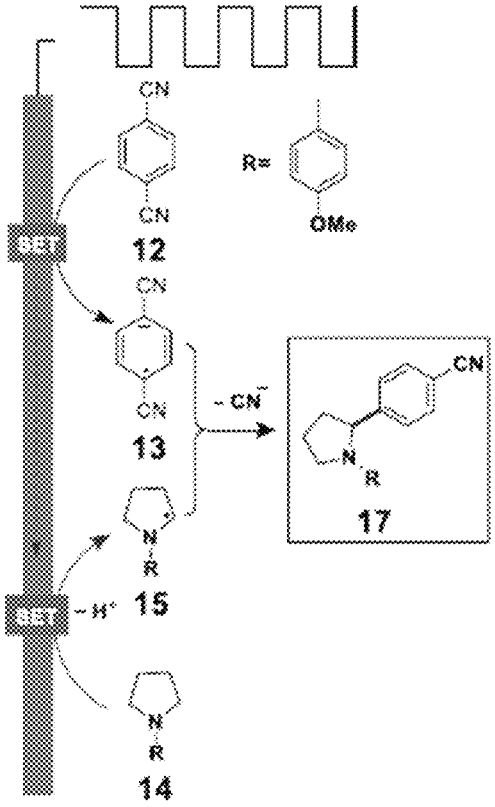
FIG. 22. Electrochemical C—H arylation of pyrrolidine (14) using ACE.
Figure 24:
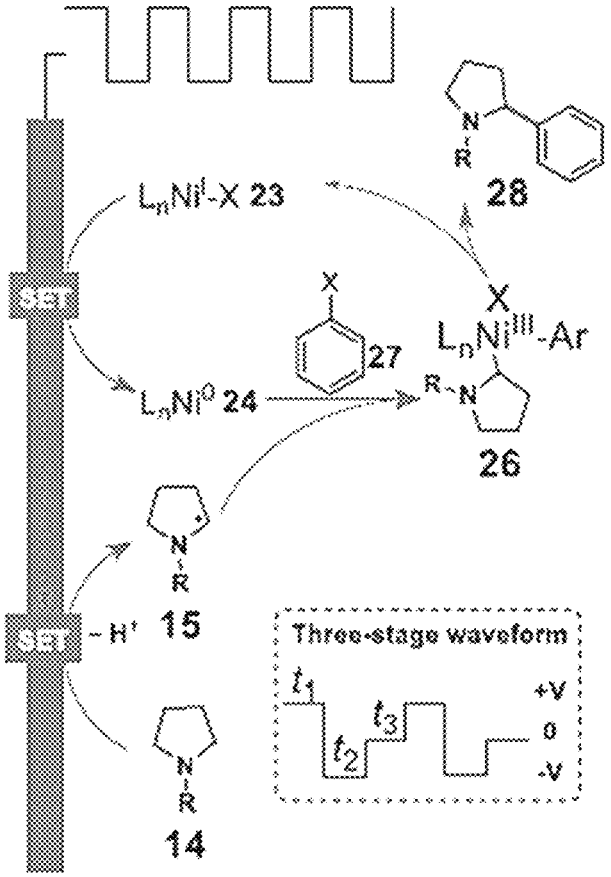
FIG. 24. Electrochemical C—H arylation of amines with aryl halide using Ni catalyzed ACE. Insert: A three-stage waveform.

FIG. 22 illustrates electrochemical C—H arylation of pyrrolidine (14) using ACE. The reaction was previously performed by photo-redox catalysis (see the mechanism in FIG. 3C). In ACE, however, dicyanobenzene (12) and the model substrate pyrrolidine (14) are separately reduced and oxidized to their radicals (13 and 15) during the cathodic and anodic pulses of a square wave (FIG. 24). These two radicals are coupled to yield the final product 17. At 100 Hz and 8 V, a product yield of 48% was obtained. Interestingly, a similar yield of 36% at a constant voltage of 3.6 V was observed. These results confirmed the feasibility of performing α-amino C—H arylation using ACE and allowed the comparison between ACE and paired electrolysis in-depth.

Figure 23A:
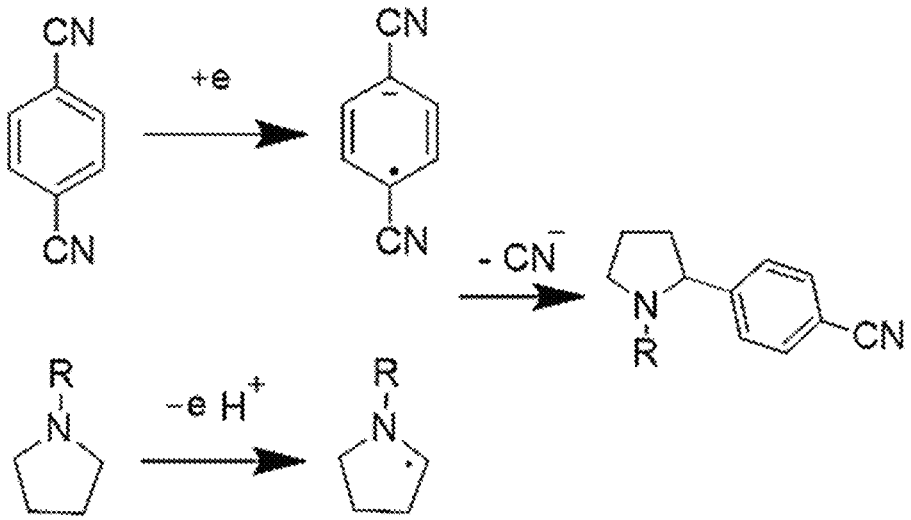
Figure 23B:
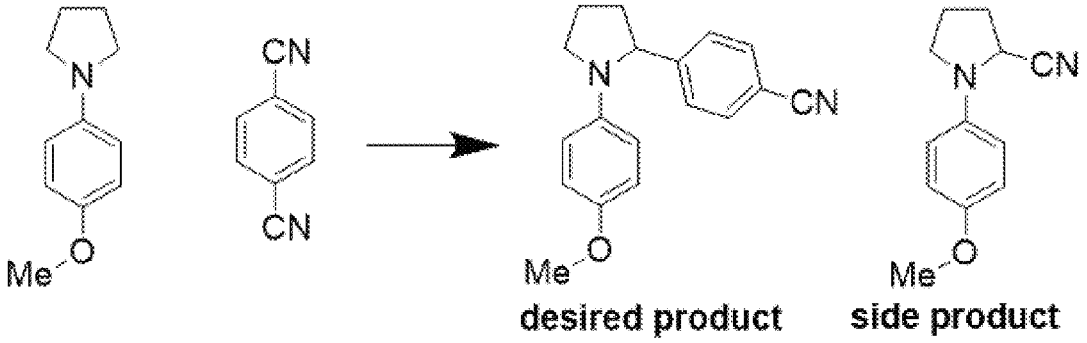

FIGS. 23A-23C illustrate α-amino C—H arylation reaction using ACE. The α-arylated benzylic amines are a prominent structural class found among medicinal agents (e.g., Tadalafil for treating erectile dysfunction). Overoxidation of the amines is a common problem for this type of reaction under electrochemical conditions, leading to low product yield and poor product selectivity. In the ACE approach, the alternating voltage was applied for the α-amino C—H arylation reaction. During ACE, the starting materials, dicyanobenezene, and amine are separately reduced and oxidized to their radicals during the cathodic and anodic pulses of an AC waveform, respectively. Then the two radicals are coupled to yield the final product (FIG. 23A).

It was hypothesized that ACE could suppress the overoxidation of amine by tuning the frequency of the AC waveform to control the time for the oxidation and reduction pulses. Results confirmed this hypothesis. The coupling product yield increased from 24% using a constant voltage of 2.0 V (entry 1, FIG. 23B) to 73% using a 10 Hz sin waveform (entry 2, FIG. 23B). It was interesting that selectivity towards the desired product changes from the desired product to a side product ratio of 24:21 using a constant voltage to 73:00 using ACE, respectively. The substrate scope was expanded using ACE (FIG. 23C).

FIGS. 23D-23G show the general procedure for a amine arylation, instrumentation, and structures.

FIG. 23D shows the synthesis of a amine arylation and instrumental setup. To an oven-dried 10-mL conical Schlenk flask was charged with a triangular magnetic stir bar, $LiClO_4$ (53 mg, 0.5 mmol, 1.0 equiv), NaOAc (82 mg, 1.0 mmol, 2.0 equiv), 1,4-dicyanobenzene (64 mg, 0.5 mmol, 1.0 equiv) and N-(p-methoxyphenyl)pyrrolidine (132.8 mg, 0.75 mmol, 1.5 equiv) under argon. After the conical Schlenk flask was evacuated and refilled with argon (repeated 3 times), the anhydrous dimethylacetamide (DMA) (4 mL) was then added to the flask under the argon. Two carbon plate electrodes (3 mm in thickness, 1 cm in width, and 10 cm in length) were then inserted into the reaction flask with an electrode-electrode separation of 1 mm and were connected to a waveform generator. The carbon electrodes were partially immersed (2 cm) in the solution. The output waveform is a 10 Hz sine wave with a root mean square (RMS) voltage of 2.0 V. The reaction mixture was stirred at room temperature while the current was passing through the reaction medium. After the reaction mixture had been stirring for 24 h, the electrodes were removed, and the internal standard dichloromethane (16 μL, 0.25 mmol, 0.5 equiv) was added to the reaction mixture and stirred for 2 min. An aliquot of the crude mixture was removed and used for crude conversion analysis. The conversion of N-(p-methoxyphenyl)pyrrolidine (1) to 4-(1-(4-methoxyphenyl)pyrrolidin-2yl)benzonitrile (2) was determined using $^1H$ NMR.

Isolation of compound 2: After the crude mixture was analyzed using $^1H$ NMR, it was diluted with ethyl acetate and added to a separatory funnel containing 25 mL of a saturated aqueous solution $NaHCO_3$ and extracted with EtOAc (10 mL for three times). The combined organic extracts were dried using $MgSO_4$ and concentrated in vacuo. The crude residue was purified by gradient flash chromatography (2% to 10%, ethyl acetate in hexane) to yield compound 2 (101 mg, 0.36 mmol, 73%) as a slightly yellow solid.

In FIG. 23E, Compound 3 was synthesized from N-(4-fluorophenyl)pyrrolidine (123.8 mg, 0.75 mmol) using the same procedure to synthesize compound 2 using a sine wave with an RMS voltage of 3.0 V and frequency of 125 Hz. The Conversion was measured at 77%.

Figure 23F:
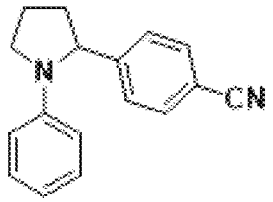

In FIG. 23F, Compound 4 was synthesized from N-phenylpyrrolidine (110.3 mg, 0.75 mmol) using the same procedure to synthesize compound 2 using a sine wave with an RMS voltage of 3.0 V and frequency of 5 Hz. The Conversion was measured at 70%.

Figure 23G:
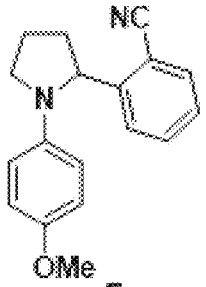

In FIG. 23G, Compound 5 was synthesized from 1,2-dicyanobenzene (64 mg, 0.5 mmol, 1.0 equiv) and N-(p-methoxyphenyl) pyrrolidine (132.8 mg, 0.75 mmol, 1.5 equiv) using the same procedure to synthesize compound 2 using a sine wave with an RMS voltage of 2.0 V and frequency of 10 Hz. The Conversion was measured at 61%.

FIG. 24 illustrates electrochemical C—H arylation of amines with aryl halide using Ni catalyzed ACE. The insert shows a three-stage waveform. In the reaction, C—H functionalization of amines with aryl halides (Joe, et al., *Angew. Chem., Int. Ed.* 2016, 55, 4040). The $Ni^1$ catalyst (23) is reduced to $Ni^0$ (24), while the amine (14) is oxidized to its radical (15). 24 activates aryl halide (27) and mediates the coupling of aryl and α-amino radicals by forming intermediate (26). The following reductive elimination then yields the final product (28) and regenerates 23. The feasibility of this experimental design was tested at 4.4 V and 10 Hz. The product 28 was detected using mass spectrometry, and no product was observed in the absence of the Ni catalyst. These results have confirmed the possibility of performing α-amino C—H arylation with aryl halide using Ni-catalyzed ACE.

Exemplary amines that can be α-arylated include pyrimidine, pyrrolidine (e.g., five-membered pyrrolidine); piperidine (e.g., six-membered piperidine); morpholine; N-Boc (where Boc is tert-butoxycarbonyl); piperazine; seven-membered azepane rings; N-naphthyl-substituted amines; acyclic amines; benzonitriles substituted with esters; amides; phosphonate esters; electron-deficient tetrazoles; 1,2-dicyanobenzene; pyridine (e.g., cyano-substituted pyridines); azaindoles; five-membered heterocycles (e.g., triazole), imidazole, indole, aniline, histidine, and tryptophan.

Unless otherwise indicated, the present disclosure practice can employ conventional techniques of chemistry, organic chemistry, biochemistry, analytical chemistry, physical chemistry, and electrochemistry. These methods are described in the following publications. See, e.g., Harcourt, et al., Holt McDougal Modern Chemistry: Student Edition (2018); J. Karty, Organic Chemistry Principles and Mechanisms (2014); Nelson, et al., Lehninger Principles of Biochemistry 5th edition (2008); Skoog, et al., Fundamentals of Analytical Chemistry (8th Edition); Atkins, et al., Atkins' Physical Chemistry (11th Edition); Lefrou, et al., Electrochemistry: The Basics, with Examples, 2012.

For example, Redox (short for reduction-oxidation reaction) is a chemical reaction in which the oxidation states of atoms are changed. Any such reaction involves both a reduction process and a complimentary oxidation process, two key concepts involved with electron transfer processes. Redox reactions include all chemical reactions in which atoms have their oxidation state changed; in general, redox reactions involve the transfer of electrons between chemical species. The chemical species from which the electron is stripped is said to have been oxidized, while the chemical species to which the electron is added is said to have been reduced. The processes of oxidation and reduction occur simultaneously and cannot happen independently of one another. Although oxidation and reduction properly refer to change in oxidation state, the actual transfer of electrons may not actually occur. The oxidation state of an atom refers to the fictitious change that an atom would have if all bonds between atoms of different elements were 100% ionic. Thus, oxidation can best be defined as an increase in oxidation, and reduction as a decrease in oxidation state. In practice, the transfer of electrons will always cause a change in oxidation state; however, many reactions may be classified as redox even though no electron transfer occurs (i.e. those involving covalent bonds).

An oxidizing agent (oxidant, oxidizer) refers to a substance that has the ability to oxidize other substances (i.e. cause them to lose electrons). Substances that have the ability to oxidize other substances (cause them to lose electrons) are said to be oxidative or oxidizing and are known as oxidizing agents, oxidants, or oxidizers. That is, the oxidizing agent removes electrons from another substance, and is thus itself reduced. Because it "accepts" electrons, the oxidizing agent may also be called an electron acceptor, Oxygen is a quintessential oxidizer, Common oxidizing agents include, but are not limited to, oxygen, hydrogen peroxide, and the halogens. Oxidants are usually chemical substances with elements in high oxidation states (e.g. $H_2O_2$, $MnO_4^-$, $CrO_3$, $Cr_2O_7^{2-}$, $OsO_4$) or else highly electronegative elements ($O_2$, $F_2$, $Cl_2$, $Br_2$) that can gain extra electrons by oxidizing another substance. In one sense, an oxidizing agent is a chemical species that undergoes a chemical reaction that removes one or more electrons from another atom. In that sense, it is one component in an oxidation-reduction (redox) reaction. In another sense, an oxidizing agent is a chemical species that transfers electronegative atoms, usually oxygen, to a substrate.

In particular embodiments, the oxidizing agent may be an electron acceptor. Electron acceptors participate in electron-transfer reactions. In this context, the oxidizing agent is called an electron acceptor and the reducing agent is called an electron donor. Extensive tabulations and rankings of the electron accepting properties of various reagents (redox potentials) are available. The mechanism and details of the electron transfer event can be described as inner sphere or outer sphere, Exemplary electron acceptor oxidizing agents include, but are not limited to, tetracyanoquinodimethane, the ferrocenium ion $Fe(C_5H_5)^{2+}$, which accepts an electron to form $Fe(C_5H_5)_2$, the radical cation derived from $N(C_6H_{4\text{-}4}.Br)_3$ ("Magic blue"), and the like.

In particular embodiments, the oxidizing agent is an atom-transfer reagent. Commonly, an oxidizing agent as an atom-transfer reagent transfers oxygen atoms to a substrate. In this context, the oxidizing agent can be termed an oxygenation reagent or an oxygen-atom transfer (OAT) agent. Exemplary oxygen-atom transfer agents include, but are not limited to, $MnO^{4-}$ (permanganate), $CrO_4^{2-}$ (chromate), $OsO_4$ (osmium tetroxide), and $ClO^{4-}$ (perchlorate). In some instances, these oxide species can also serve as electron acceptors, as illustrated by the conversion of $MnO_4^-$ to $MnO_4^{2-}$, manganite. In a preferred embodiment, the oxidizing agent is an oxygen-atom transfer agent. Exemplary suitable oxygen-atom transfer agent oxidizing agents include, but are not limited to, oxygen ($O_2$), ozone ($O_3$), hydrogen peroxide ($H_2O_2$), tert-butyl hydroperoxide (TBHP) and other inorganic peroxides, Fenton's reagent, fluorine ($F_2$), chlorine ($Cl_2$), bromine ($Br_2$), iodine ($I_2$) and other halogens, nitric acid ($HNO_3$) and nitrate compounds, sulfuric acid ($H_2SO_4$), peroxydisulfuric acid ($H_2S_2O_8$), peroxymonosulfuric acid ($H_2SO_5$), chlorite, chlorate ($ClO_3^-$), perchlorate and other analogous halogen compounds, hypochlorite ($ClO^-$) and other hypohalite compounds, sodium hypochlorite (NaClO) hexavalent chromium compounds (i.e. chromic and dichromic acids and chromium trioxide ($CrO_3$), pyridinium chlorochromate (PCC) and chromate/dichromate ($CrO_4^{2-}/Cr_2O_7^{2-}$) compounds), permanganate compounds (i.e. potassium permanganate), sodium perborate, nitrous oxide ($N_2O$), potassium nitrate ($KNO_3$), sodium bismuthate, sulfur dioxide ($SO_2$), and the like. In a most preferred embodiment, the oxidizing agent is hydrogen peroxide.

In particular embodiments, reducing agents include electron donors including triethanolamine, ethylenediamine, ethylenediaminetetraacetate, ethylenediamine hydrochloride, triethylamine, mercaptoethanol, and the like. In particular embodiments, exemplary reducing agents include sodium dithionate, amidoximes such as phenylamidoxime, 2-thienylamidoxime, and p-phenoxyphenylamidoxime; azines such as 4-hydroxy-3,5-dimethoxy-benzaldehydeazine; combinations of aliphatic carboxylic acid arylhydrazides with ascorbic acid such as a combination of 2,2'-bis(hydroxymethyl)propionyl-β-phenylhydrazine with ascorbic acid: combinations of polyhydroxybenzenes with hydroxylamine, reductone and/or hydrazine, such as combinations of hydroquinone with bis(ethoxyethyl)hydroxylamine, piperidinohexosereductone or formyl-4-methylphenyl-hydrazine: hydroxamic acids such as phenylhydroxamic acid, p-hydroxyphenylhydroxamic acid, and β-anilinehydroxamic acid; combinations of azines with sulfonamidophenols such as a combination of phenothiazine with 2,6-dichloro-4-benzenesulfonamidephenol; α-cyanophenyl acetic acid derivatives such as ethyl-α-cyano-2-methylphenyl acetate and ethyl-α-cyanophenyl acetate; bis-β-naphthols such as 2,2'-dihydroxy-1-1'-binaphthyl, 6,6'-dibromo-2,2'-dihydroxy-1,1-binaphthyl, and bis(2-hydroxy-1-naphthyl)methane; combinations of bis-β-naphthols with 1,3-dihydroxybenzene derivatives such as 2,4-dihydroxybenzophenone and 2',4'-dihydroxyacetophenone; 5-pyrazolones such as 3-methyl-1-phenyl-5-pyrazolone; reductones such as dimethylaminohexose-reductone, anhydrodihydroaminohexosereductone and anhydrodihydropiperidone-hexosereductone; sulfonamidephenol reducing agents such as 2,6-dichloro-4-benzenesulfonamide-phenol and p-benzenesulfonamidephenol; 2-phenylindane-1,3-dione, etc.; chromans such as 2,2-dimethyl-7-t-butyl-6-hydroxychroman; 1,4-dihydropyridines such as 2,6-dimethoxy-3,5-dicarboethoxy-1,4-dihydropyridine; bisphenols such as bis(2-hydroxy-3-t-butyl-5-methylphenyl)methane, 2,2-bis(4-hydroxy-3-methylphenyl)propane, 4,4-ethylidene-bis(2-t-butyl-6-methylphenol), 1,1-bis(2-hydroxy-3,5-dimethylphenyl)-3,5,5-trimethylhexane, and 2,2-bis(3,5-dimethyl-4-hydroxyphenyl)propane; ascorbic acid derivatives such as 1-ascorbyl palmitate and ascorbin stearate; aldehydes and ketones such as benzil and diacetyl; 3-pyrazolidones; sodium dithionate and certain indane-1,3-diones.

ACE can be carried out in the presence of supporting electrolytes. Electrolytes can be added to adjust the conductivity of the electrolysis solution and/or to control the selectivity of the reaction. The electrolyte content can generally be at a concentration from 0.1 to 10, preferably from 1 to 5 wt %, in each case based on the ACE reaction mixture. Exemplary supporting electrolytes include protic acids (e.g., methanesulfonic acid, benzenesulfonic acid, or toluenesulfonic acid) and mineral acids (e.g., sulfuric acid and phosphoric acid). Additionally, supporting electrolytes can be neutral salts.

In some embodiments, ACE may be conducted at a temperature in the range of 15° C. to 100° C. The reactions can beneficially be performed at a temperature close to ambient temperature, particularly from 15 to 20° C.

One of ordinary skill in the art can achieve and maintain a desired pH of an ACE aqueous solution. In one example, KOH may be used to adjust the pH. In another example, hydroxides, metal oxides, carbonates, phosphates, amines, carboxylic acids, mineral acids, and mixtures thereof may be used to adjust and maintain the pH.

Each embodiment disclosed herein can comprise, consist essentially of, or consist of its particular stated element, step, ingredient, or component. Thus, the terms "include" or "including" should be interpreted to recite: "comprise, consist of, or consist essentially of." The transition term "comprise" or "comprises" means has, but is not limited to, and allows for the inclusion of unspecified elements, steps, ingredients, or components, even in major amounts. The transitional phrase "consisting of" excludes any element, step, ingredient, or component not specified. The transition phrase "consisting essentially of" limits the scope of the embodiment to the specified elements, steps, ingredients, or components and to those that do not materially affect the embodiment. A material effect would cause a statistically significant reduction in the ability to obtain a claimed effect according to a relevant experimental method described in the current disclosure, for example, the ability to obtain a comparable yield (within 15%) in a synthesis method based on similar AC current applications.

Unless otherwise indicated, all numbers expressing quantities of ingredients, properties such as molecular weight, reaction conditions, and so forth used in the specification and claims are to be understood as being modified in all instances by the term "about." Accordingly, unless indicated to the contrary, the numerical parameters set forth in the specification and attached claims are approximations that may vary depending upon the desired properties sought to be obtained by the present invention. At the very least, and not as an attempt to limit the application of the doctrine of equivalents to the scope of the claims, each numerical parameter should at least be construed in light of the number of reported significant digits and by applying ordinary rounding techniques. When further clarity is required, the term "about" has the meaning reasonably ascribed to it by a person skilled in the art when used in conjunction with a stated numerical value or range, i.e., denoting somewhat more or somewhat less than the stated value or range, to within a range of ±20% of the stated value; ±19% of the stated value; ±18% of the stated value; ±17% of the stated value; ±16% of the stated value; ±15% of the stated value; ±14% of the stated value; ±13% of the stated value; ±12% of the stated value; ±11% of the stated value; ±10% of the stated value; ±9% of the stated value; ±8% of the stated value; ±7% of the stated value; ±6% of the stated value; ±5% of the stated value; ±4% of the stated value; ±3% of the stated value; ±2% of the stated value; or ±1% of the stated value.

Notwithstanding that the numerical ranges and parameters setting forth the broad scope of the invention are approximations, the numerical values set forth in the specific examples are reported as precisely as possible. Any numerical value, however, inherently contains certain errors necessarily resulting from the standard deviation found in their respective testing measurements.

The terms "a," "an," "the," and similar referents used in the context of describing the invention (especially in the context of the following claims) are to be construed to cover both the singular and the plural unless otherwise indicated herein or clearly contradicted by context. Recitation of ranges of values herein is merely intended to serve as a shorthand method of referring individually to each separate value falling within the range. Unless otherwise indicated herein, each individual value is incorporated into the specification as if it were individually recited herein. All methods described herein can be performed in any suitable order unless otherwise indicated herein or otherwise clearly contradicted by context. The use of any and all examples or exemplary language (e.g., "such as") provided herein is intended merely to better illuminate the invention and does not pose a limitation on the scope of the invention otherwise claimed. No language in the specification should be construed as indicating any non-claimed element essential to the practice of the invention.

Groupings of alternative elements or embodiments of the invention disclosed herein are not to be construed as limitations. Each group member may be referred to and claimed individually or in any combination with other members of the group or other elements found herein. It is anticipated that one or more members of a group may be included in, or deleted from, a group for reasons of convenience and/or patentability. When any such inclusion or deletion occurs, the specification is deemed to contain the group as modified, thus fulfilling the written description of all Markush groups used in the appended claims.

Certain embodiments of this invention are described herein, including the best mode known to the inventors for carrying out the invention. Of course, variations on these described embodiments will become apparent to those of ordinary skill in the art upon reading the foregoing description. The inventor expects skilled artisans to employ such variations as appropriate, and the inventors intend for the invention to be practiced otherwise than specifically described herein. Accordingly, this invention includes all modifications and equivalents of the subject matter recited in the claims appended hereto as permitted by applicable law. Moreover, any combination of the above-described elements in all possible variations thereof is encompassed by the invention unless otherwise indicated herein or otherwise clearly contradicted by context.

Furthermore, numerous references have been made to patents, printed publications, journal articles, and other written text throughout this specification (referenced materials herein). Each of the referenced materials are individually incorporated herein by reference in their entirety for their referenced teaching.

In closing, it is to be understood that the embodiments of the invention disclosed herein are illustrative of the principles of the present invention. Other modifications that may be employed are within the scope of the invention. Thus, by way of example, but not of limitation, alternative configurations of the present invention may be utilized in accordance with the teachings herein. Accordingly, the present invention is not limited to that precisely as shown and described.

The particulars shown herein are by way of example and for purposes of illustrative discussion of the preferred embodiments of the present invention only and are presented in the cause of providing what is believed to be the most useful and readily understood description of the principles and conceptual aspects of various embodiments of the invention. In this regard, no attempt is made to show structural details of the invention in more detail than is necessary for the fundamental understanding of the invention, the description taken with the drawings and/or examples making apparent to those skilled in the art how the several forms of the invention may be embodied in practice.

Definitions and explanations used in the present disclosure are meant and intended to be controlling in any future construction unless clearly and unambiguously modified in the examples or when application of the meaning renders any construction meaningless or essentially meaningless. In cases where the construction of the term would render it meaningless or essentially meaningless, the definition should be taken from Webster's Dictionary, 3rd Edition or a dictionary known to those of ordinary skill in the art, such as the Oxford Dictionary of Biochemistry and Molecular Biology (Eds. Attwood T et al., Oxford University Press, Oxford, 2006).

What is claimed:

1. A method of synthesizing an organic molecule using alternating current (AC) electrolysis comprising:

obtaining a container housing an aqueous solution, an electrode, and a reaction group, wherein the reaction group comprises a sequential reaction pair comprising a first member comprising $CF_3SO_2Cl$, $CF_3SO_2Br$, $CF_3SO_2I$, $CF_3SO_2Na$, $Zn(SO_2CO_3)_2$, or $NaSO_2CF_3$, and a second member comprising an arene, heteroarene, or alkene; and applying an AC to the electrode for a sufficient period of time, thereby synthesizing the organic molecule.

2. The method of claim 1, wherein the first member is $CF_3SO_2Cl$, the second member is 2-acetylpyrrole, and the container further comprises $K_2HPO_4$.

3. The method of claim 2, wherein the synthesized organic molecule is trifluoromethylated 2-acetylpyrrole or bis-trifluoromethylated 2-acetylpyrrole.

4. The method of claim 1, wherein the first member is $CF_3SO_2Cl$ and the second member is

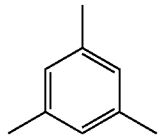

with the synthesized organic molecule comprising

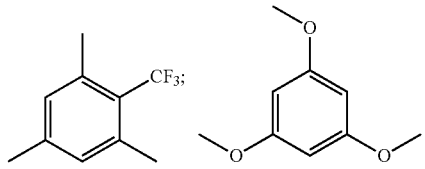

with the synthesized organic molecule comprising

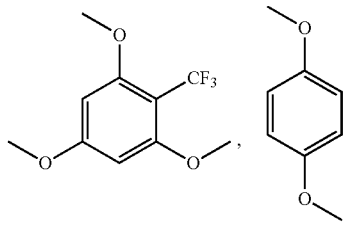

with the synthesized organic molecule comprising

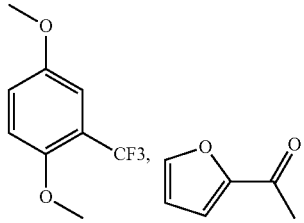

with the synthesized organic molecule comprising

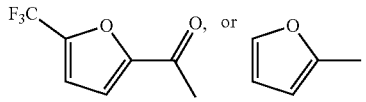

with the synthesized organic molecule comprising

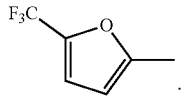

5. The method of claim 1, wherein the first member is $CF_3SO_2Cl$ and the second member is

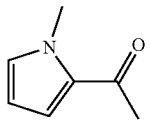

with the synthesized organic molecule comprising

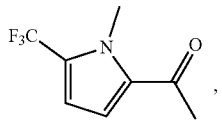

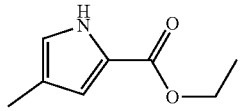

with the synthesized organic molecule comprising

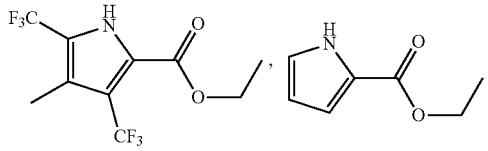

with the synthesized organic molecule comprising,

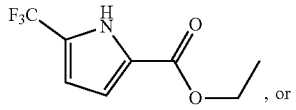

-continued

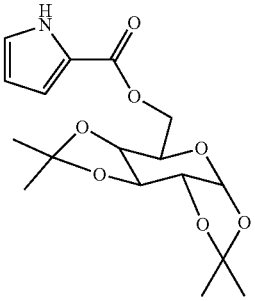

with the synthesized organic molecule comprising

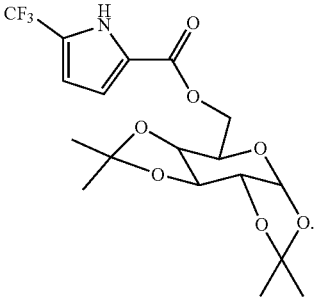

6. The method of claim 1, wherein the first member is $CF_3SO_2Cl$, the second member is 4-phenyl butene, and the synthesized organic molecule comprises a chloro-trifluoromethylated alkene.

7. The method of claim 6, wherein the chloro-trifluoromethylated alkene is

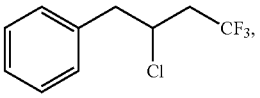

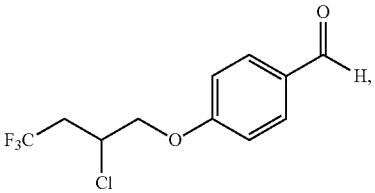

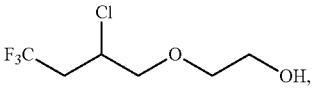

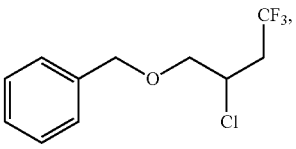

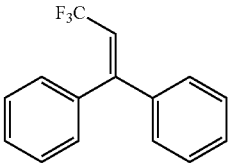

-continued

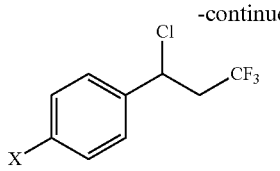

wherein X is H, Bu, or F.

8. The method of claim 1, wherein the first member is $CF_3SO_2Br$ and the second member is the alkene.

9. The method of claim 8, wherein the synthesized organic molecule is a bromo-trifluoromethylated alkene.

10. The method of claim 1, wherein the synthesized organic molecule comprises a functionalized alkene or amine.

11. The method of claim 10, wherein the functionalized alkene comprises a halogen-functionalized alkene.

12. The method of claim 11, wherein the functionalized alkene comprises a trifluoromethylated alkene, a di-trifluoromethylated alkene, a chloro-trifluoromethylated alkene, a bromo-trifluoromethylated alkene or a halide-arylated amine.

13. The method of claim 1, wherein the applied AC has a voltage between 1 and 10 volts.

14. The method of claim 1, wherein the applied AC has a frequency between 1 and 10,000 Hertz.

15. The method of claim 1, wherein the applied AC has a voltage between 2 and 10 volts and a frequency between 1 and 10,000 Hertz.

16. The method of claim 1, wherein the applied AC has a voltage between 1.8 and 2.5 volts or between 4.0 and 4.8 volts and a frequency between 90-110 Hertz.

17. The method of claim 1, wherein the electrode comprises platinum, carbon, or nickel.

18. The method of claim 1, wherein the reaction group comprises a nucleophilic group.

19. The method of claim 18, wherein the nucleophilic group comprises a nitrile, an amine, or an azide.

* * * * *